US009765528B2

(12) United States Patent
Bilge

(10) Patent No.: US 9,765,528 B2
(45) Date of Patent: Sep. 19, 2017

(54) METHOD AND SYSTEM FOR MOUNTING WALL PANELS TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 14/666,976

(22) Filed: Mar. 24, 2015

(65) Prior Publication Data

US 2015/0197940 A1 Jul. 16, 2015

Related U.S. Application Data

(60) Division of application No. 14/107,334, filed on Dec. 16, 2013, now Pat. No. 9,051,741, which is a (Continued)

(51) Int. Cl.

| | |
|---|---|
| ***E04F 13/08*** | (2006.01) |
| ***E04F 13/07*** | (2006.01) |
| ***E04F 13/12*** | (2006.01) |

(52) U.S. Cl.

CPC ..... *E04F 13/0805* (2013.01); *E04F 13/07* (2013.01); *E04F 13/0803* (2013.01); (Continued)

(58) Field of Classification Search

CPC ... E04F 13/0889; E04F 13/12; E04F 13/0803; E04F 13/0805; E04F 13/0891; (Continued)

(56) References Cited

U.S. PATENT DOCUMENTS

| | | | |
|---|---|---|---|
| 1,655,406 A | 1/1928 | Bennett | |
| 1,726,500 A | 8/1929 | Norris | |

(Continued)

FOREIGN PATENT DOCUMENTS

| | | | |
|---|---|---|---|
| DE | 3326054 A1 * | 6/1984 | ..... E04B 9/067 |
| DE | 3732534 A1 | 4/1989 | |

(Continued)

OTHER PUBLICATIONS

Bamco Inc., G500 Wall System., printed on Dec. 8, 2005.
International Search Report & Written Opinion for Application No. PCT/US2014/012496 dated May 22, 2014.

*Primary Examiner* — James Ference
*Assistant Examiner* — Charissa Ahmad
(74) *Attorney, Agent, or Firm* — Richard M. Goldberg

(57) ABSTRACT

A method of assembling wall panels includes mounting a plurality of PVC fastening extrusions to a wall in a predetermined parallel, spaced apart relationship, each having a length much greater than a length of a wall panel and having two spaced apart resilient bent end securing walls extending from a base, each securing wall having a projection, each wall panel having a main wall panel and four bent end sections with recesses and corner openings, pressing a bent end section into the spacing between the securing walls to cause deformation and snapping back thereof a projection engages in a respective recess, sliding said wall panel along the parallel, spaced apart fastening extrusions to a desired position with the corner openings permitting said sliding action, and repeating the steps of pressing and sliding for additional wall panels.

25 Claims, 46 Drawing Sheets

Related U.S. Application Data continuation of application No. 14/044,606, filed on Oct. 2, 2013, now Pat. No. 9,328,518, which is a continuation-in-part of application No. 13/868,574, filed on Apr. 23, 2013, now Pat. No. 8,739,483, which is a continuation-in-part of application No. 13/747,035, filed on Jan. 22, 2013, now Pat. No. 8,833,015.

(52) U.S. Cl.
CPC ..... *E04F 13/0862* (2013.01); *E04F 13/0866* (2013.01); *E04F 13/0889* (2013.01); *E04F 13/0891* (2013.01); *E04F 13/12* (2013.01); *Y10T 403/57* (2015.01)

(58) Field of Classification Search
CPC ... E04F 13/0862; E04F 13/07; E04F 13/0866; Y10T 403/57
See application file for complete search history.

(56) References Cited

U.S. PATENT DOCUMENTS 1,738,469 A 12/1929 Weiss
1,833,174 A 11/1931 Norris
2,054,573 A 9/1936 Mendenhall
2,059,483 A 11/1936 Parsons
2,066,205 A 12/1936 Keating
2,082,241 A 6/1937 Bennett
2,607,971 A 8/1952 Bedford, Jr.
D177,034 S 3/1956 Fridolph
2,789,321 A 4/1957 Adams
2,803,321 A 8/1957 Fox-Williams
3,009,549 A 11/1961 Miller
3,021,915 A 2/1962 Kemp
3,475,870 A * 11/1969 Birum, Jr. ..... E06B 1/12 52/211
3,548,557 A 12/1970 Downing, Jr.
3,671,061 A 6/1972 Dawdy
3,832,820 A 9/1974 Eggert
3,858,377 A 1/1975 Browne et al.
D240,398 S 7/1976 The Scott & Fetzer Co
4,189,880 A 2/1980 Ballin
D258,615 S * 3/1981 Dallaire ..... D25/124
D262,404 S 12/1981 Bittner
4,332,119 A 6/1982 Toews
4,344,267 A 8/1982 Sukolics
D268,809 S 5/1983 Marontate
4,452,029 A 6/1984 Sukolics
4,573,300 A 3/1986 Bezner
4,640,064 A 2/1987 Goodworth, II
4,667,579 A 5/1987 Daw
4,696,142 A 9/1987 Mieyal et al.
4,731,960 A * 3/1988 Sease ..... B44C 7/022 160/392
D299,969 S * 2/1989 Hardy ..... D25/124
4,829,740 A 5/1989 Hutchison
4,833,839 A 5/1989 Kurose
4,833,858 A 5/1989 Hutchison
D307,803 S * 5/1990 Westphal ..... D25/124
4,998,395 A 3/1991 Bezner
D318,707 S 7/1991 Barrow
5,050,360 A 9/1991 Gailey
D330,431 S 10/1992 Wang
D335,624 S * 5/1993 Siener ..... D25/123
5,212,914 A * 5/1993 Martin ..... E04F 13/12 52/235
5,263,292 A 11/1993 Holland et al.
D352,790 S 11/1994 Gullblom
D376,754 S 12/1996 Livingston et al.
5,579,624 A 12/1996 Aeberhard
5,644,878 A 7/1997 Wehrmann
5,809,729 A 9/1998 Mitchell
5,845,446 A 12/1998 Funaki et al.
5,996,301 A 12/1999 Conterno
6,035,598 A 3/2000 Sukolics et al.
6,101,777 A 8/2000 Bodine et al.
6,164,024 A 12/2000 Konstantin
6,205,733 B1 3/2001 LaLonde
6,330,772 B1 12/2001 Mitchell et al.
6,430,885 B1 8/2002 Ito
D462,601 S 9/2002 Chaney
6,536,175 B2 3/2003 Conterno
6,745,527 B1 6/2004 Sherman et al.
6,748,709 B1 6/2004 Sherman et al.
6,751,916 B1 6/2004 Ritzer et al.
6,892,500 B2 5/2005 Zaborowski
D518,900 S 4/2006 Barnett
7,210,273 B2 5/2007 Zahner, III
D554,486 S 11/2007 Emblin
D556,018 S 11/2007 Curtas et al.
D557,112 S 12/2007 Franssen
7,472,521 B2 1/2009 Bilge
7,562,504 B2 7/2009 Herbst et al.
7,562,509 B2 7/2009 Ness
7,621,084 B2 11/2009 Bilge
7,716,891 B2 5/2010 Radford
7,752,818 B1 7/2010 Roegge et al.
8,033,066 B2 10/2011 Griffiths
8,056,289 B1 11/2011 Konstantin
8,127,507 B1 3/2012 Bilge
8,166,716 B2 5/2012 Macdonald et al.
8,225,572 B2 7/2012 Wallace
8,240,099 B2 * 8/2012 Hummel, III ..... E04F 13/081 52/235
8,256,181 B2 9/2012 Voegele, Jr. et al.
8,307,607 B2 11/2012 Conterno
8,316,609 B2 11/2012 Ben-Zvi
8,347,569 B1 1/2013 McIntyre et al.
8,584,424 B2 11/2013 Smith et al.
D698,216 S 1/2014 Waddell
8,650,827 B2 2/2014 Givoni et al.
D731,704 S * 6/2015 Klus ..... D26/138
D733,355 S * 6/2015 Klus ..... D26/138
9,091,079 B2 * 7/2015 Wright ..... E04F 13/0816
2001/0022058 A1 9/2001 Conterno
2002/0035811 A1 3/2002 Heuel
2002/0124514 A1 * 9/2002 Higgins ..... E04F 13/083 52/506.06
2002/0152704 A1 10/2002 Thompson et al.
2003/0110726 A1 6/2003 Rudduck
2004/0134143 A1 7/2004 Boyer
2006/0179744 A1 * 8/2006 Lynch ..... E04F 13/007 52/235
2008/0155917 A1 7/2008 Bilge
2009/0049770 A1 2/2009 Konstantin
2009/0145071 A1 6/2009 Radford
2009/0241444 A1 10/2009 Griffiths
2009/0241451 A1 10/2009 Griffiths
2010/0287858 A1 11/2010 Israeli et al.
2014/0202094 A1 7/2014 Bilge
2015/0292215 A1 10/2015 Bilge

FOREIGN PATENT DOCUMENTS

DE 3732535 A1 4/1989
EP 2166169 A1 3/2010
GB 2135355 A 8/1984
JP 8189176 7/1996

* cited by examiner

METHOD AND SYSTEM FOR MOUNTING WALL PANELS TO A WALL

CROSS-REFERENCE TO RELATED APPLICATIONS

The present application is a Divisional of U.S. patent application Ser. No. 14/107,334, filed Dec. 16, 2013 which is a Continuation of U.S. patent application Ser. No. 14/044,606, filed Oct. 2, 2013 which is a Continuation-In-Part of U.S. patent application Ser. No. 13/868,574, filed Apr. 23, 2013, which in turn, is a Continuation-In-Part of U.S. patent application Ser. No. 13/747,035 to the same inventor herein, filed Jan. 22, 2013 and which are expressly incorporated herein in their entirety.

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation AG500 WALL SYSTEM.@ With this system, the wall panels are provided with right angle or bends at their edges. Each planar panel and the right angle bend together form an L-shape. Each bend is secured by screws to a fastening extrusion having the same linear dimension as the wall panel, and the fastening extrusion has a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

U.S. Pat. No. 7,472,521 and U.S. Pat. No. 7,621,084, by the same inventor herein disclose systems for mounting wall panels to an existing wall structure, which includes a plurality of wall panels. There is also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

The main panel section has a rectangular configuration with four hook walls, and there are four fastening extrusions, with the recess of the retaining wall of each fastening extrusion receiving one hook wall of the wall panel. Each U-shaped cross-sectional profile defines a recess therein, and each fastening extrusion includes at least one stabilizing wall extending from a free end of a respective retaining wall, with the stabilizing wall being received in one recess of a respective U-shaped cross-sectional profile. Each stabilizing wall has an L-shaped cross-sectional profile. Also, the securing section and the retaining wall structure together define a U-shaped cross-sectional profile.

A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel. In a later embodiment, there is only a single fastening extrusion.

There is also at least one channel secured to the securing sections of adjacent fastening extrusions and positioned between adjacent wall panels corresponding thereto. An elongated plug is inserted into each channel for closing off the gap between adjacent wall panels.

This arrangement, however, requires the insertion of screws into the fastening extrusions and the channel while supporting the wall panels, which can be burdensome. It also requires the separate channels and plugs in order to close off the gap between adjacent wall panels to provide an aesthetic appearance between the wall panels. If the gap between adjacent panels is varied, this would also require a plurality of different size plugs, which can further add to the cost of the structure.

A further system has been sold for more than one year by Creative Metal Contractors Inc. of Toms River, N.J., which uses a single fastening extrusion having tongues extending from opposite sides thereof. The single fastening extrusion is secured to the existing wall by screws at a central portion thereof between the tongues. Each wall panel has a main panel section and hook walls at edges of the main panel section, with the main panel section and each hook wall having a U-shaped cross-sectional profile. Fasteners or frame extrusions are secured to the hook walls, with each fastener including walls defining a recess which receives a corresponding tongue of the single fastening extrusion, such that the tongues are spaced away from the hook walls. A compressed joint plug is positioned in overlying relation to the screws and between adjacent hook walls to provide an aesthetic appearance.

However, with this latter arrangement, plugs are also required, with the same consequent disadvantages. It may also be difficult to align the recesses over the tongues of the single fastening extrusion. In addition, the single fastening extrusions are secured to the existing wall by screws only through the center of the fastening extrusions, which can result in failure of such securement. Still further, if the gap between adjacent panels is varied, this would also require a plurality of different size plugs, which can further add to the cost of the structure.

In addition, in the latter arrangement, the gap between adjacent wall panels is sealed with a silicone sealant and a compressed joint plug. As a result, the air pressure behind the wall panels varies relative to the ambient air pressure in front of the panels. However, architectural requirements require the air pressures to be the same or equalized so as not to reduce the longevity of the wall structure of the building.

The invention of U.S. Pat. No. 8,127,507 to the same inventor herein also requires the insertion of screws into the fastening extrusions and the channel while supporting the wall panels, which can be burdensome. It also requires the separate decorated panels in order to close off the gap between adjacent wall panels to provide an aesthetic appearance between the wall panels.

It is also known from U.S. Pat. No. 4,344,267 to Sukolics, U.S. Pat. No. 4,829,740 to Hutchison and U.S. Pat. No. 5,809,729 to Mitchell, to provide a wall system with L-shaped ends of the panels that include recesses in the bent ends that engage with projections of the extrusions secured by screws to the walls. However, with these patents, there is still a large gap between adjacent bent ends, which is necessary for securing the panels to the extrusions, and which also thereby requires a plug to close this gap.

More importantly, with these latter arrangements, assembly is relatively difficult.

Specifically, in U.S. Pat. No. 4,344,267 to Sukolics and U.S. Pat. No. 4,829,740 to Hutchison, two bent edges of each wall panel are assembled with two channel members 12' in a loose manner, which means that they have to be physically held together to prevent escape. Then, the other two bent edges of the wall panel are hung on two other channel members 12 that are already assembled on the wall. Thereafter, the two loose channel members 12' must be assembled by screws on the wall. This makes the assembly very difficult. See column 2, lines 13-19 of U.S. Pat. No. 4,344,267 to Sukolics and column 2, lines 52-59 of U.S. Pat. No. 4,829,740 to Hutchison. The process is then repeated for each wall panel.

In U.S. Pat. No. 5,809,729 to Mitchell, each bent end of a wall panel has a groove and each securing member has a groove facing the groove of the bent end. After these grooves are aligned, an elongated attachment member is slid into the passage formed between the grooves to lock the wall panels in place.

It is known from U.S. Pat. No. 5,263,292 to Holland et al to provide wall panels have bent end sections that snap into U-shaped anchor sockets. However, L-shaped attachments must be first secured to ends of the wall panels, which makes construction more complicated and costly. Also, the anchor sockets are made from aluminum and are only intended to hold lightweight panels. Thus, this patent could not be used to hold panels of 100 pounds or more. In addition, the anchor socket is arranged in rectangular configurations for snapping the wall panels thereto. However, there is no provision for sliding the wall panels therealong to provide easy adjustment and assembly.

It is also known to provide a snap in arrangement of ceiling tiles from U.S. Pat. No. 6,101,777 to Bodine et al. However, as with Holland et al, this arrangement is not capable of supporting heavy wall panels, and there is no provision for sliding wall panels therealong to provide easy adjustment and assembly.

U.S. Pat. No. 6,536,175 to Conterno provides structural panels for a building or roof which are reinforced in the interior of each panel by ribs, as are the U-shaped jointing elements that hold adjacent bent end sections of the panels together. Clearly, there is no flexibility or resilience of these U-shaped jointing elements or panels, even though they show mating inclined surfaces. The upright walls of the jointing elements are further rigidified by clamping arms that extend from the building structure. It is clear that there is no resilience to the structure which provides the positive engagement, since this structure requires a center pressing element between the bent end sections to force engagement with the upright walls of the jointing element. There is also no indication of any sliding of the wall panels therealong to provide easy adjustment and assembly. Further, once the bent sections are wedged in position in the clamping arms, it is very difficult to remove them because of the force applied by the center pressing element.

U.S. Pat. No. 3,021,915 to Kemp discloses an acoustical ceiling tile assembly. The jointing elements to which the ceiling tiles are connected are not shown or discussed. The tiles include cut out sections at the corners that facilitate connection, although how this occurs is not disclosed. Further, although there are shoulders on the inner surfaces of the bent end sections, these are only used to secure the pan holding the sound absorbing material and are therefore not engageable by any clamping assembly.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels are merely pressed into place and retained therein by spring-like extrusions secured to the walls.

It is a further object of the present invention to provide a wall system in which the wall panels, after being pressed into place, can be slid along the extrusions secured to the walls for assembly and adjustment.

It is yet another object of the present invention to provide a wall system that is easy to assemble with an existing wall structure.

It is a further object of the present invention to provide a wall system that permits sliding of the walls panels on the extrusions.

It is a further object of the present invention to provide a wall system that is easy and economical to manufacture and use.

In accordance with an aspect of the present invention, a system for mounting wall panels to an existing wall structure, includes a plurality of wall panels with each wall panel formed by a main wall panel and four bent end sections extending at an angle from different edges of the main wall panel and each bent end section having a wall thickness. There are also a plurality of main fastening extrusions made of a rigid PVC material, each fastening extrusion having a length much greater than a length of a wall panel, each fastening extrusion including at least one base section adapted to be secured to the existing wall structure and two spaced apart resilient bent end securing walls extending at an angle from the at least one base section and with a spacing therebetween. A cut-out section is provided at either first surfaces of two opposing bent end sections which face respective bent end securing walls, or a second surface of each bent end securing wall which faces the first surfaces. A projection is provided in the opposite walls, namely, the first surfaces of the two bent end sections, or the second surface of each bent end securing wall. The projections and cut-outs have inclined wedge surfaces which engage each other to permit subsequent removal of the wall panels by a pulling action that results in wedging of the inclined wedge surfaces against each other and which biases at least one bent end securing wall away from the other bent end securing wall. Adjacent bent end sections of each wall panel meet at a corner having a corner opening. The resilient bent end securing walls are positioned such that pressing of the bent end sections into the spacing between the bent end securing walls causes at least one the bent end securing wall to be biased away from the other bent end securing wall until the projections engage in respective cut-out sections to permit the bent end securing walls to spring back to hold the bent end sections in the spacing. Further, each projection is engaged in a respective cut-out section when the wall panels are engaged with the fastening extrusions in such a manner as to permit sliding of each wall panel along parallel, spaced apart ones of the fastening extrusions to a desired position, with the corner openings permitting the sliding.

In one embodiment, the projections and cut-outs have respective holding surfaces which engage each other to fixedly lock the bent end sections to the bent end securing walls.

In another embodiment, the projections and cut-outs have inclined wedge surfaces which engage each other to permit subsequent removal of the wall panels by a pulling action that results in wedging of the inclined wedge surfaces against each other and which biases at least one bent end securing wall away from the other bent end securing wall.

Preferably, although not limited, the cut-out sections are provided on inner surfaces of the bent end sections, and the projections on the bent end securing walls which face each other.

There is also at least one opening in the wall panels and at least one light source on the wall panels for emitting light through the at least one opening.

In one embodiment, each fastening extrusion is formed as a one-piece, unitary construction, and in another embodiment, each fastening extrusion includes at least two separate base sections adapted to be secured to the existing wall structure and at least two spaced apart flexible and resilient bent end securing walls, each extending at an angle from one of the base sections.

In one embodiment, the two bent end securing walls have a spacing therebetween corresponding substantially to the wall thickness of two the bent end sections. In another embodiment, the two bent end securing walls have a first spacing therebetween substantially greater than the wall thickness of two bent end sections, and each fastening extrusion includes at least one further wall positioned between the spaced apart bent end securing walls, with a second spacing between the at least one further wall and each bent end securing wall being substantially equal to the wall thickness of one bend end section. In the latter embodiment, there is a closure member for closing a space between adjacent bent end sections.

In accordance with another embodiment of the present invention, for use with a system described above, a method is provided for assembling the wall panels including the steps of mounting a plurality of the main fastening extrusions to a wall in a predetermined parallel, spaced apart relationship corresponding to dimensions of the wall panels, pressing at least one bent end section of a first wall panel into the spacing between the bent end securing walls of at least one fastening extrusion to cause at least one bent end securing wall to be biased away from the other bent end securing wall until a point where the at least one bent end securing wall springs back so that the projection engages in a respective cut-out section to lock the bent end section in the spacing, sliding the first wall panel along the parallel, spaced apart fastening extrusions to a desired position with the corner openings permitting the sliding action, and repeating the steps of pressing and sliding for additional wall panels.

The above and other features of the invention will become readily apparent from the following detailed description thereof which is to be read in connection with the accompanying drawings.

DETAILED DESCRIPTION

Figure 1:
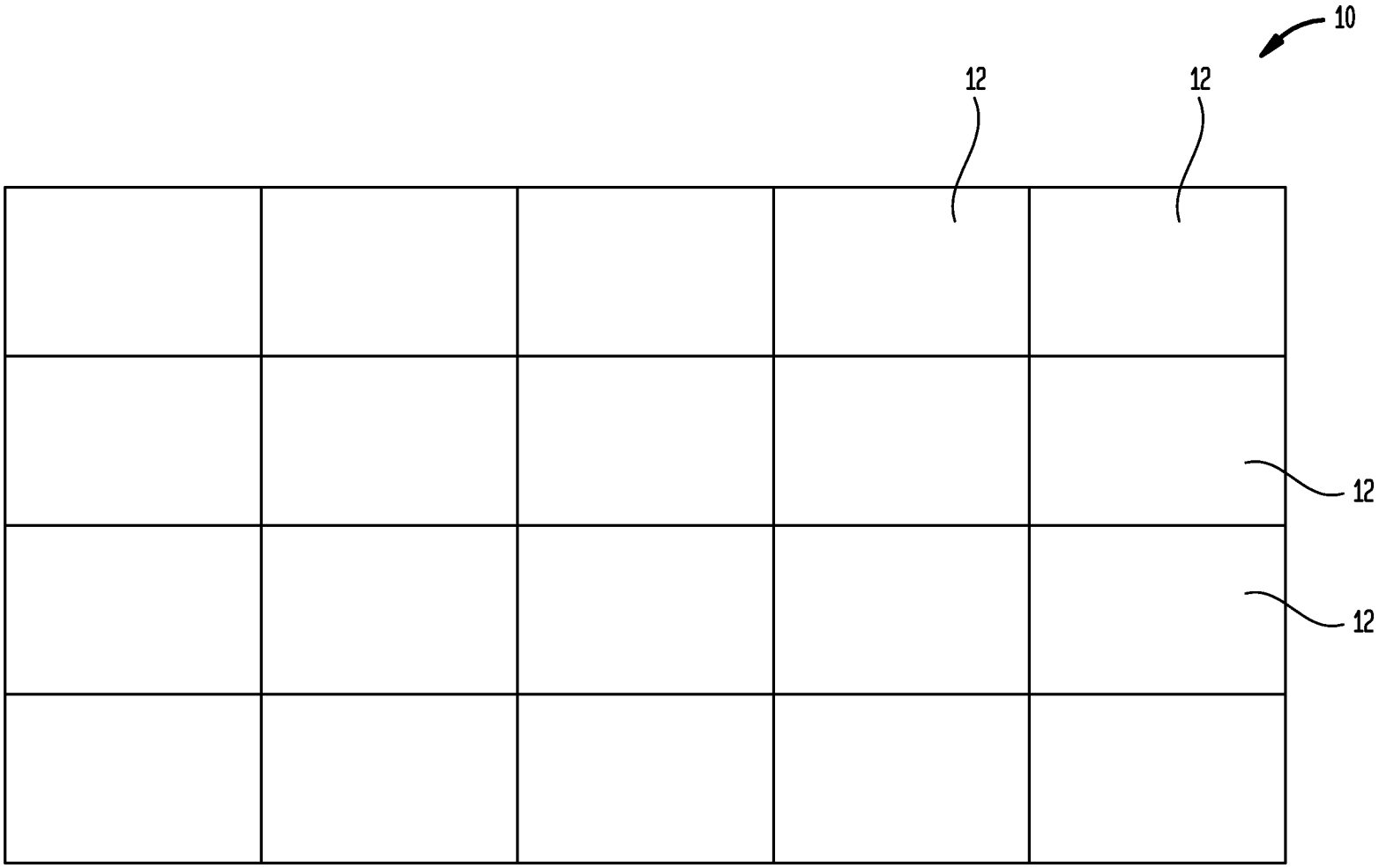
FIG. 1 is an elevational view of a plurality of wall panels mounted to an existing wall structure.

Referring to the drawings in detail, there is shown a system 10 according to the present invention for easily mounting wall panels 12 over an existing wall structure 14. Wall structure 14 preferably includes any planar wall. Each panel 12 includes a rectangular shaped, planar main panel section 16 and at least two bent end sections 18 bent at a right angle in the same direction at edges of main panel section 16. Main panel 16, however, need not be planar, and in fact, can have different shapes, such as a wave shape, etc. to provide different aesthetic appearances. Preferably, there are four bent end sections 18 at each edge of main panel section 16 which form an L-shaped cross-sectional shape thereat. However, the invention is not limited thereby and wall panels 12 can be formed with two, three or four bent end sections 18. Wall panels 12 are formed preferably by, but not limited to, a polyethylene core 20 with a thin aluminum wall 22 covering opposite sides thereof, as shown in FIG. 5. However, for the sake of simplicity in the drawings, FIGS. 3 and 4 show wall panels 12 formed of only a single material.

Figure 2:
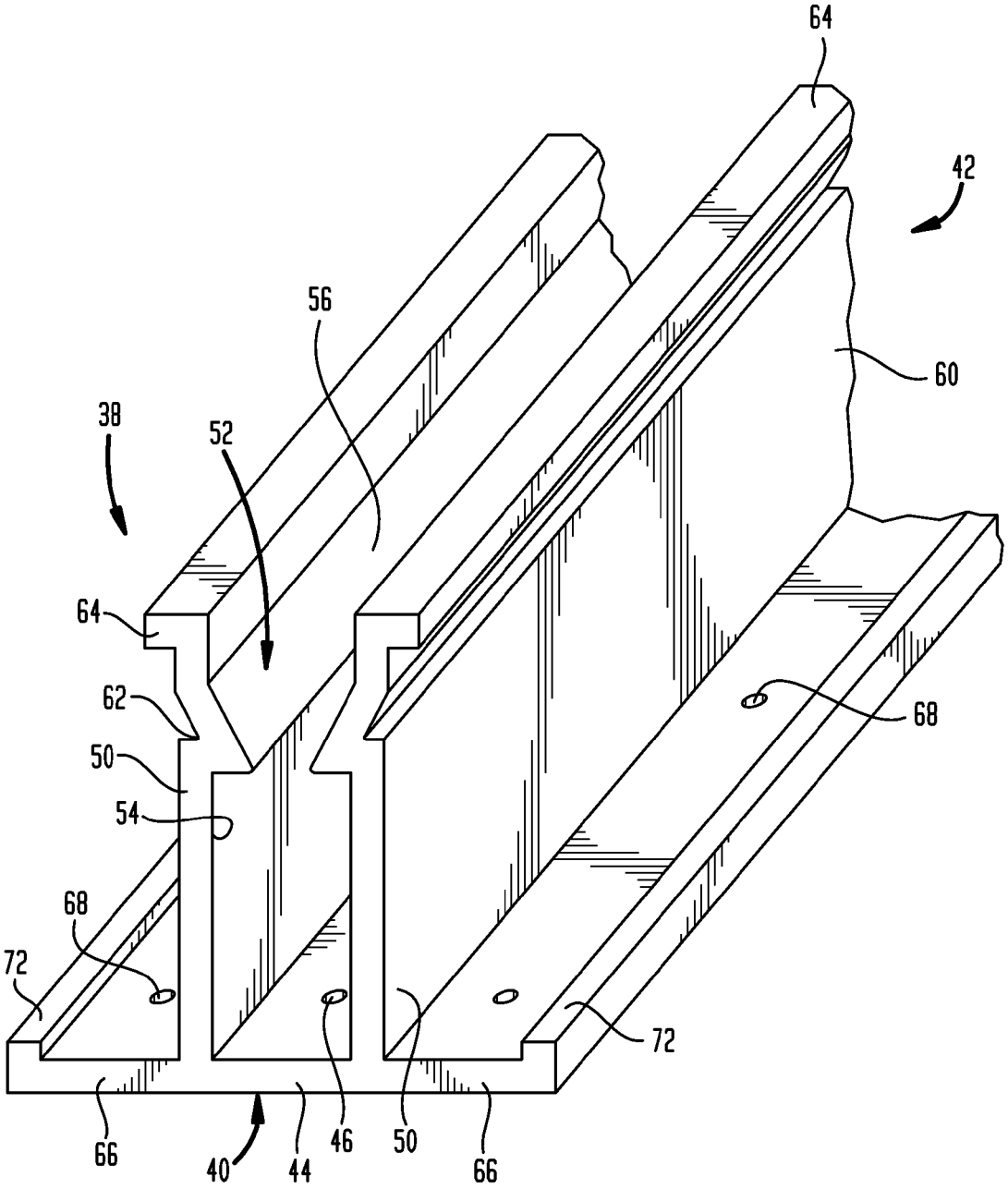
FIG. 2 is a perspective view of a frame extrusion according to the present invention.
Figure 4:
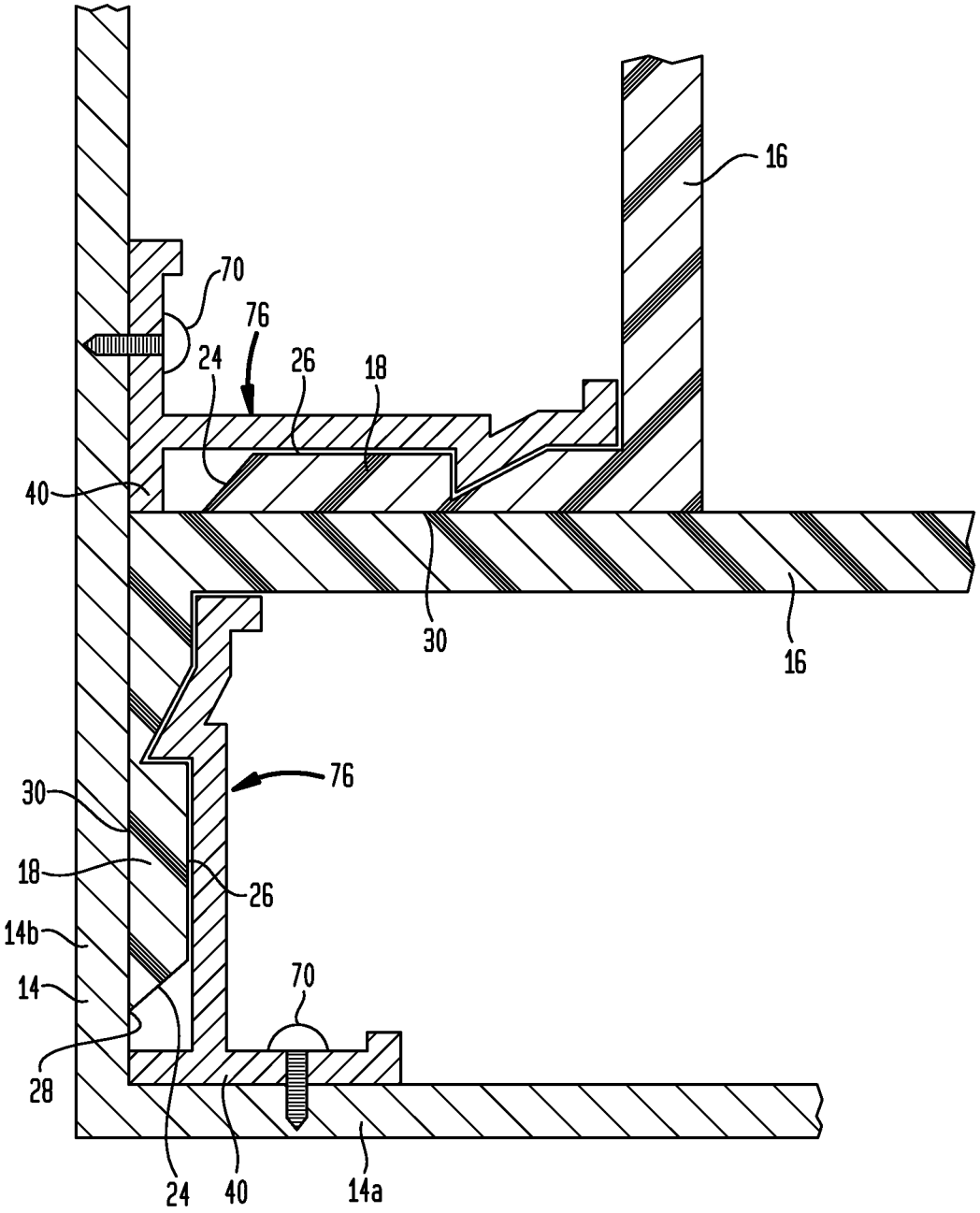
FIG. 4 is a cross-sectional view showing two wall panels connected together by a corner frame extrusion.
Figure 5:
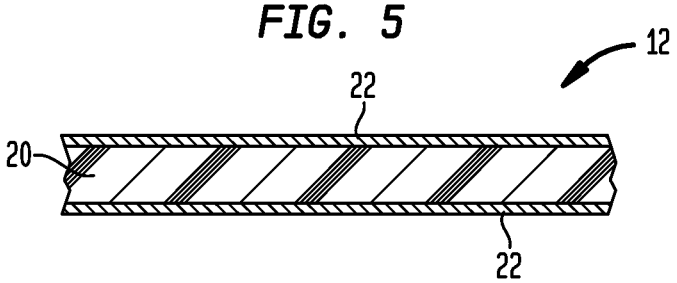
FIG. 5 is a cross-sectional view of a wall panel.

As shown in FIGS. 2 and 4, each bent end section 18 is formed with a lower beveled or inclined surface 24 at the inner surface 26 thereof and extending to a line edge 28 at the distal end of the bent end section 18 at the outer surface 30 thereof. As a result, there is a reduction in thickness of the bent end section 18 at the lower end thereof. Lower beveled surface 24 preferably extends along the entire length of the bent end section 18, although the present invention is not so limited, that is, lower beveled surface 24 can extend along only a part of the length of bent end section 18.

In addition, each bent end section 18 includes a cut-out section or recess 32 at the inner surface 26 thereof and spaced slightly away from main panel section 16. Each cut-out section 32 preferably has a nose-shaped configuration in cross-section, although the present invention is not limited thereby. Specifically, each cut-out section 32 has an inclined surface 34 that extends toward the distal end of the bent end section 18 at the outer surface 30 thereof, and terminates at a holding surface 36 that extends parallel to main panel section 16. As a result, cut-out section 32 effectively forms a notch in the inner surface of bent end section 18. Cut-out section 32 preferably extends along the entire length of the bent end section 18, although the present invention is not so limited, that is, cut-out section 32 can extend along only a part of the length of bent end section 18, or there may be a plurality of spaced apart cut-out sections 32.

Figure 3:
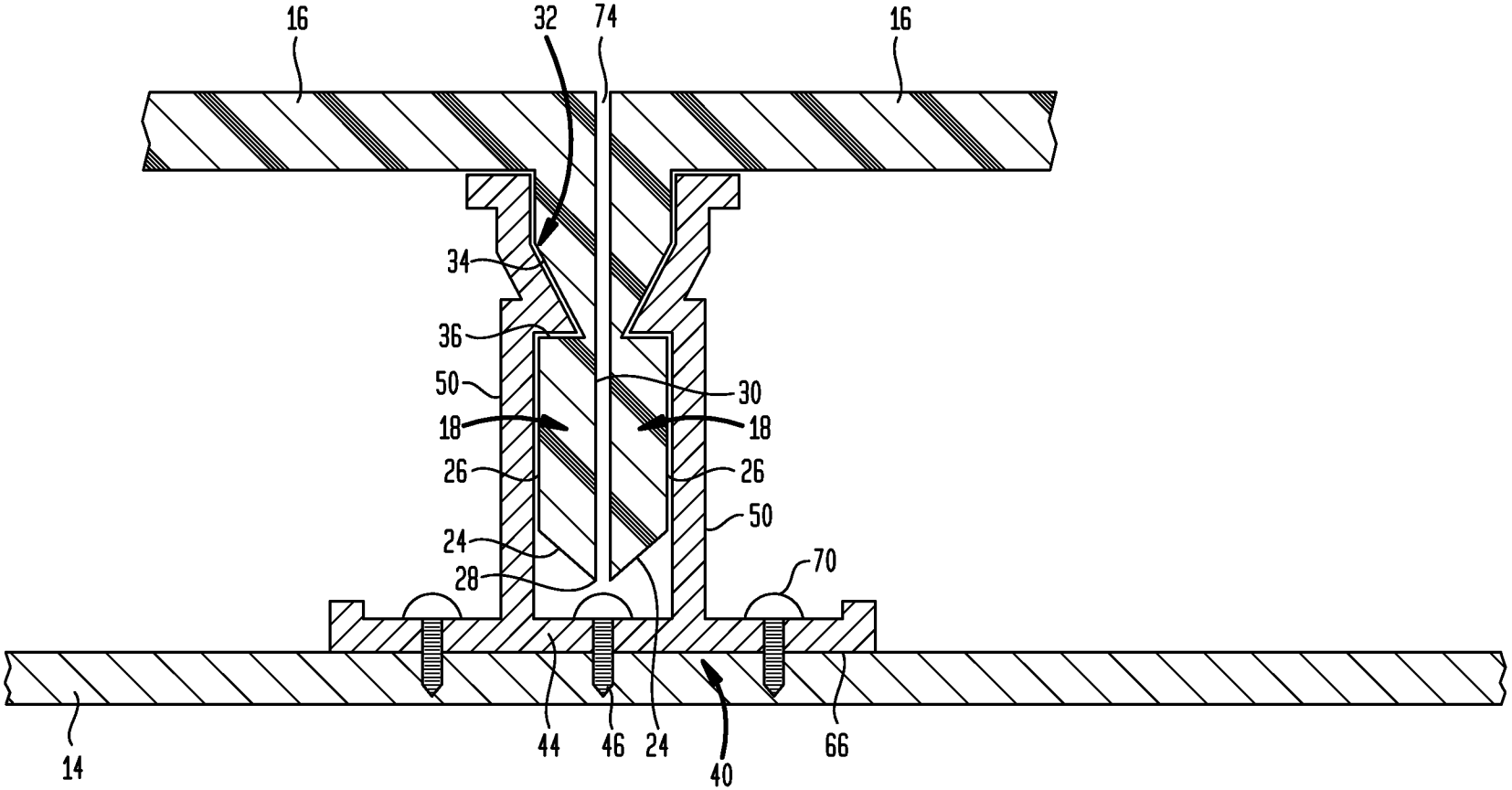
FIG. 3 is a cross-sectional view showing two wall panels connected together by the frame extrusion of FIG. 2.

As shown in FIGS. 2 and 3, main fastening extrusions 38 are provided for securing each wall panel 12 to existing wall structure 14. Each main fastening extrusion 38 is preferably formed as a single, one-piece, unitary member that includes a base section 40 secured to existing wall structure 14 and a supporting section 42 that connects to a side edge of each panel 12. Each main fastening extrusion 32 is formed preferably by a relatively rigid PVC (polyvinyl chloride) or chloroethylene homopolymer compound, which is a polyvinyl resin, but is not limited thereto, preferably a PVC material sold by the PVC Compound Division of Axiall, LLC of Madison, Miss. under the product names 2000 through 3999 and 5000 through 9999 pellet and powder, having a specific gravity in the range of 1.25 to 1.55. PVC material is very easy to cut or notch on a job site, saving time and labor.

Base section 40 includes a central planar wall 44 that seats flush against existing wall structure 14, and which has a plurality of linearly aligned openings 46 extending therealong and through which screws 48 can be inserted to secure central wall panel 44 to existing wall structure 14. Two, parallel, spaced apart, bent end securing walls 50 extend outwardly at right angles from opposite ends of central planar wall 44 for securing bent end sections 18 of two adjacent wall panels 12 thereto. As will be understood from the discussion hereafter, bent end securing walls 50 are flexible and resilient, so that they can be bent away from each other and when the bending force is removed, return to their original positions shown in FIGS. 2 and 3. In other words, although they are made of a relatively rigid PVC that can support heavy wall panels weighing more than 100 pounds, bent end securing walls 50 are still resilient and capable of flexing to accommodate the fitting of the wall panels therewith.

Each bent end securing wall 50 includes an inwardly directed projection 52 at the inner surface 54 of the respective bent end securing wall 50, with each projection having a nose-shaped configuration in cross-section, which corresponds in shape and dimensions to nose-shaped cut-out section 32, although the present invention is not limited thereby. Specifically, each projection 52 has an inclined surface 56 that slopes in a direction toward base section 40 and terminates at a holding surface 58 that extends parallel to central planar wall 44. Projection 52 preferably extends along the entire length of the bent end securing wall 50, although the present invention is not so limited, that is, projection 52 can extend along only a part of the length of bent end securing wall 50, or there may be a plurality of spaced apart projections 52.

As shown in FIGS. 2 and 3, the outer surface 60 of each bent end securing wall 50 includes a nose-shaped cut-out section 62 corresponding in position to nose-shaped projection 52, in order to save material, although the present invention is not limited thereby, and nose-shaped cut-out section 62 can be eliminated.

The upper free end of each bent end securing wall 50 includes an outwardly extending stub wall 64 that is perpendicular to the respective bent end securing wall 50 and parallel to central planar wall 44.

In addition, although not essential to the present invention, two outwardly extending wing walls 66 extend outwardly from opposite ends of central planar wall 44, that is, outwardly and extending from opposite sides of the lower ends of bent end securing walls 50. Each wing wall 66 is coplanar with central planar wall 44 so as to lie flush against existing wall structure 14, and each wing wall 66 includes a plurality of linearly aligned openings 68 extending therealong and through which screws 70 can be inserted to secure central wall panel wing walls 66 to existing wall structure 14. This provides additional securement of main fastening extrusions 38 to existing wall structure 14. Each wing wall 66 terminates in a bent end stub wall 72, although the present invention is not limited thereby.

With this arrangement, main extrusions 38 are secured to existing wall structure 14 by screws 46 and 70 at predetermined spacing intervals determined by the dimensions of wall panels 12. Thereafter, it is only necessary to push bent end sections 18 of wall panels 12 into the gap between spaced apart bent end securing walls 50. This can be performed with bent end section 18 of one wall panel 12, followed by a bent end section 18 of an adjacent wall panel 12, or with the two bent ends sections 18 of adjacent wall panels 12 simultaneously. In such case, lower beveled surface of each bent end securing wall 50 first hits against inclined surface 56 and biases the respective bent end securing wall 50 outwardly away from the other bent end securing wall 50, whereby the distal end of each bent end section 18 can pass into the space between central planar wall 44 and inwardly directed projection 52. Once holding surface 36 passes holding surface 58, the respective bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel sections 16.

An important aspect of the present invention is that the outer surfaces 30 of adjacent bent end sections 18 are in abutting or near abutting relation, that is, they are at least in near abutting relation. As shown in FIG. 3, there is only a very small gap between adjacent outer surfaces so that they are in near abutting relation, but in fact, they can be, and preferably are, in abutting or touching relation with each other. In other words, the gap 74 between the adjacent outer surfaces 30 is so small that it does not permit bent end sections to be pulled out. With this arrangement, there is no need to provide any sealants or plugs in gap 74, and in fact, no such sealants or plugs would even fit within gap 74.

In other words, the two bent end securing walls 50 have a spacing therebetween corresponding substantially to the wall thickness of the two bent end sections 18 held therein.

In this regard, it is very easy to assemble wall panels 12 by merely pressing bent end sections 18 into the space between adjacent bent end securing walls 50.

As shown in FIG. 4, at a corner of existing wall structure 14, corner fastening extrusions 76 are provided, which merely constitute one-half of a main fastening extrusion 38. Thus, each corner fastening extrusion 76 includes one-half of base section 40, and one wing wall 66 having openings 68, and with only one bent end securing wall 50 having an inwardly directed nose-shaped projection 52 formed by inclined surface 56 at the inner surface 54 thereof and terminating in holding surface 58, along with outwardly extending stub wall 64 at the free end thereof.

During assembly at each corner, a first corner fastening extrusion 76 is secured to one wall 14*a* of existing wall structure 14 by screws 70 extending through openings 68 of the wing 66, such that the free end of base section 40 is in abutting relation to the other wall 14*b* of the corner which is perpendicular to wall 14*a*. In this arrangement, there is a space between the bent end securing wall 50 thereof and the parallel other wall 14*b*. A bent end section 18 is then press fit into this space, whereby the bent end securing wall 50 is biased away from the other wall 14*b*, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent corner wall 14*b*, that is, it is at least in near abutting relation.

Then, a second corner fastening extrusion 76 is secured to the other wall 14*b* of existing wall structure 14 by screws 70 extending through openings 68 of the wing 66, such that the free end of base section 40 is in abutting relation to planar main panel section 16 of the already assembled wall panel 12. In this arrangement, there is a space between the bent end securing wall 50 thereof and planar main panel section 16 of the already assembled wall panel 12. A bent end section 18 of another wall panel 12 is then press fit into this space, whereby the bent end securing wall 50 is biased away from planar main panel section 16 of the already assembled wall panel 12, until holding surface 36 passes by holding surface 58, whereupon bent end securing wall 50 springs back to its original position, whereby nose-shaped inwardly directed projection 52 engages in nose-shaped cut-out section 32. In such case, holding surface 58 engages holding surface 36 to prevent escape of bent end section 18. In such position, outwardly extending stub walls 64 are in abutting or near abutting relation with the respective planar main panel section 16.

In this position, the outer surface 30 of the bent end section 18 is in abutting or near abutting relation with the adjacent planar main panel section 16, that is, it is at least in near abutting relation.

It will be appreciated that the present invention can be varied within the scope of the claims. In all of the following embodiments, the bend end securing walls 50 are biased outwardly when the bend end sections 18 are pressed into engagement therewith, whereby the bent end sections 18 snap back and are then locked with the bent end securing walls 50.

Figure 6:
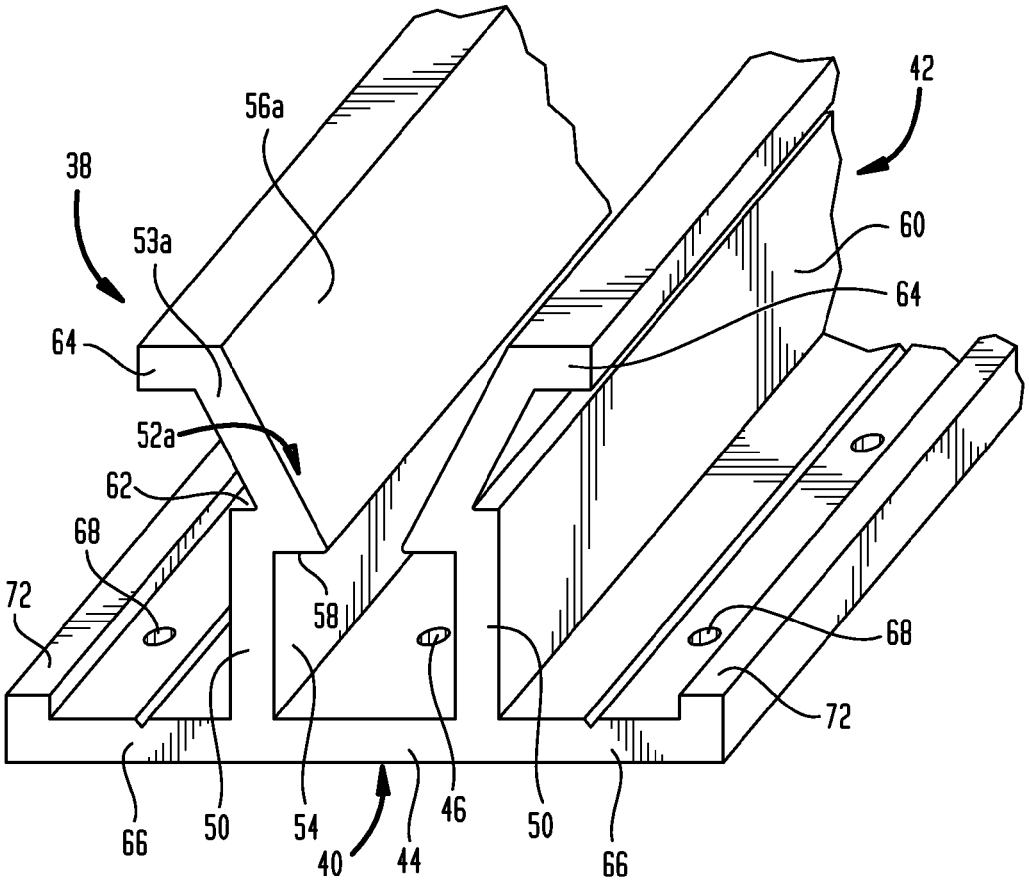
FIG. 6 is a perspective view of a frame extrusion according to another embodiment of the present invention.

Thus, FIG. 6 shows a modification of the embodiment of FIG. 2 in which the inclined surface 56*a* of each inwardly directed projection 52*a* continues upwardly at an angle with an inclined wall 53*a* ends in outwardly extending stub wall 64 that is perpendicular to the respective bent end securing wall 50 and parallel to central planar wall 44, rather than changing direction and running parallel to each bent end securing wall 50. Preferably, although not required, outwardly extending stub wall 64 is in contact with the underside of planar main panel section 16 when inwardly directed projection 52*a* is positioned in cut-out section 32 so as to provide a snap-tight like action with a tight fit so that there is little or no play, whereby wall panels 12 are tightly held in position. This is due to the combination of cut-out section 32 having a holding surface 36 that is substantially parallel to planar main panel section 16 when wall panels 12 are assembled, and the engagement of the stub walls 64 with the underside of planar main panel section 16, which is different from known arrangements which provide arcuate cut-out sections 32.

Of course, it will be appreciated that outwardly extending stub walls 64 can be eliminated, and the free end of inclined wall 53*a* could be used to contact the underside of planar main panel section 16. In either case, stub wall 64 or the free end of inclined wall 53*a* where stub wall 64 is eliminated, it is the free end of bent end section 18 that contacts the underside of planar main panel section 16 to provide the aforementioned tight fit without any play.

Figure 7:
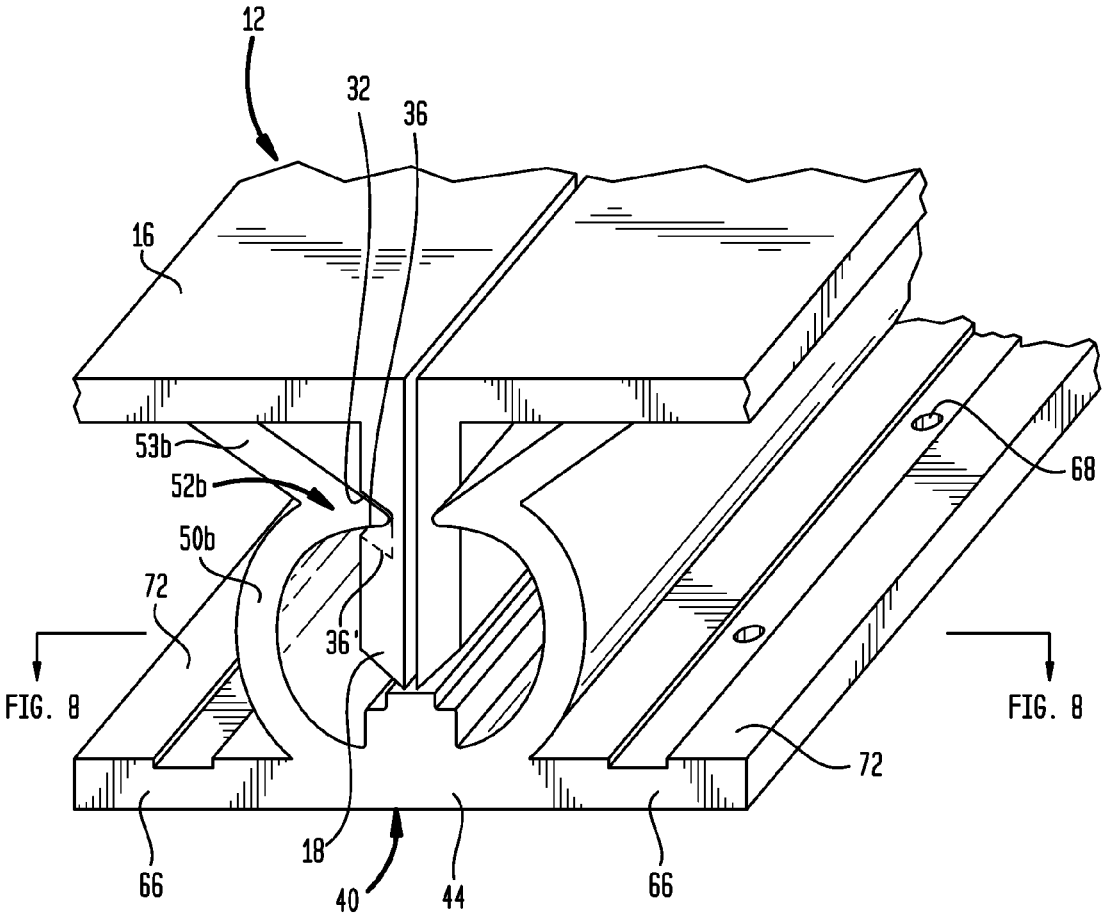
FIG. 7 is a perspective view showing two wall panels connected together by a frame extrusion according to another embodiment of the present invention.
Figure 8:
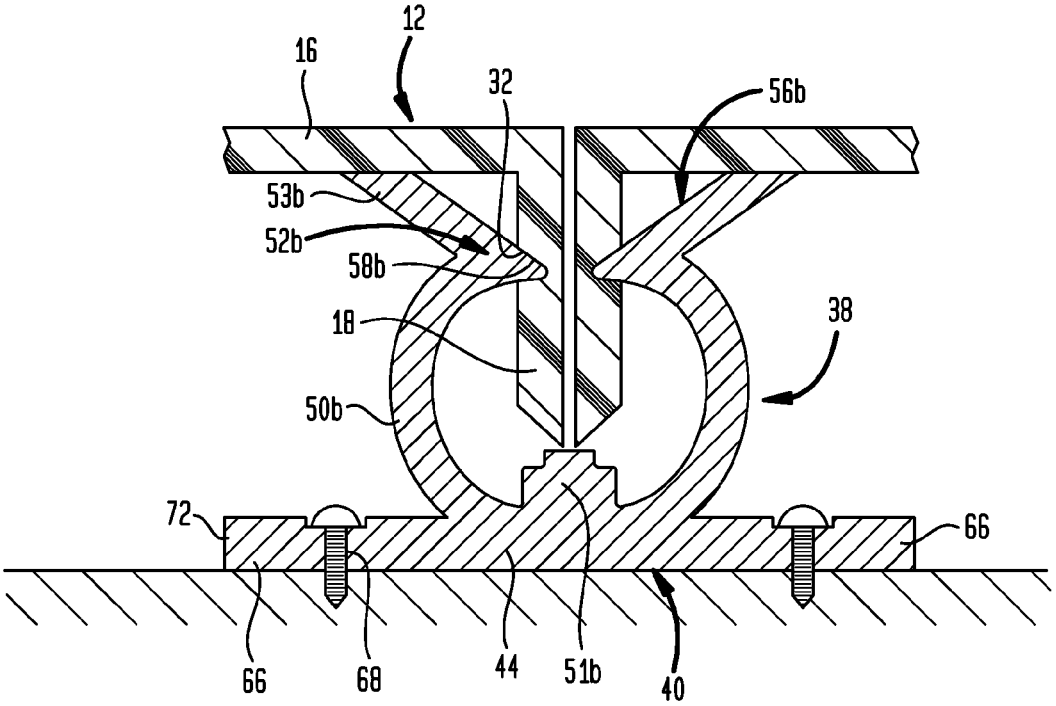
FIG. 8 is a cross-sectional view showing two wall panels connected together by the frame extrusion of FIG. 7.

FIGS. 7 and 8 shows a modification of the FIG. 6 embodiment in which outwardly extending stub walls 64 are eliminated and in which each bent end securing wall 50*b* has an outward curvature, terminating in an inwardly directed projection 52*b*. Further, the inclined surface 56*b* of each inwardly directed projection 52*b* continues upwardly at an angle with an inclined wall 53*b* that abuts against the inner surface or undersurface of planar main panel section 16 since the outwardly extending stub wall is eliminated. As will be understood from the discussion hereafter, bent end securing walls 50*b* are also flexible and resilient, so that they can be bent away from each other and when the bending force is removed, return to their original positions so that inwardly directed projections 52*b* engage in cut-out sections 32 in FIG. 7. In addition, a center platform section 51*b* is provided along the center of base section 40, on which the lower ends of two bent end sections 18 rest. Screws (not shown) can be inserted through center platform section 51*b* to secure the extrusion to the wall.

As will be appreciated from the latter embodiment, the two inwardly directed projections 52*b* have a spacing therebetween which is less than the wall thickness of two said bent end sections 18.

As with the embodiment of FIG. 6, a tight fit is obtained with little play. In both embodiments of FIG. 6 and FIGS. 7 and 8, and contrary to known arrangements, holding surface 36 would be substantially parallel to planar main panel section 16 when wall panels 12 are assembled. However, it is possible that the holding surface is angled in a direction away from the respective main panel section, 16 starting from inner surface 26 of bent end section 18, as shown by dashed line holding surface 36' in FIG. 7. Of course, in the latter situation, holding surface 58*b* of inwardly directed projection 52 would have a similar slope.

Figure 9:
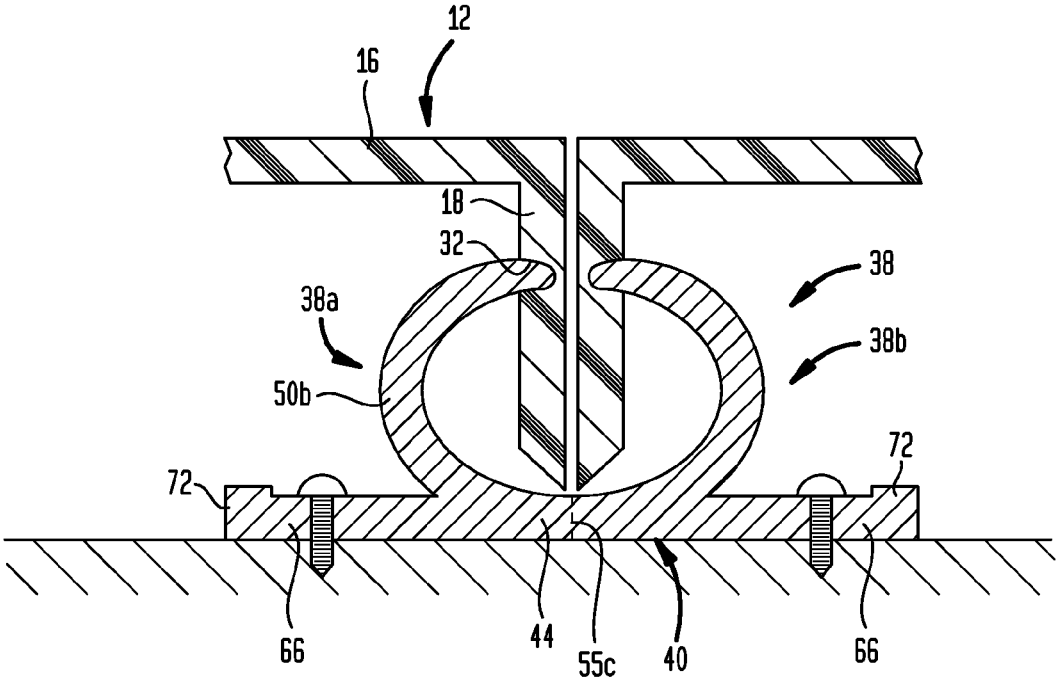
FIG. 9 is a cross-sectional view showing two wall panels connected together by a frame extrusion according to another embodiment of the present invention.

FIG. 9 shows a modification of the FIG. 7 embodiment in which platform 51*b* and inclined walls 53*b* are eliminated. In addition, as with all of the embodiments in the present application, main fastening extrusions 38 can each be formed as a unitary, one piece structure or of two separate main fastening extrusion sections 38*a* and 38*b* divided, as shown, by dashed line 55*c* in FIG. 9.

Figure 10:
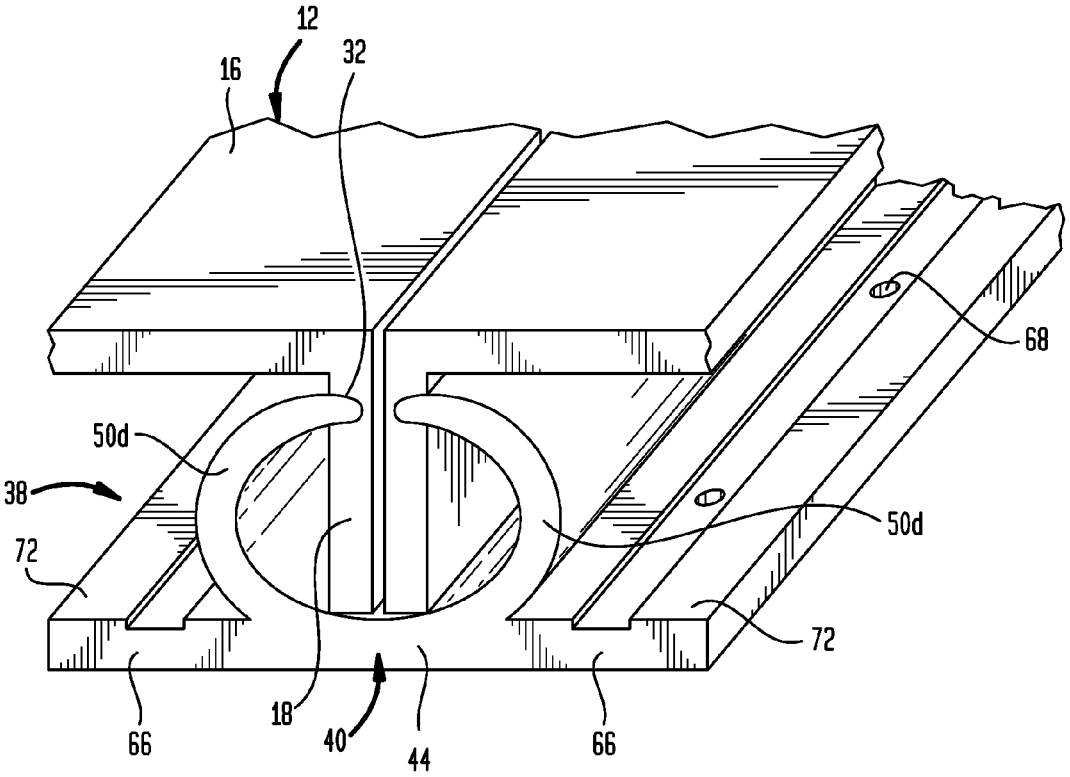
FIG. 10 is a perspective view showing two wall panels connected together by a frame extrusion according to another embodiment of the present invention.

FIG. 10 shows a modification of the FIG. 9 embodiment in which the only change has been changing the arc of outwardly curved bent end securing walls 50*d* so that the free ends thereof engage in cut-out sections 32 at positions close to the inner surfaces of bent end sections 18.

Figure 11:
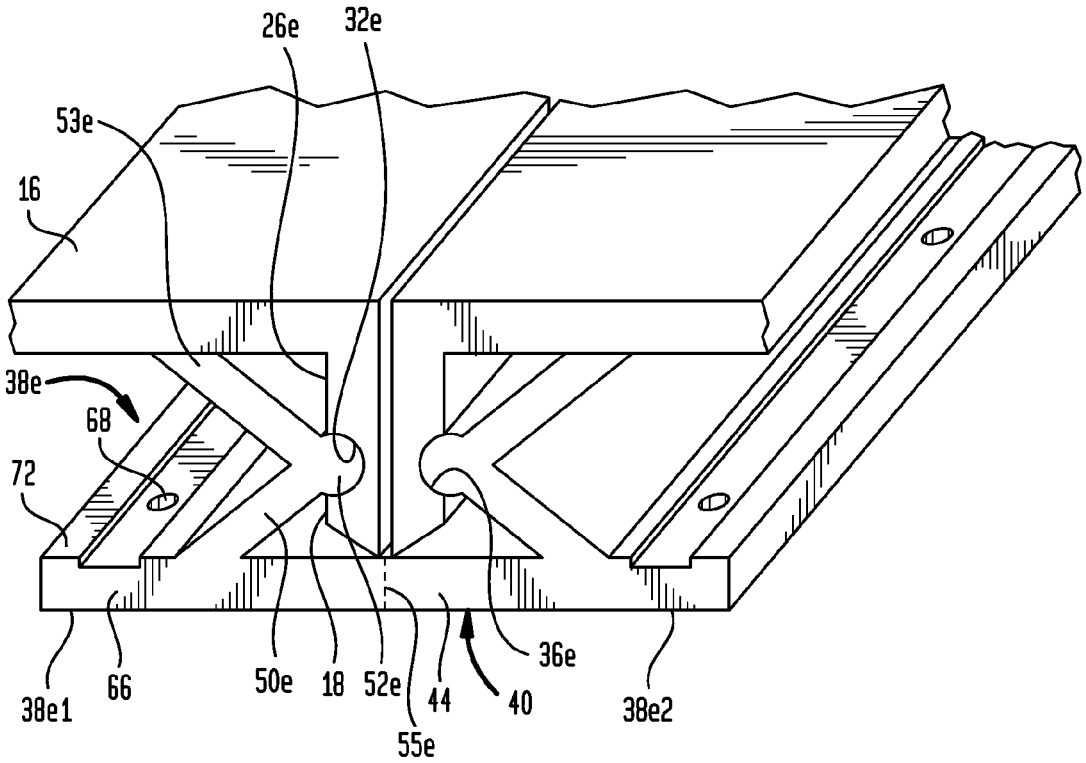
FIG. 11 is a perspective view showing two wall panels connected together by a frame extrusion according to another embodiment of the present invention.

FIG. 11 shows a modification of the FIGS. 7 and 8 embodiment in which the bent end securing walls 50*e* are inclined inwardly in an opposite direction from outwardly inclined walls 53*e* and meet at a cylindrical inwardly directed projection 52*e* which is engaged in a part cylindrical cut-out section 32*e* which has a circumference that extends over an angle greater than 180 degrees. Cylindrical inwardly directed projection 52*e* also has a circumference that extends over an angle greater than 180 degrees and has a diameter similar to the diameter of cylindrical cut-out section 32*e* so that it is force fit and snaps into part cylindrical cut-out section 32*e* in order to lock wall panels 12 and extrusions 38 together. It will be appreciated that, contrary to known arrangements, part cylindrical cut-out section 32*e* and cylindrical inwardly directed projection 52*e* extend over an angle greater than 180 degrees in order to provide this snap fitting arrangement. Of course, because of the snap fitting engagement, inclined wall 53*e* can be eliminated, although it is preferable to include inclined wall 53*a* for purposes of stability of the structural arrangement.

With this embodiment, pressing of bent end sections 18*e* into the spacing between bent end securing walls 50*e* causes bent end securing walls 50*e* to be biased away from each other until projections 52*e* snap engage into respective cut-out sections 32*e* to lock bent end sections 18*e* in the spacing in a manner that outer walls of bent end sections 18*e* are at least in near abutting relation with each other. It will be appreciated, however, that the spacing between bent end sections 18*e* can be much greater such that bent end securing walls 50*e* need not be biased. This is because of the snap fitting relation of projections 52*e* into part cylindrical cut-out sections 32*e*. In the latter case, bent end securing walls 50*e* need not be biased outwardly.

Further, it will be appreciated that, because part cylindrical cut-out section 32*e* extends over an angle greater than 180 degrees, part cylindrical cut-out section 32*e* defines a holding surface 36*e* which is slightly inclined at an angle away from said main panel section 16, starting from the inner wall surface 26*e* of the bent end section 18*e*. Therefore, a positive engagement is provided with little or no room for play or movement of wall panels 12.

Figure 12:
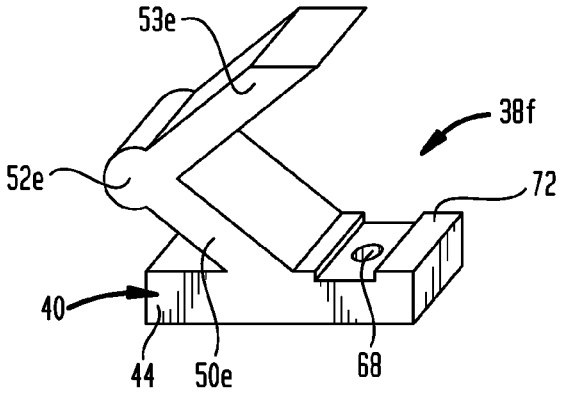
FIG. 12 is a perspective view of a frame extrusion according to another embodiment of the present invention.

As discussed above with respect to FIG. 9, main fastening extrusions 38*e* of FIG. 11 can each be formed as a unitary, one piece structure or of two separate main fastening extrusion sections 38*e*1 and 38*e*2 divided, as shown, by dashed line 55*c* in FIG. 9. In addition, each separate main fastening extrusion section 38*e*1 and 38*e*2 can be formed from a plurality of discrete main fastening extrusions 38*f*, as shown in FIG. 12, which are secured to the wall in parallel, spaced apart relation to each other. This applies to all of the embodiments of the present application.

Figure 13:
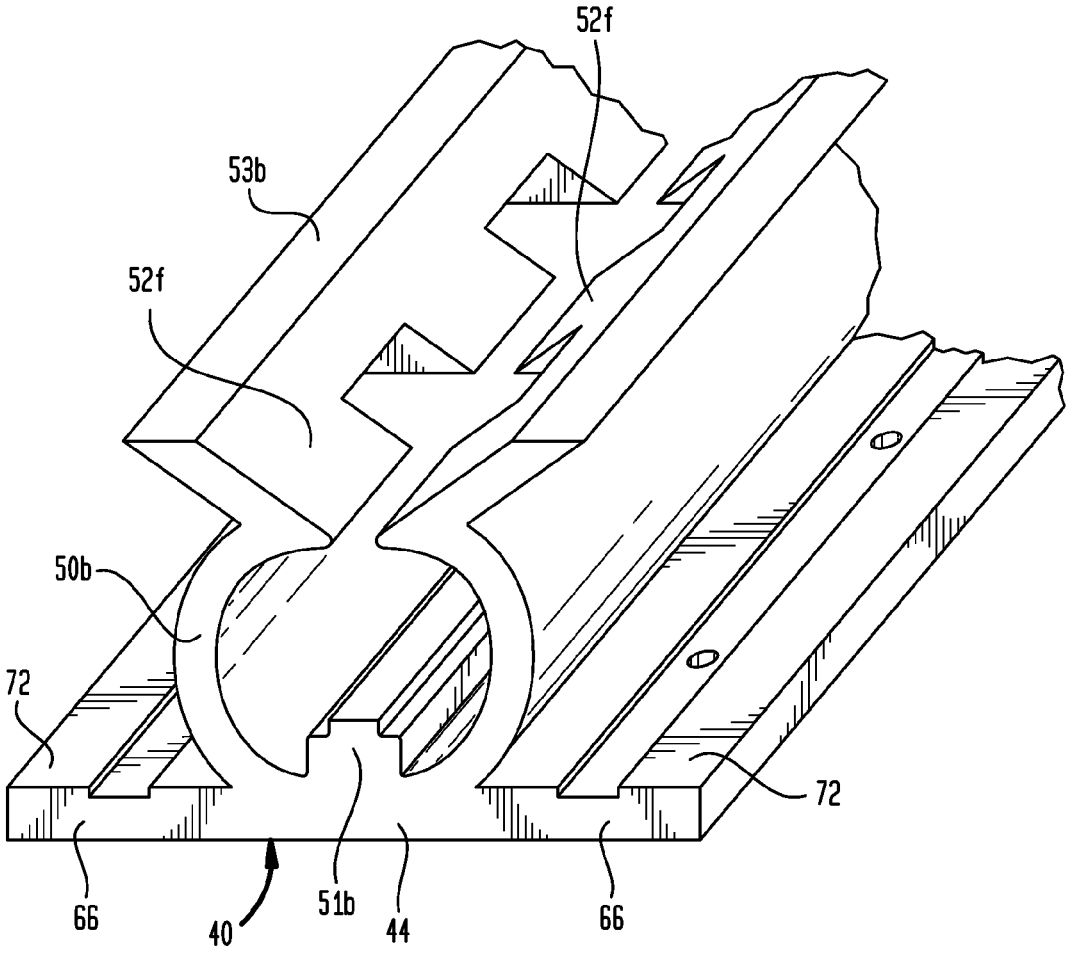
FIG. 13 is a perspective view of a frame extrusion according to another embodiment of the present invention.

It will be appreciated that, with the above embodiments, the respective cut-out section 32 has been continuous. However, it is possible that a plurality of spaced apart cut-out sections 32 can be provided along the length of bent end sections 18, and in such case, each inwardly directed projection 52 would be formed of a plurality of spaced apart inwardly directed teeth 52*f*, as shown in FIG. 13, which is a variation of the embodiment of FIGS. 7 and 8. This applies to all of the embodiments in the present application.

As discussed above, U.S. Pat. No. 4,344,267 to Sukolics, U.S. Pat. No. 4,829,740 to Hutchison and U.S. Pat. No. 5,809,729 to Mitchell, provide a wall system with L-shaped ends of the panels that include recesses in the bent ends that engage with projections of the extrusions secured by screws to the walls, in which there is a large gap between adjacent bent ends. The present invention provides further advances over these systems.

Figure 14:
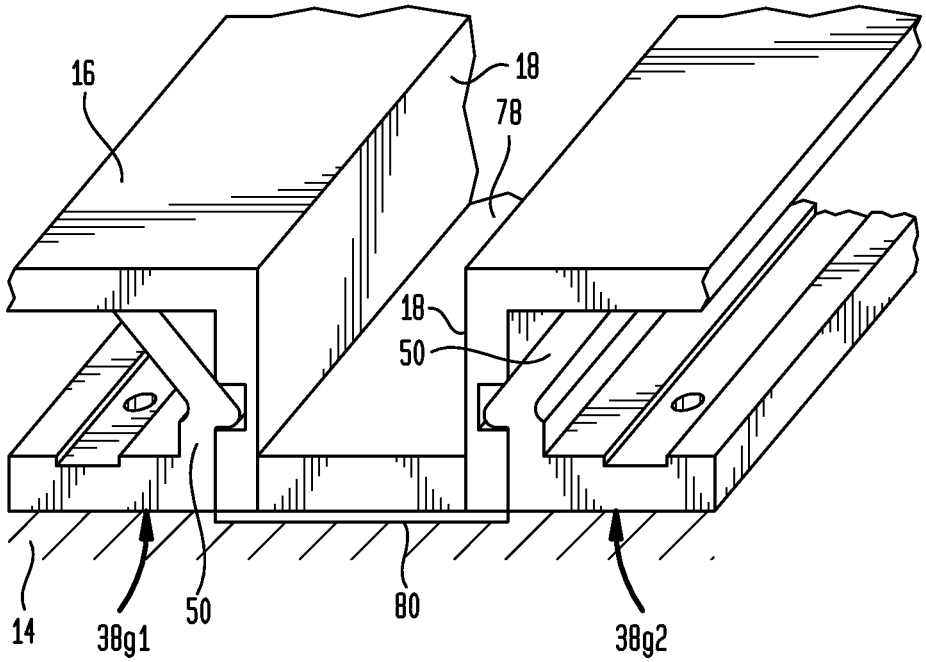
FIG. 14 is a perspective view showing two wall panels connected together by a frame extrusion according to another embodiment of the present invention.
Figure 15:
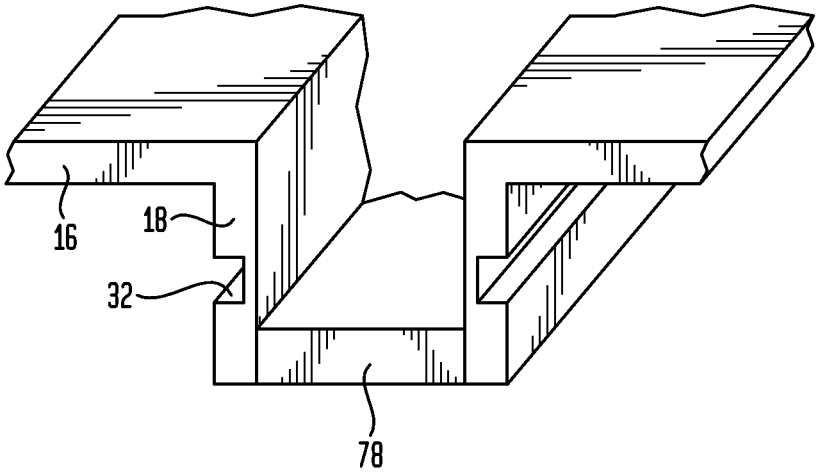
FIG. 15 is a perspective view of the wall panels and spacer member of FIG. 14.
Figure 16:
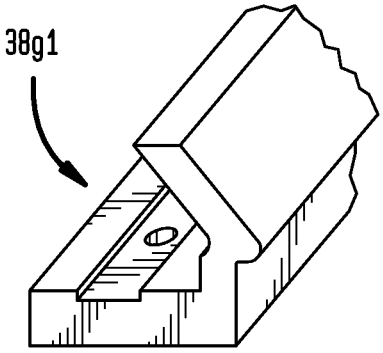
FIG. 16 is a perspective view of the frame extrusion of FIG. 16.

Specifically, as shown in FIGS. 14-16, two separate main fastening extrusion sections 38*g*1 and 38*g*2 are provided, which are of a similar configuration to the main fastening extrusion of FIG. 6, divided along a center line. In the embodiment of FIG. 14, a further spacer member 78 in the shape of a rectangular parallelepiped is first secured to the wall 14 by a double sided adhesive strip 80. Then, separate main fastening extrusion sections 38*g*1 and 38*g*2 are secured to wall 14 by screws, such that the inner surfaces of bent end securing walls 50 thereof are spaced away from the side edges of spacer member 78 by a distance equal substantially to the thickness of a bent end section 18.

Figure 17:
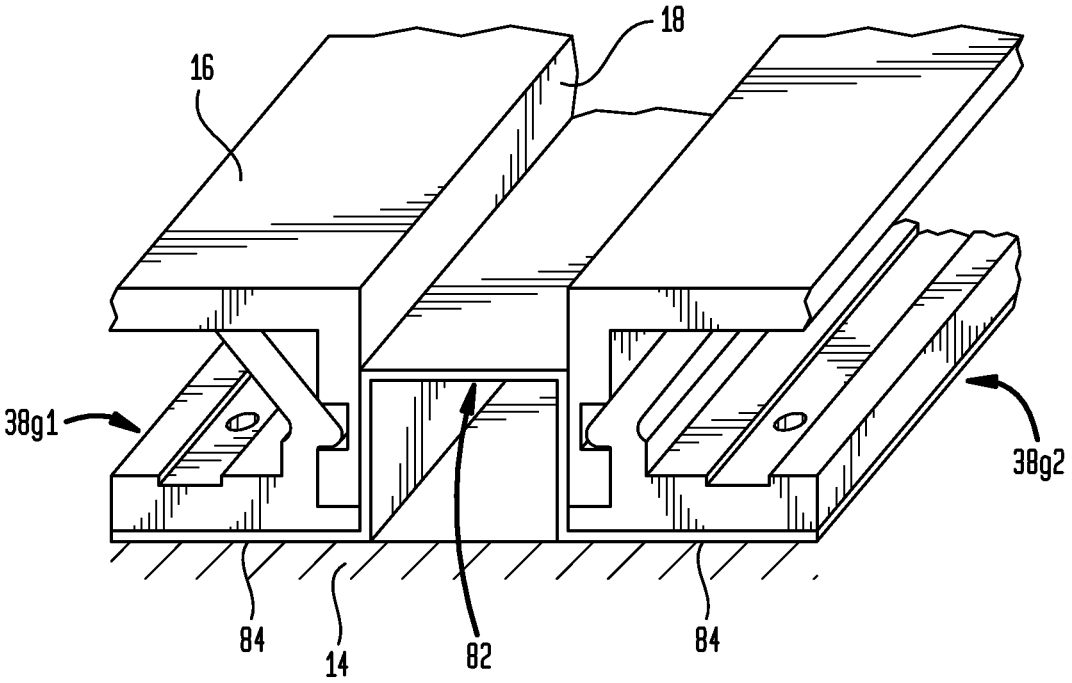
FIG. 17 is a perspective view showing two wall panels connected together by a frame extrusion according to another embodiment of the present invention.

Alternatively, as shown in FIG. 17, a thin walled, inverted U-shaped spacer member 82 is provided in place of spacer member 78 for the same purpose, with U-shaped spacer member 82 including outwardly extending wing sections 84 that extend between separate main fastening extrusion sections 38*g*1 and 38*g*2 and wall 14.

Figure 18:
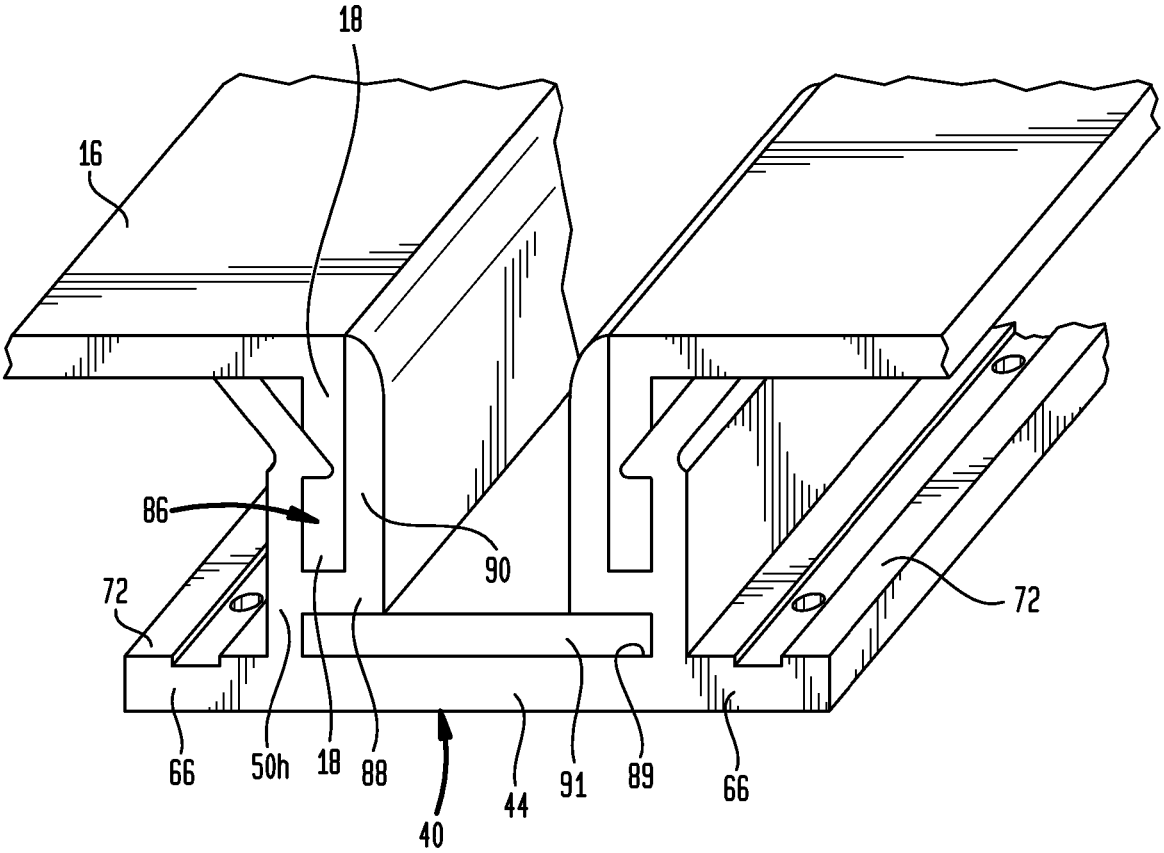
FIG. 18 is a perspective view showing two wall panels connected together by a frame extrusion according to another embodiment of the present invention.

FIG. 18 shows another embodiment which is similar to that of FIG. 6, except that bent end securing walls 50*h* are spaced apart further than that in the embodiment of FIG. 6. With this embodiment, an upwardly extending L-shaped extension 86 extends includes a first leg 88 as a lateral connecting wall that extends inwardly from a lower portion of bent end securing wall 50*h* and a second leg 90 as an inner wall that extends upwardly from the free end of first leg 88 and in parallel spaced apart relation to the respective securing wall 50*h* with a spacing substantially equal to the thickness of a bent end section 18 which fits therein. In this manner, bent end sections 18 are inserted in the gap between a securing wall 50*h* and respective second leg 90. With this arrangement, there is a space 89 between central planar wall 44 and each first leg 88. A closure plate 91 of a rectangular parallelepiped shape is inserted in spaces 89 and also spans the distance between second legs 90 so as to form an aesthetic closure.

Figure 19:
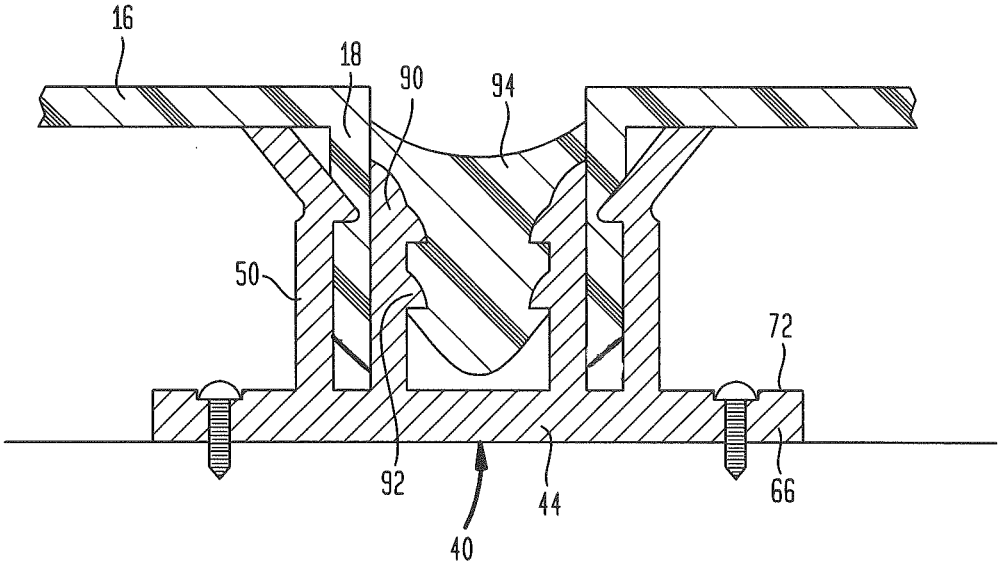
FIG. 19 is a cross-sectional view showing two wall panels connected together by a frame extrusion according to another embodiment of the present invention.

FIG. 19 shows another embodiment similar to that of FIG. 18, in which second legs 90 extend upwardly from central planar wall 44 of base section 40, and first legs 88 are eliminated. The inner facing surfaces of second legs 90 are further provided with barbs 92 that are angled toward base section 44. In this manner, a plug 94 can be inserted within the gap between second legs 90 for closing off the gap and providing an aesthetic appearance, with the plug 94 engaged by barbs 92.

It will be appreciated that the securement of the wall panels in FIGS. 14-19 occurs in the same manner discussed above with respect to the embodiments of FIGS. 6-8.

Figure 20:
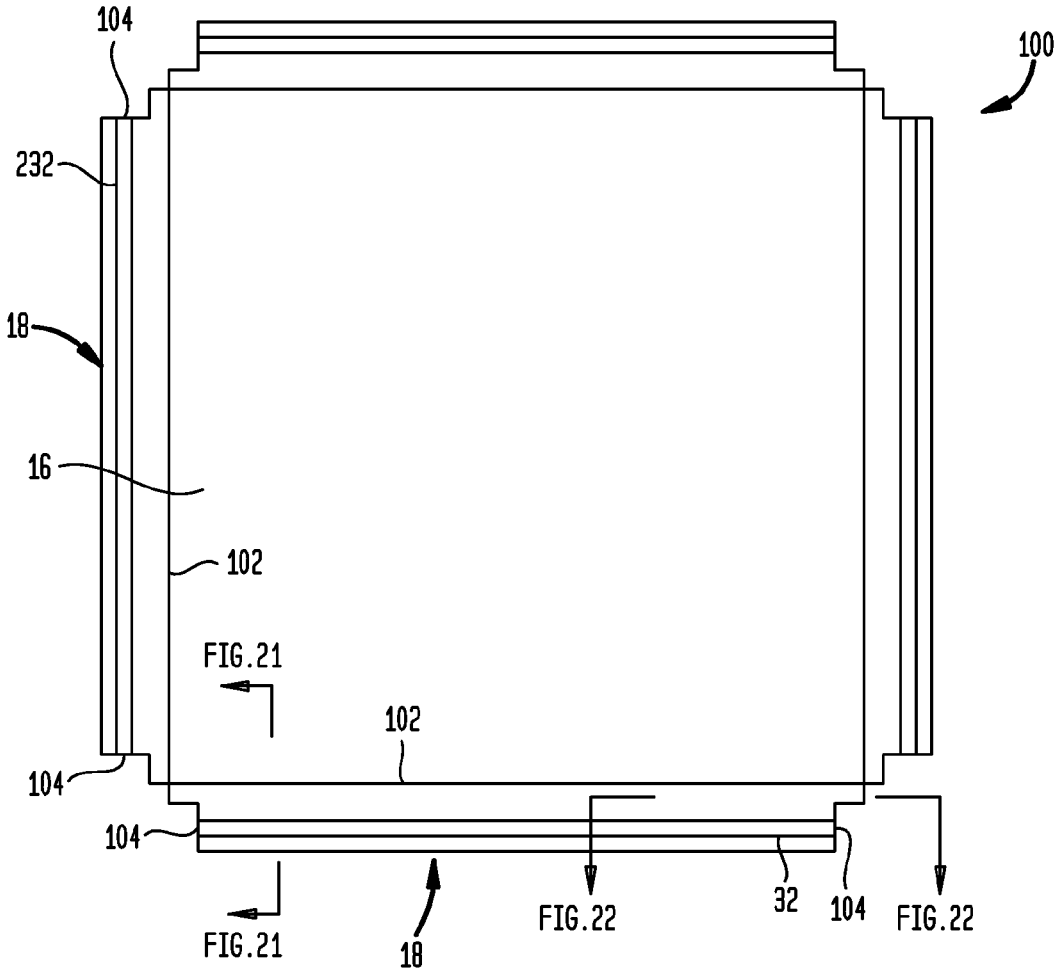
FIG. 20 is a top plan view of a planar blank used for forming a wall panel.
Figure 21:
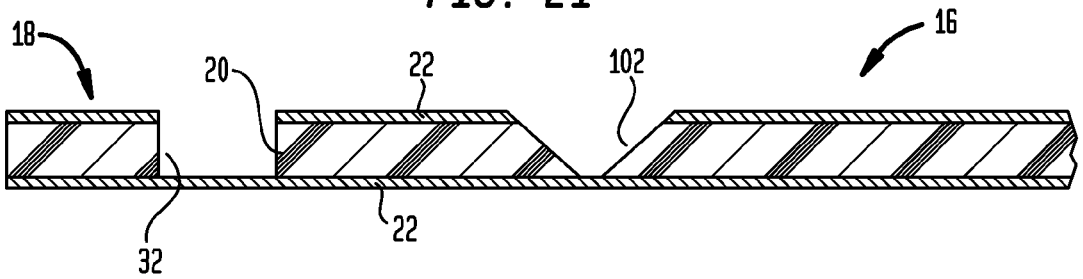
FIG. 21 is a cross-sectional view of the planar blank of FIG. 20, taken along line 21-21 thereof.
Figure 22:
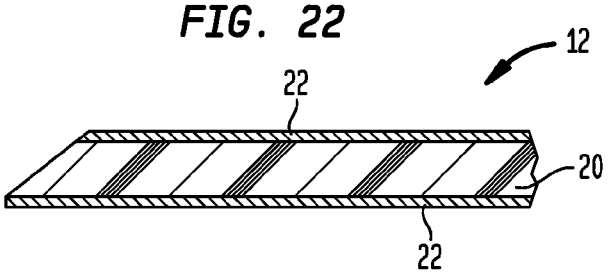
FIG. 22 is a cross-sectional view of the planar blank of FIG. 20, taken along line 22-22 thereof.

With all of the above embodiments, each wall panel 12 is preferably formed from a planar blank 100 shown in FIG. 20, which is formed preferably by, but not limited to, a polyethylene core 20 with a thin aluminum wall 22 covering opposite sides thereof, as shown in FIGS. 5, 21 and 22. Each planar blank 100 can be stamped from or cut from a larger sheet of the respective material.

Specifically, each planar blank 100 is formed by planar main panel section 16 which is preferably, but not limited to, a square shape with all sides being equal. There are four bent end sections 18, each formed as one piece at a respective side edge of planar main panel section 16, and coplanar therewith. A V-shaped cut-out 102 extends through one thin aluminum wall 22 and polyethylene core 20 at the connecting edge of each bend end section 18 to the side edge of planar main panel section 16, as best shown in FIG. 21. This permits each bent end section 18 to be bent along its respective V-shaped cut-out 102 at a right angle to planar main panel section 16 in the manner shown, for example, in FIG. 3. Each bent end section 18 further includes cut-out section 32 at the inner surface 26 thereof and spaced slightly away from main panel section 16. Each cut-out section 32 can take any suitable shape, such as the nose-shaped configuration in cross-section of FIG. 3, the rectangular configuration in cross-section of FIG. 15, the part-cylindrical configuration in cross-section of FIG. 11, etc., or any other suitable configuration.

In accordance with an important aspect of the present invention, the opposite ends of each bent end section 18 have a rectangular cut-away section 104. Three of the bent end sections 18 are bent along V-shaped cut-outs 102 in FIG.

Figure 23:
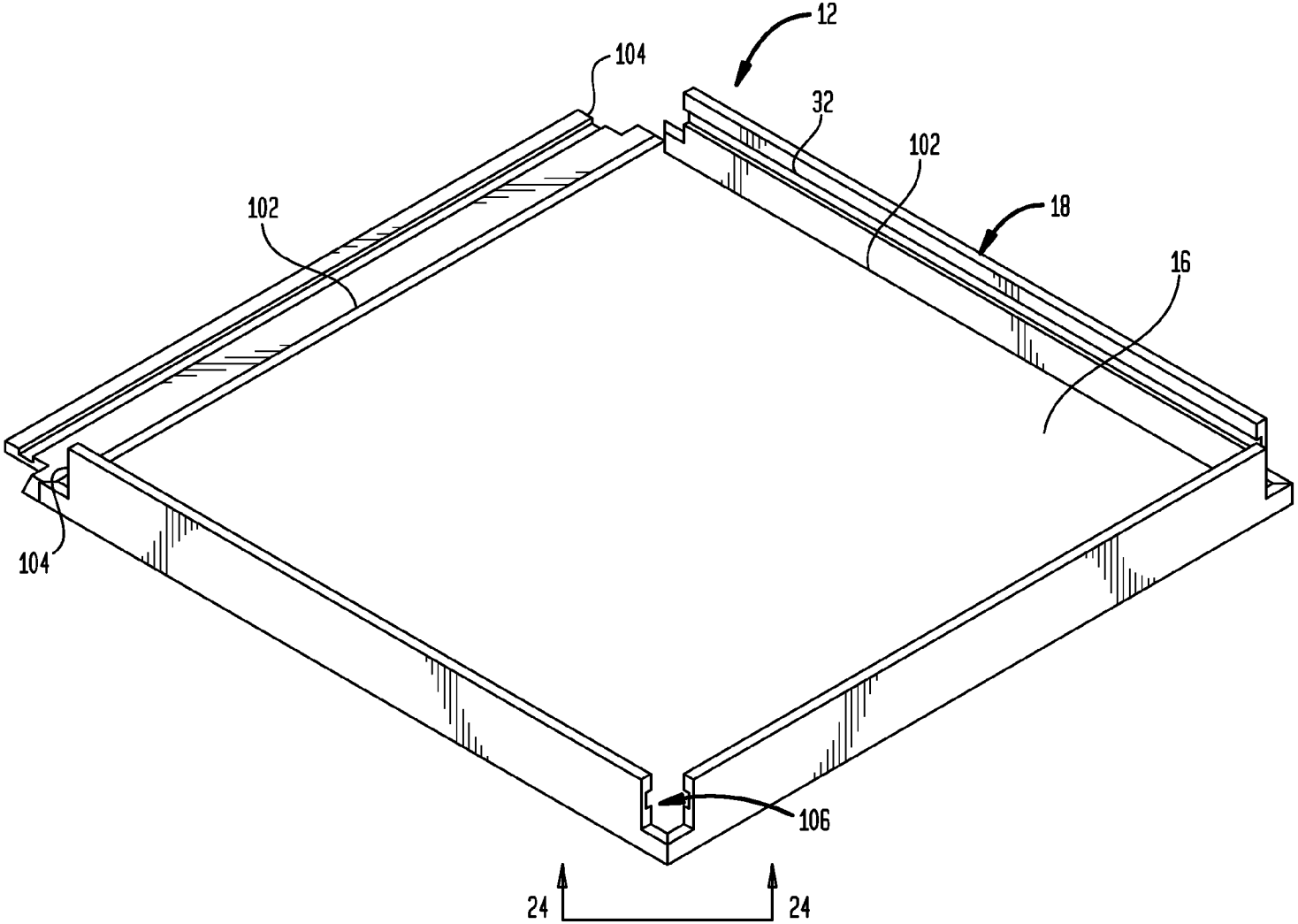
FIG. 23 is a perspective view of the blank of FIG. 20, with three bent end sections bent at right angles with respect to the planar main panel section.
Figure 24:
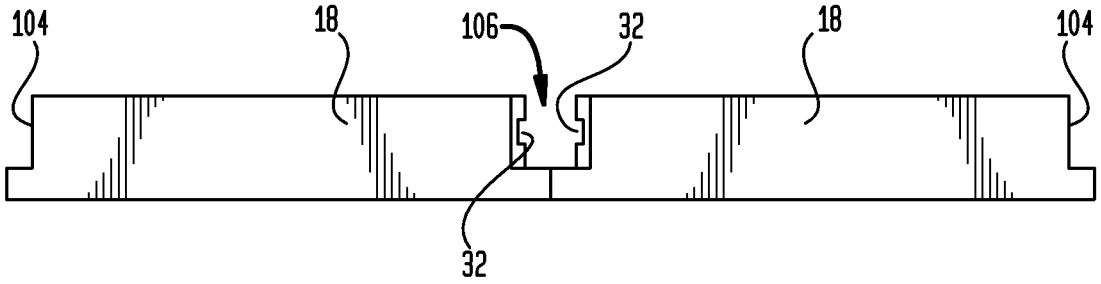
FIG. 24 is an elevational view of the blank of FIG. 23, viewed along line 24-24.
Figure 25:
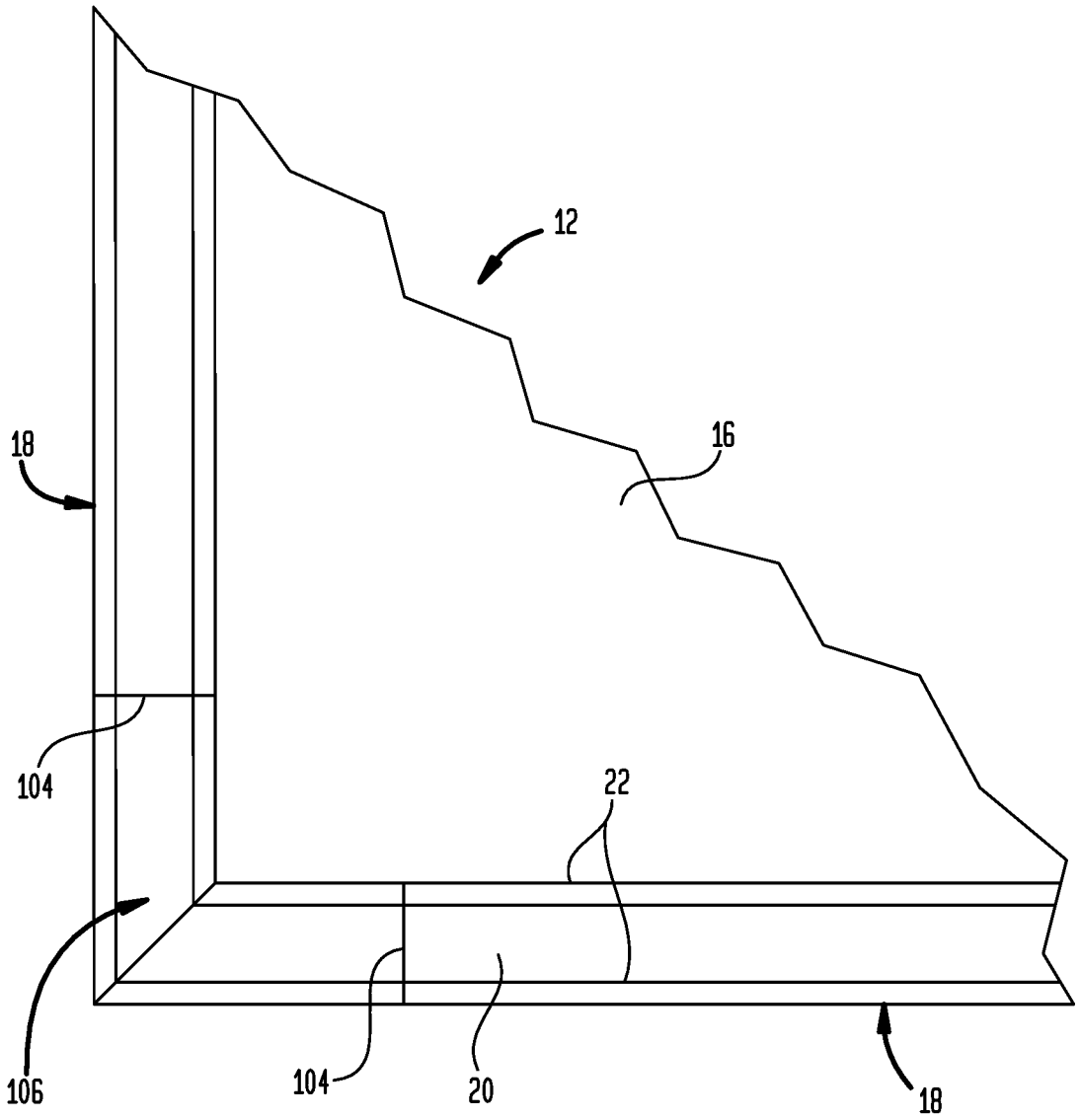
FIG. 25 is a top plan view of one of the corners which is circled in FIG. 23 where two bent end sections are both bent at rights angles with respect to the planar main panel section.
Figure 27:
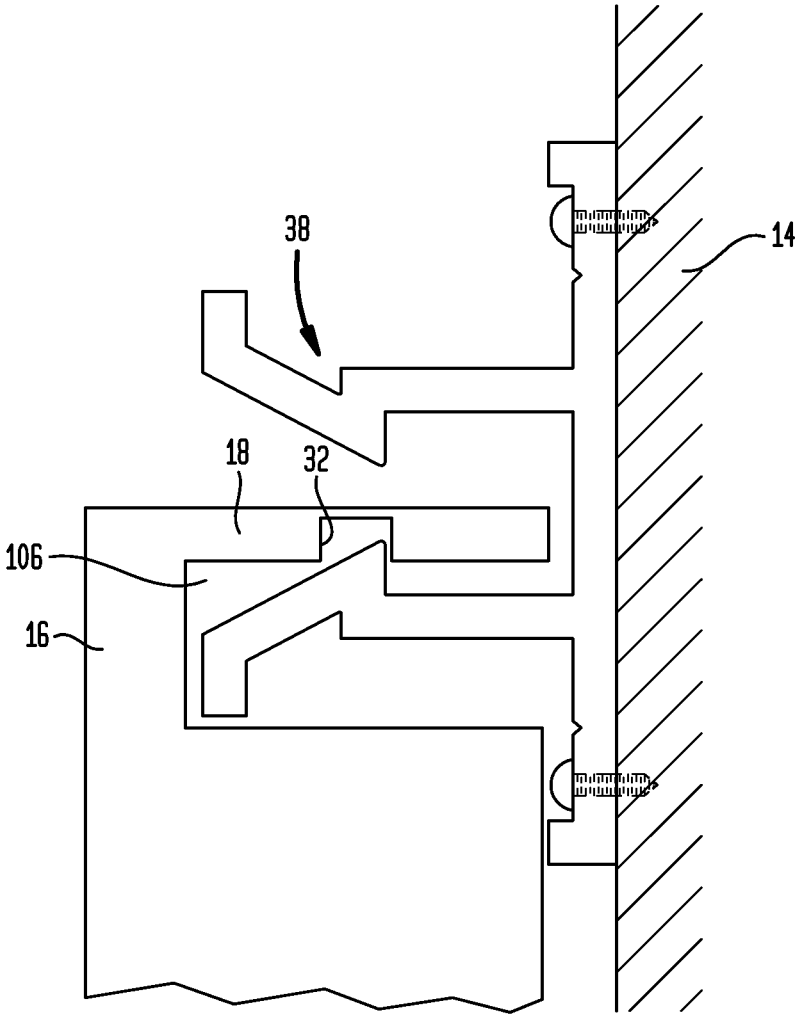
FIG. 27 is an end elevational view of a wall panel hung on a main fastening extrusion for sliding therealong.
Figure 28:
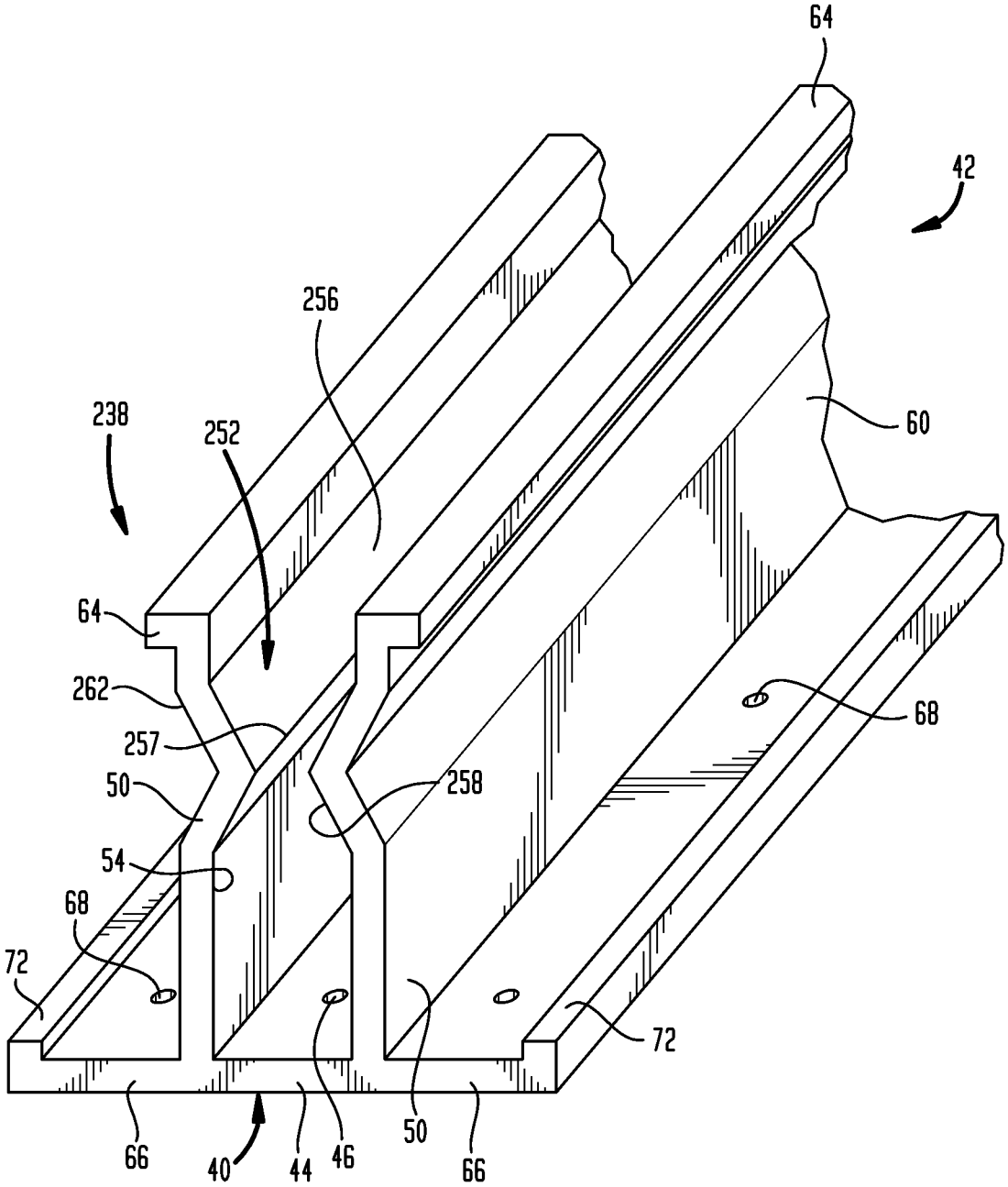
FIG. 28 is a perspective view of a frame extrusion according to another embodiment of the present invention.

23 for illustration purposes only, and as shown in FIGS. 23-25, at the corners where bent end sections 18 are bent at right angles to planar main panel section 16, corner openings or cut-away sections 106 are provided. As a result, when a main fastening extrusion 38, such as the one shown in FIGS. 6 and 27, is secured to an existing wall structure 14, such that it extends along the entire length of the existing wall structure 14, wall panels 12 can merely be hung thereon in the manner shown in FIG. 27 and slid therealong, as a result of corner openings 106.

Of course, it will be appreciated that each corner opening 106 can be formed by a single cut-away section 104, that is, one bent end section 18 at a corner may not include a cut-away section 104.

Figure 25A:
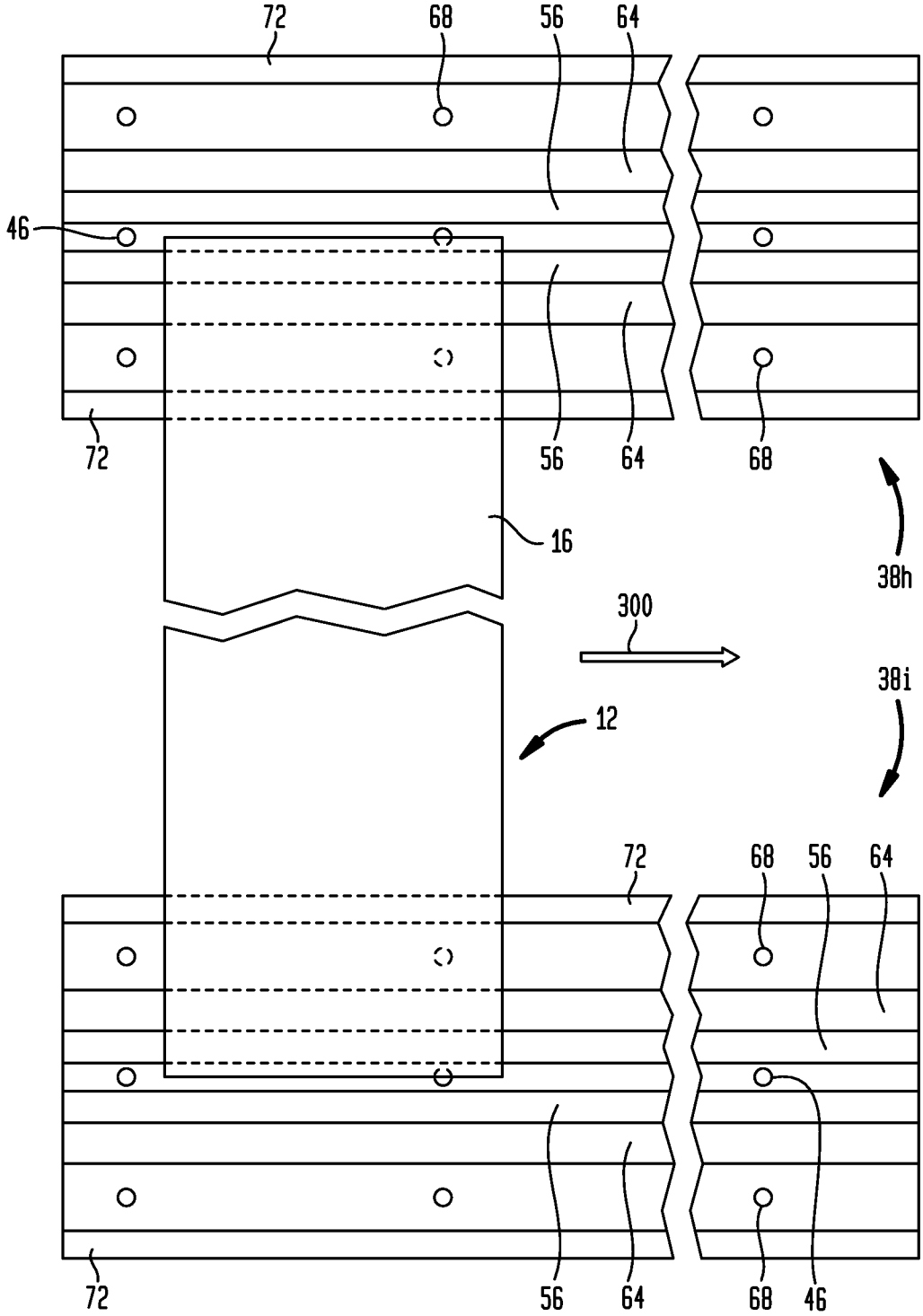
FIG. 25A is an elevational view showing assembly and sliding of a wall panel on two parallel, spaced apart extrusions.

Further, it will be appreciated that the use of corner openings 106 is used with each of the above embodiments. This is a great advantage over known systems in which the panels have to be carefully placed over the extrusions. With this system, the extrusions are mounted to a wall, and the panels are placed on the extrusions and can be slid therealong so as to be easily adjusted in position. Therefore, there is a great savings in time during construction. Specifically, as shown in FIG. 25A, there is shown a front elevational view of a wall having two parallel, spaced apart, elongated fastening extrusions 38*h* and 38*i*, of the type shown in FIG. 2 mounted to a wall 14. A wall panel 12 of much less length is shown mounted thereto. For example, fastening extrusions 38*h* and 38*i* may extend along the entire length of a wall 14, for holding, for example, ten or more wall panels 12 thereon. In such case, only the bent end sections 18 at the upper and lower edges of wall panel 12 are engaged with the two fastening extrusions 38*h* and 38*i*. Specifically, the upper bent end section 18 is preferably engaged with the upper fastening extrusion 38*h* and then that wall panel 12 can be slid along fastening extrusions 38*h* and 38*i* in the direction of arrow 300 to a desired position, either vertically or horizontally, whereupon the lower bent end section 18 is snapped into engagement with the lower fastening extrusion 38*i*. Alternatively, both upper and lower bent end sections 18 can be snapped into engagement with fastening extrusions 38*h* and 38*i*, and the wall panel then slid therealong to the desired position. It will be appreciated that wall panel 12 must necessarily also include side bent end sections 18 as well, in order to provide a finished appearance to the exposed surface of the wall panel, and for this reason, the use of corner cut-away section or opening 104 is essential for permitting this sliding arrangement. This provides for easy and accurate leveling along the entire wall during installation.

With all of the above arrangements, the main fastening extrusions are all secured to a wall in a predetermined spaced relationship to each other. Thereafter, it is only necessary to snap in the wall panels, whereby the bent end sections of each pressed or snapped in wall panel function to bend the flexible and resilient bent end securing walls of the respective main fastening extrusion away from the bent end sections until the inwardly directed projections of the bent end securing walls enter the respective cut-out sections of the bent end sections of the wall panels to secure the wall panels in place. Thus, there is no need to hold the walls panels in position on the wall, or with the main fastening extrusions, while subsequently requiring the insertion by screws as in the prior art. Therefore, assembly is very easy with the present invention by a mere press fit.

Figure 26:
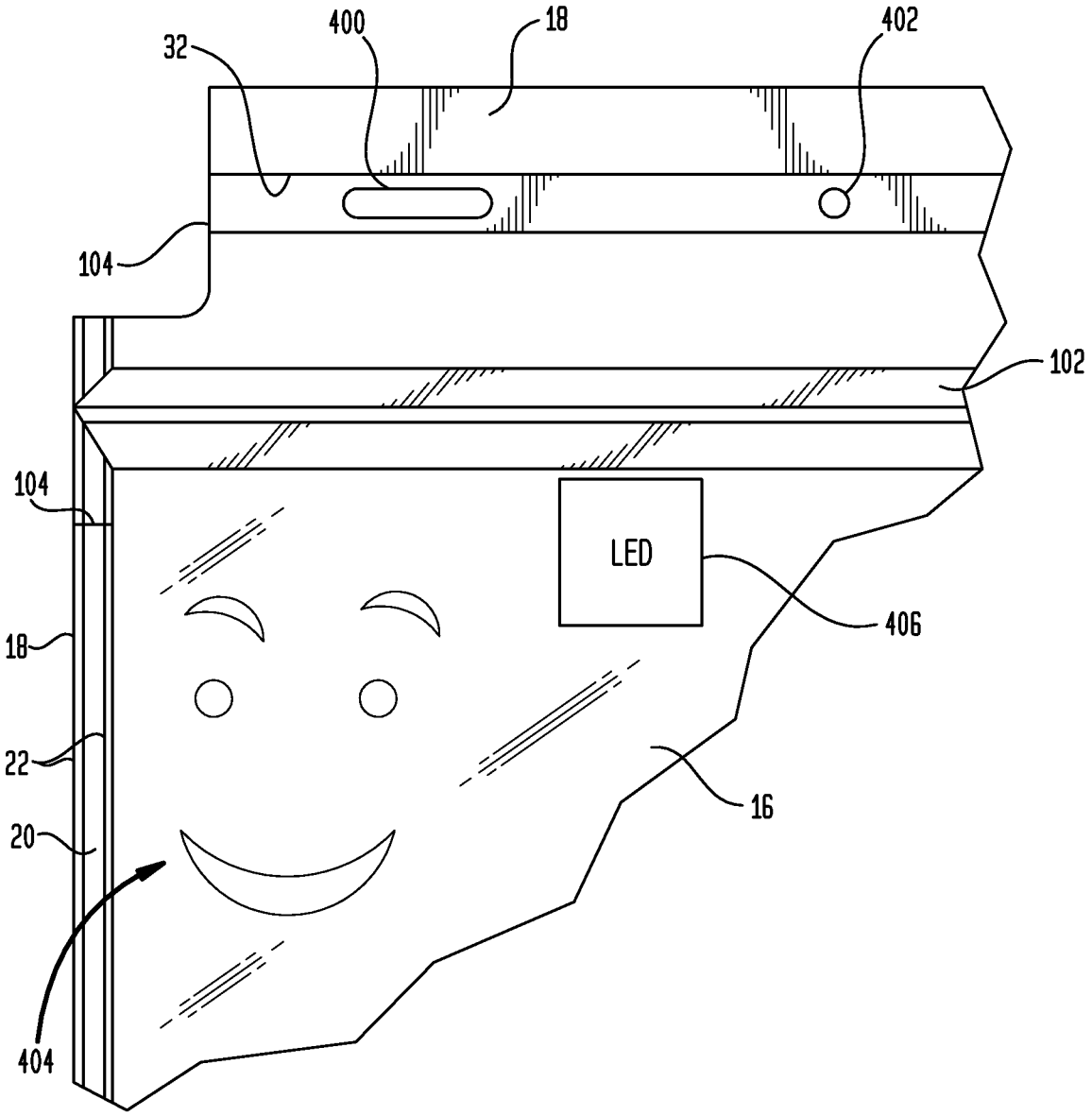
FIG. 26 is a top plan view of one of the corners which is circled in FIG. 23 where only one bent end section is bent at a rights angle with respect to the planar main panel section.

In addition, as shown in FIG. 26, openings in any shape, such as a slot opening 400, a circular opening 402 or the like can be provided in bent end sections 18, for example, in cut-out sections 32 or otherwise, or even in main panel section 216, for example, as shown by the openings which form a face 404, any picture, advertising, a message or the like. Light emitting diodes (LEDs) 406 or any other light source can be provided, for example, on the inner facing surface of main panel section 216, so that light therefrom is emitted out from openings 400, 402 and 404.

With all of the above embodiments, because of the holding surfaces of the cut-out sections and the respective holding surfaces of the projections, the wall panels are positively and securely held in position so that they cannot be removed. This is ideal for wall panels secured to the outside of a building. However, for wall panels secured to an inner wall of a building, where vandalism is not a large issue, it may be desirable to replace the walls panels with new wall panels. In such case, it is desirable that the wall panels be positively and securely held in position, but also that the wall panels be permitted to be readily removed for interchanging with different wall panels.

In this regard, reference is first made to FIGS. 28-31, which correspond to FIGS. 2-5, but which show modified wall panels 212 and a modified main fastening extrusion 238, with all like elements from wall panels 12 and main fastening extrusion 38 identified by the same reference numerals.

Wall panels 212 differ from wall panels 12 in that nose-shaped cut-out section 32 is replaced by a V-shaped cut-out section 232. Specifically, each cut-out section 232 has a first inclined wedge surface 234 that meets a second reverse inclined wedge surface 236 that extends at an opposite inclination to first inclined wedge surface 234 and which meet at a vertex 235. As a result, inclined wedge surfaces 234 and 236 form straight planar, wedge surfaces, as will be understood from the discussion hereafter.

V-shaped cut-out section 232 preferably extends along the entire length of the bent end section 18, although the present invention is not so limited, that is, cut-out section 232 can extend along only a part of the length of bent end section 18, or there may be a plurality of spaced apart cut-out sections 232.

In like manner, main fastening extrusions 238 differ from main fastening extrusions 38 in that nose-shaped projection 52 is replaced by a V-shaped projection 252. Specifically, each V-shaped projection 252 has a first inclined wedge surface 256 that meets a second reverse inclined wedge surface 258 that extends at an opposite inclination to first inclined wedge surface 256 and which meet at a vertex 257. As a result, inclined wedge surfaces 256 and 258 form straight planar, wedge surfaces, as will be understood from the discussion hereafter.

V-shaped projection 252 preferably extends along the entire length of the bent end securing wall 50, although the present invention is not so limited, that is, V-shaped projection 252 can extend along only a part of the length of bent end securing wall 50, or there may be a plurality of spaced apart V-shaped projections 252.

Figure 29:
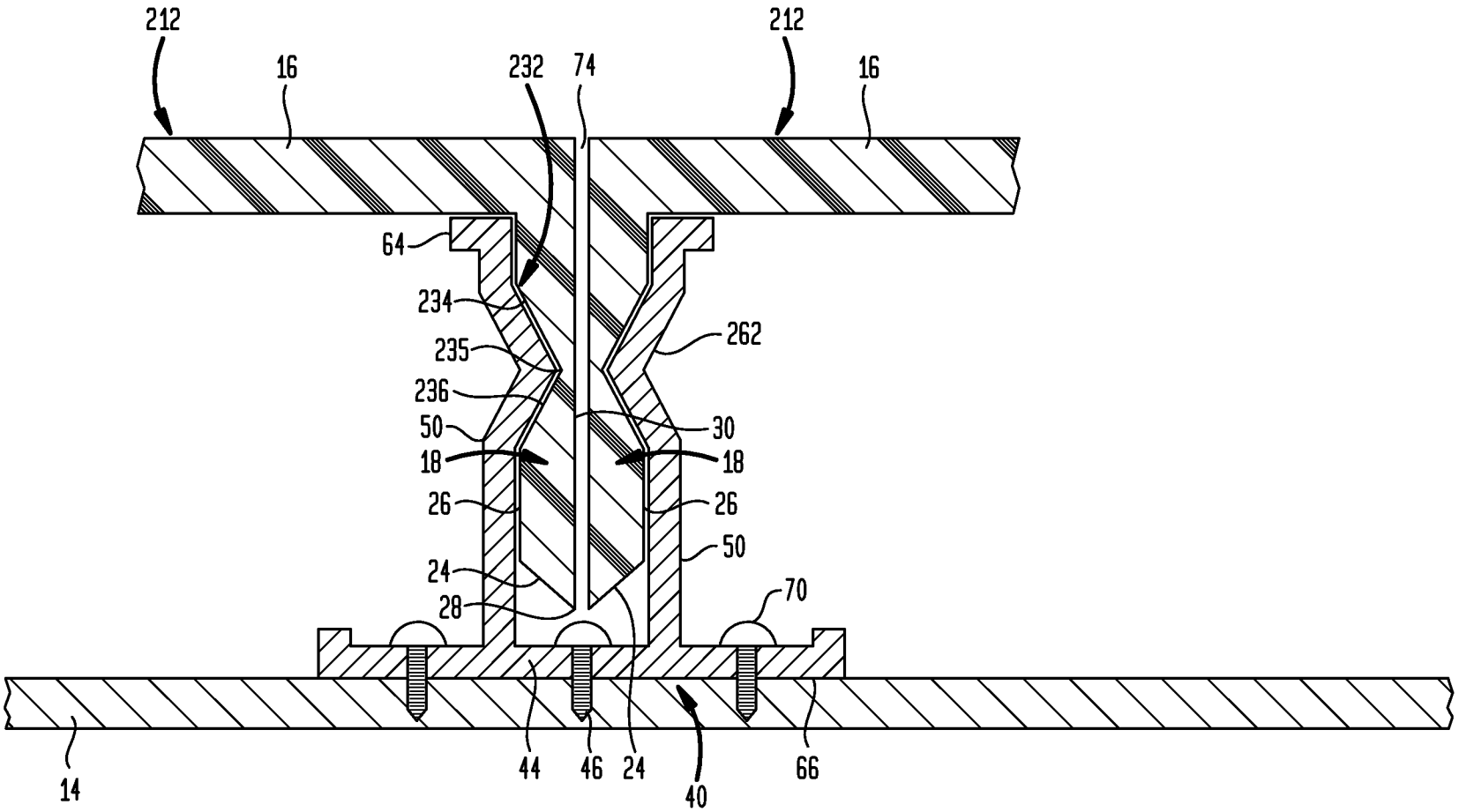
FIG. 29 is a cross-sectional view showing two wall panels connected together by the frame extrusion of FIG. 28.
Figure 30:
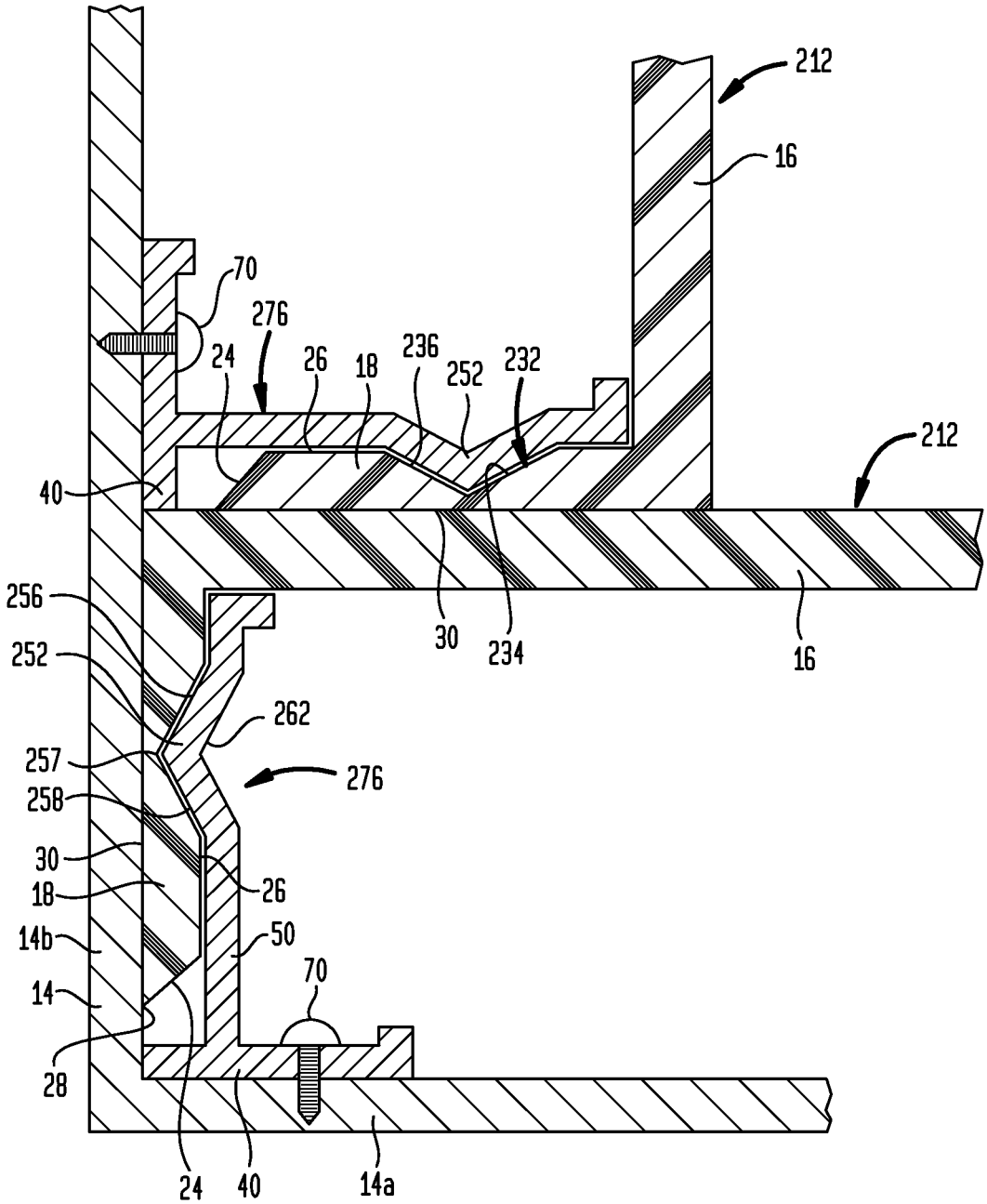
FIG. 30 is a cross-sectional view showing two wall panels connected together by a corner frame extrusion.
Figure 31:
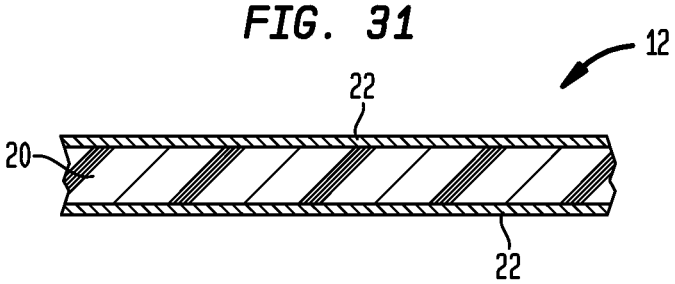
FIG. 31 is a cross-sectional view of a wall panel.

As shown in FIGS. 29 and 30, the outer surface 60 of each bent end securing wall 50 includes a V-shaped cut-out section 262 corresponding in position to V-shaped projection 252, in order to save material, although the present invention is not limited thereby, and V-shaped cut-out section 262 can be eliminated.

With this arrangement, main extrusions 238 are first secured to existing wall structure 14 by screws 46 and 70 at predetermined spacing intervals determined by the dimensions of wall panels 12. Thereafter, it is only necessary to push bent end sections 18 of wall panels 12 into the gap between spaced apart bent end securing walls 50. This can be performed with bent end section 18 of one wall panel 12, followed by a bent end section 18 of an adjacent wall panel 12, or with the two bent ends sections 18 of adjacent wall panels 12 simultaneously. In such case, lower beveled surface 24 of each bent end securing wall 50 first hits against inclined wedge surface 256 and biases the respective bent end securing wall 50 outwardly away from the other bent end securing wall 50, whereby the distal end of each bent end section 18 can pass into the space defined between central planar wall 44 and inwardly directed V-shaped projection 252. Once reverse inclined wedge surface 236 passes inclined wedge surface 256, the respective bent end securing wall 50 springs back to its original position, whereby V-shaped inwardly directed projection 252 releasably engages in V-shaped cut-out section 232. In such case, inclined wedge surface 256 engages or is in near proximity to inclined wedge surface 234 and reverse inclined wedge surface 258 engages or is in near proximity to reverse inclined wedge surface 236 to retain bent end section 18, while still permitting release by a sufficient pulling action at a later time to replace the wall panels. Preferably, in such position, outwardly extending stub walls 64 are in abutting or near abutting relation with the respective planar main panel sections 16.

In the embodiment of FIGS. 2-5, holding surfaces 36 and 58 prevent the escape of the wall panels 12. This makes it very difficult to remove existing mounted wall panels 12 and replace the same with new wall panels 12. However, with the present invention, because of engaging V-shaped cut-out section 232 and V-shaped projection 252, that is, because the holding surfaces 36 and 58 of the embodiment of FIGS. 2-5 are replaced by reverse inclined wedge surfaces 236 and 258, the wall panels 12 are held in a mounted state, but can be removed and replaced by new wall panels 12 by merely pulling out the already mounted wall panels 12. This is because reverse inclined surfaces 236 and 258 permit such action. In such case, a reverse wedging operation occurs, with reverse inclined wedge surfaces 236 and 258, during pull-out, causing bent end securing walls 50 to be biased away from each other by the wedging action, until vertices 235 pass lower beveled surfaces 24, whereby bent end securing walls 50 spring back to their original positions.

It is noted that this embodiment provides two distinctions over the prior art of U.S. Pat. No. 4,344,267 to Sukolics, U.S. Pat. No. 4,829,740 to Hutchison. In the latter patents, there is no indication that the bent end securing walls of these patents can be biased outwardly, and in fact, this would be contrary to the operation thereof, and also, these patents provide a part circular cut-out section and projection which may inhibit a wedging operation.

It is noted that the outer surfaces 30 of adjacent bent end sections 18 are in abutting or near abutting relation, that is, they are at least in near abutting relation. As shown in FIG. 29, there is only a very small gap between adjacent outer surfaces so that they are in near abutting relation, but in fact, they can be, and preferably are, in abutting or touching relation with each other. With this arrangement, there is no need to provide any sealants or plugs in gap 74, and in fact, no such sealants or plugs would even fit within gap 74.

In other words, the two bent end securing walls 50 have a spacing therebetween corresponding substantially to the wall thickness of the two bent end sections 18 held therein.

In this regard, it is very easy to assemble wall panels 12 by merely pressing bent end sections 18 into the space between adjacent bent end securing walls 50, and in like manner, wall panels 12 can be readily removed by merely pulling them out with sufficient force.

FIG. 30 shows the same structure as FIG. 4, at a corner of an existing wall structure 14, but in which corner fastening extrusions 276 differ from corner fastening extrusions 76 in that nose-shaped projection 52 is replaced by a V-shaped projection 252. Specifically, each V-shaped projection 252 has a first inclined wedge surface 256 that meets a second reverse inclined wedge surface 258 that extends at an opposite inclination to first inclined wedge surface 256 and which meet at a vertex 257. As a result, inclined wedge surfaces 256 and 258 form straight planar, wedge surfaces. Wall panels 212 differ from wall panels 12 in that nose-shaped cut-out section 32 is replaced by a V-shaped cut-out section 232, in the same manner as discussed above in regard to FIG. 29.

During assembly at each corner, a first corner fastening extrusion 276 is secured to one wall 14*a* of existing wall structure 14 by screws 70 extending through openings 68 of the wing 66, such that the free end of base section 40 is in abutting relation to the other wall 14*b* of the corner which is perpendicular to wall 14*a*. In this arrangement, there is a space between the bent end securing wall 50 thereof and the parallel other wall 14*b*. A bent end section 18 is then press fit into this space, whereby the bent end securing wall 50 is biased away from the other wall 14*b* by engagement of the inner surface of bent end section 18 with inclined surface 256, until inclined wedge surface 236 passes vertex 257, whereby bent end securing wall 50 springs back to its original position, such that V-shaped inwardly directed projection 252 engages in V-shaped cut-out section 232. With this arrangement, bent end section 18 is held in position, while still permitting easy removal of bent end section 18 at a later time to remove the wall panel 12. In such position, outwardly extending stub walls 64 are preferably in abutting or near abutting relation with the respective planar main panel section 16.

In this position, the outer surface 30 of the bent end section 18 is in abutting or near abutting relation with the adjacent corner wall 14*b*, that is, it is at least in near abutting relation.

Then, a second corner fastening extrusion 276 is secured to the other wall 14*b* of existing wall structure 14 by screws 70 extending through openings 68 of the wing 66, such that the free end of base section 40 is in abutting relation to planar main panel section 16 of the already assembled wall panel 12. In this arrangement, there is a space between the bent end securing wall 50 thereof and planar main panel section 16 of the already assembled wall panel 12. A bent end section 18 of another wall panel 12 is then press fit into this space, whereby the bent end securing wall 50 is biased away from planar main panel section 16 of the already assembled wall panel 12 by engagement of the inner surface of bent end section 18 with inclined surface 256, until inclined wedge surface 236 passes vertex 257, whereby bent end securing wall 50 springs back to its original position, such that V-shaped inwardly directed projection 252 engages in V-shaped cut-out section 232. In such position, outwardly extending stub walls 64 are in abutting or near abutting relation with the respective planar main panel section 16.

In this position, the outer surface 30 of the bent end section 18 is in abutting or near abutting relation with the adjacent planar main panel section 16, that is, it is at least in near abutting relation.

It will be appreciated that the present invention can be varied within the scope of the claims. In all of the following embodiments, the bent end securing walls 50 are biased outwardly when the bent end sections 18 are pressed into engagement therewith, whereby the bent end securing walls 50 snap back and are then locked with the bent end sections 18, while also permitting later release and removal of the wall panels 212 by pulling wall panels 212 out, by using the inclined wedge surfaces.

Figure 32:
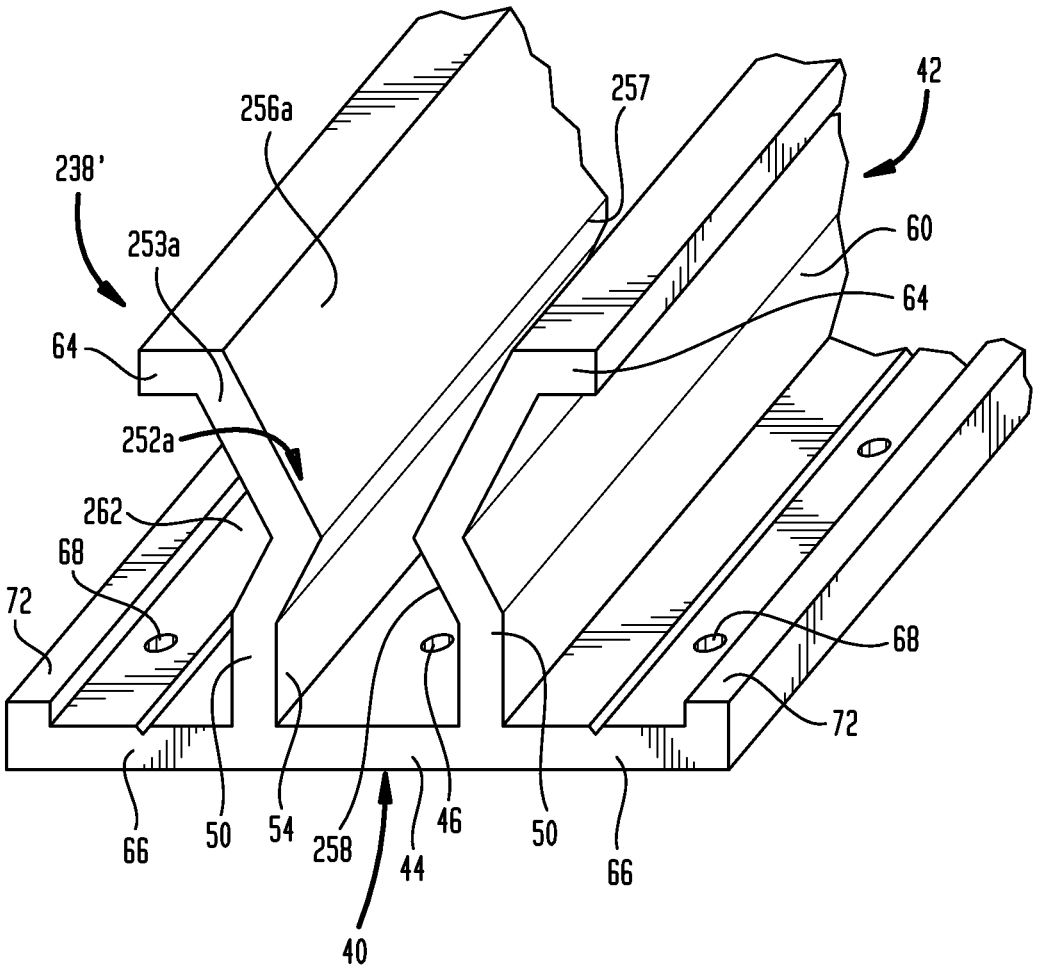
FIG. 32 is a perspective view of a frame extrusion according to another embodiment of the present invention.

Thus, FIG. 32 shows a modification of the embodiment of FIG. 2 in which the inclined surface 256*a* of each inwardly directed projection 252*a* of main fastening extrusion 238' continues upwardly at an angle with an inclined wall 253*a* and ends in outwardly extending stub wall 64 that is perpendicular to the respective bent end securing wall 50 and parallel to central planar wall 44, rather than changing direction and running parallel to each bent end securing wall 50. Preferably, although not required, outwardly extending stub wall 64 is in contact with the underside of planar main panel section 16 when inwardly directed projection 252*a* is positioned in cut-out section 32 so as to provide a snap-tight like action with a tight fit so that there is little or no play, whereby wall panels 12 are tightly held in position, while still permitting removal of wall panels 212 by reason of the aforementioned wedging action of the inclined wedge surfaces. Of course, it will be appreciated that outwardly extending stub walls 64 can be eliminated, and the free end of inclined wall 53*a* could be used to contact the underside of planar main panel section 16.

Figure 33:
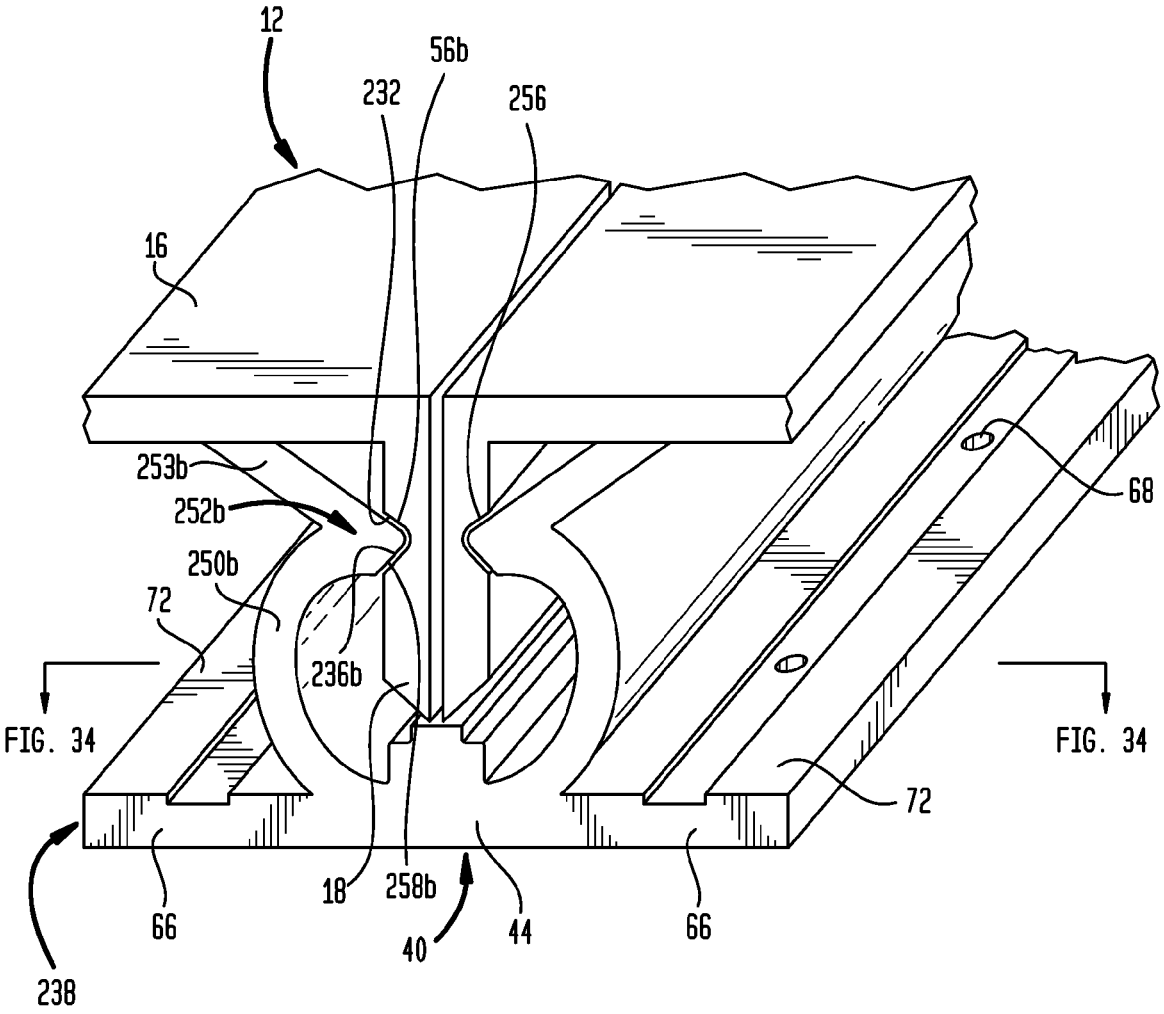
FIG. 33 is a perspective view showing two wall panels connected together by a frame extrusion according to another embodiment of the present invention.
Figure 34:
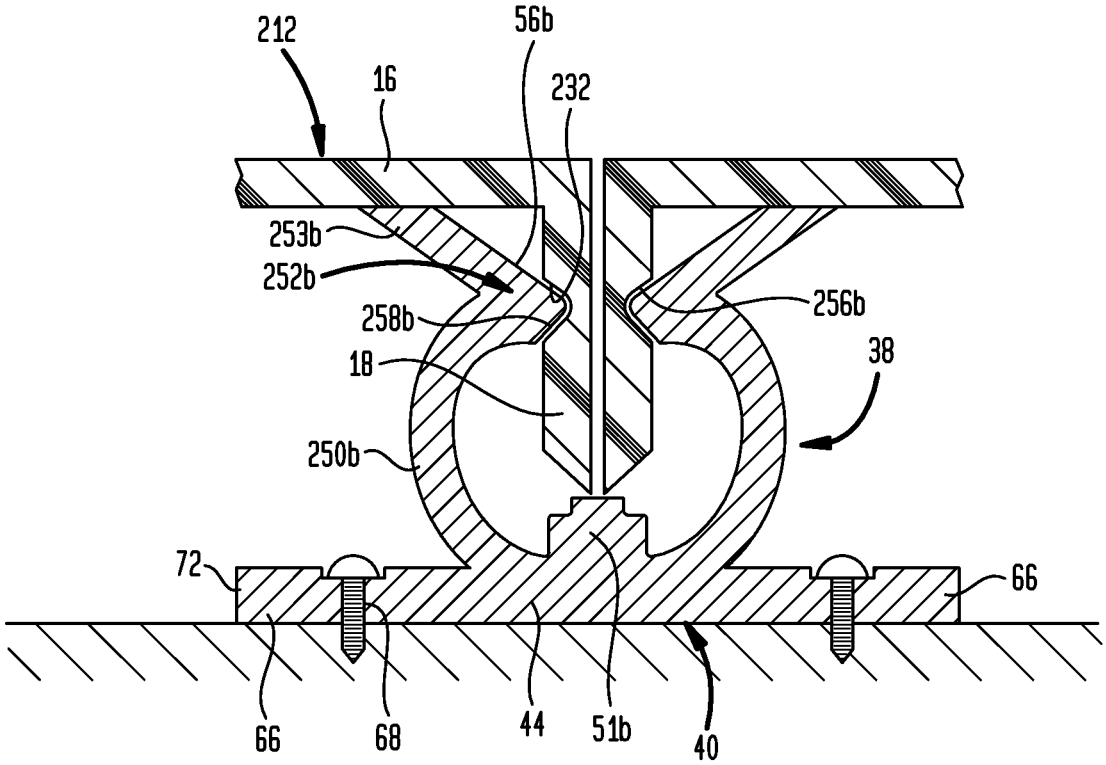
FIG. 34 is a cross-sectional view showing two wall panels connected together by the frame extrusion of FIG. 33.

FIGS. 33 and 34 correspond to the embodiment of FIGS. 7 and 8, except that holding surface 36 is replaced by a reverse inclined wedge surface 236*b* and holding surface 58 is replaced by a reverse inclined wedge surface 258*b* of main fastening extrusion 238". Thus, each bent end securing wall 250*b* has an outward curvature, terminating in an inwardly directed V-shaped projection 252*b* formed by inclined surface 256*b* and reverse inclined surface 258*b*. Further, the inclined surface 256*b* of each inwardly directed projection 252*b* continues upwardly at an angle with an inclined wall 253*b* that abuts against the inner surface or undersurface of planar main panel section 16 since the outwardly extending stub wall is eliminated. As with all other embodiment, bent end securing walls 250*b* are also flexible and resilient, so that they can be bent away from each other and when the bending force is removed, return to their original positions so that V-shaped inwardly directed projections 252*b* engage in V-shaped cut-out sections 232 in FIG. 33.

As will be appreciated from the latter embodiment, the two inwardly directed projections 52*b* have a spacing therebetween which is less than the wall thickness of two said bent end sections 18.

As with the embodiment of FIG. 32, preferably, a fit is obtained with little play. In both embodiments of FIG. 32 and FIGS. 33 and 34, and contrary to known arrangements, V-shaped cutouts 232 provide a sufficient recessed area to receive inwardly directed V-shaped projections 252, while also permitting inwardly directed V-shaped projections 252 to be pulled out therefrom due to the wedging action of reverse inclined wedge surfaces 236 and 258.

The following embodiments all include V-shaped cut-out section 232 with inclined wedge surfaces and corresponding V-shaped projections 252 with inclined wedge surfaces, except where otherwise indicated.

Figure 35:
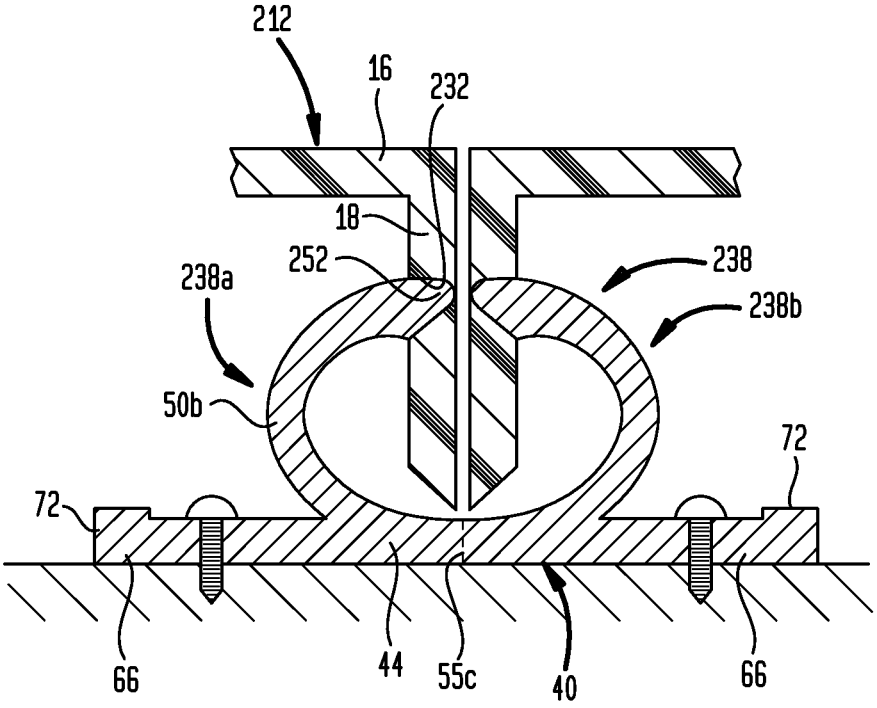
FIG. 35 is a cross-sectional view showing two wall panels connected together by a frame extrusion according to another embodiment of the present invention.

FIG. 35 shows a modification of the FIG. 33 embodiment in which platform 51*b* and inclined walls 53*b* are eliminated in main fastening extrusion sections 238*a* and 238*b*. In addition, as with all of the embodiments in the present application, main fastening extrusions 238 can each be formed as a unitary, one piece structure or of two separate main fastening extrusion sections 238*a* and 238*b* divided, as shown, by dashed line 55*c* in FIG. 35. Of course, V-shaped cut-outs 232 and V-shaped projections 252 are still provided with their inclined wedge surfaces.

Figure 36:
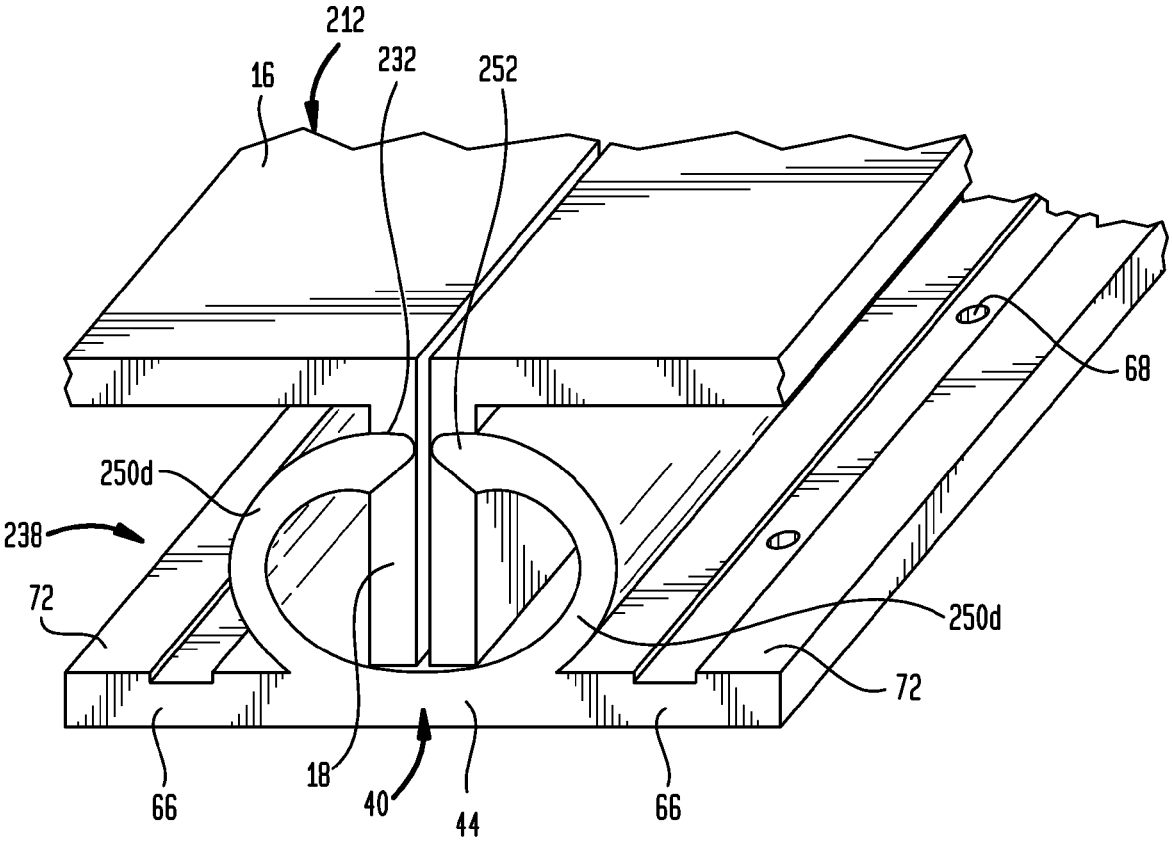
FIG. 36 is a perspective view showing two wall panels connected together by a frame extrusion according to another embodiment of the present invention.

FIG. 36 shows a modification of the FIG. 35 embodiment in which the only change has been changing the arc of outwardly curved bent end securing walls 250*d* so that the free ends form V-shaped projections 252 that engage in V-shaped cut-out sections 232 at positions close to the inner surfaces of bent end sections 18.

Figure 37:
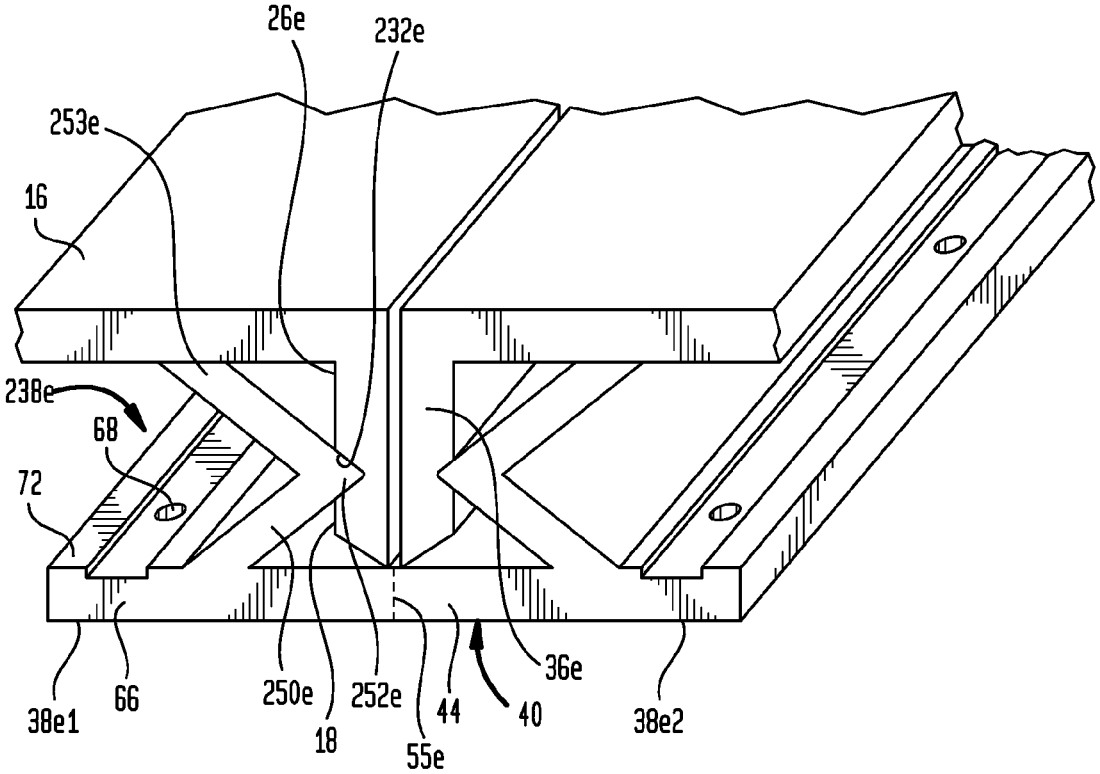
FIG. 37 is a perspective view showing two wall panels connected together by a frame extrusion according to another embodiment of the present invention.

FIG. 37 shows a modification of the FIGS. 32 and 33 embodiment in which the bent end securing walls 250*e* are inclined inwardly in an opposite direction from outwardly inclined wedge walls 253*e* and meet at a V-shaped inwardly directed projection 252*e* which is engaged in a V-shaped cut-out section 232*e*.

With this embodiment, pressing of bent end sections 18*e* into the spacing between bent end securing walls 250*e* of main fastening extrusion 238*e* causes bent end securing walls 250*e* to be biased away from each other until V-shaped projections 252*e* formed with the inclined wedge surfaces snap engage into respective V-shaped cut-out sections 232*e* formed with the inclined wedge surfaces, to releasably lock bent end sections 18*e* in the spacing in a manner that outer walls of bent end sections 18*e* are at least in near abutting relation with each other.

Figure 38:
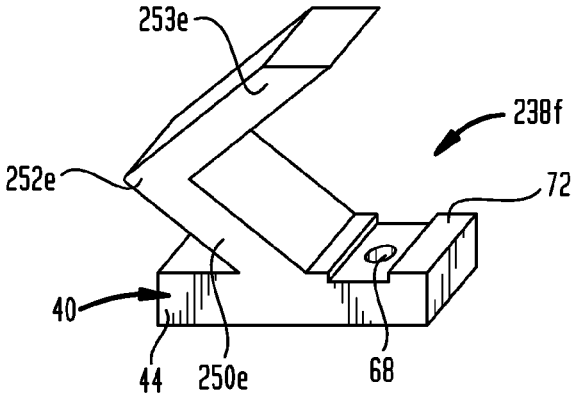
FIG. 38 is a perspective view of a frame extrusion according to another embodiment of the present invention.

As discussed above with respect to FIG. 35, main fastening extrusions 38*e* of FIG. 37 can each be formed as a unitary, one piece structure or of two separate main fastening extrusion sections 238*e*1 and 238*e*2 divided, as shown, by dashed line 55*c* in FIG. 37. In addition, each separate main fastening extrusion section 238*e*1 and 238*e*2 can be formed from a plurality of discrete main fastening extrusions 238*f*, as shown in FIG. 38, which are secured to the wall in parallel, spaced apart relation to each other. This applies to all of the embodiments of the present application.

Figure 39:
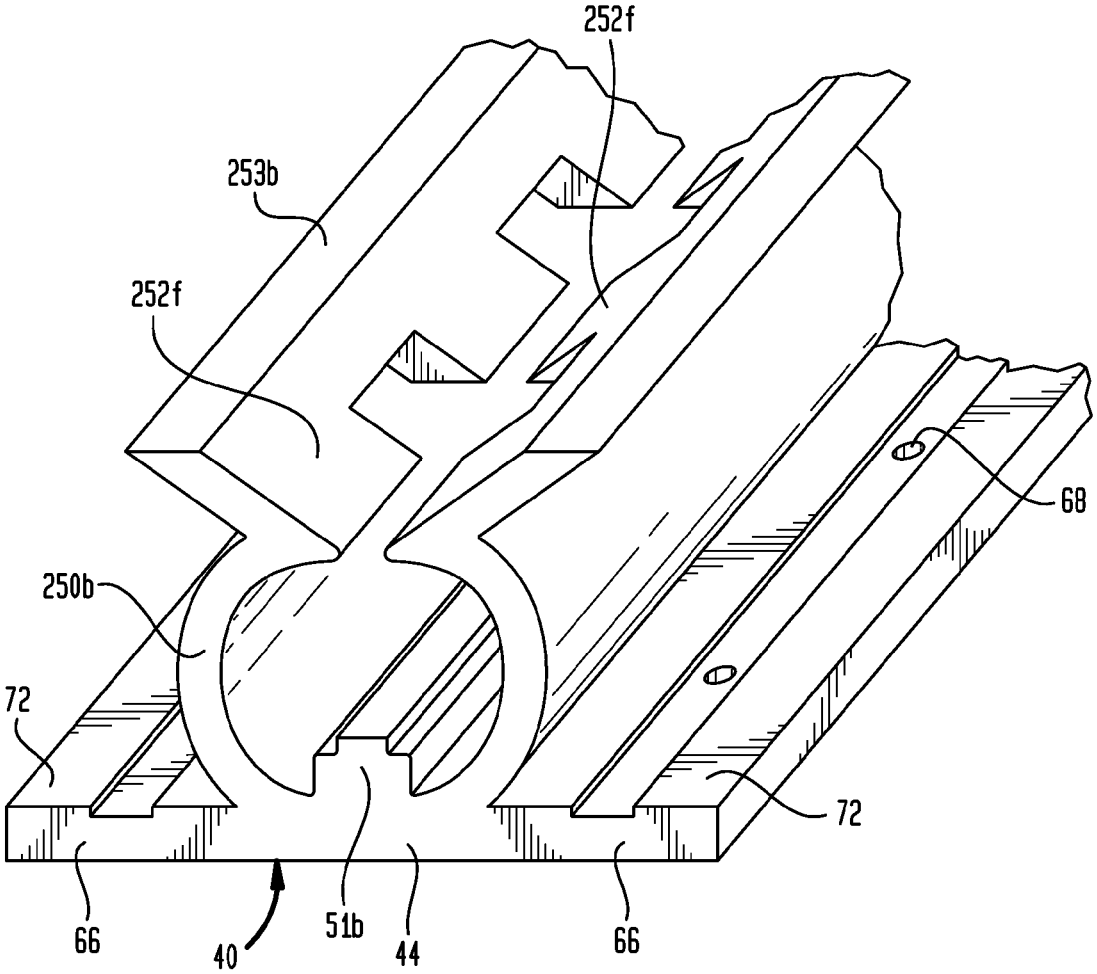
FIG. 39 is a perspective view of a frame extrusion according to another embodiment of the present invention.

It will be appreciated that, with the above embodiments, the respective V-shaped cut-out section 232 has been continuous. However, it is possible that a plurality of spaced apart V-shaped cut-out sections 232 can be provided along the length of bent end sections 18, and in such case, each inwardly directed V-shaped projection 252 would be formed of a plurality of spaced apart inwardly directed V-shaped teeth 252*f*, as shown in FIG. 39, which is a variation of the embodiment of FIGS. 33 and 34. This applies to all of the embodiments in the present application.

Figure 40:
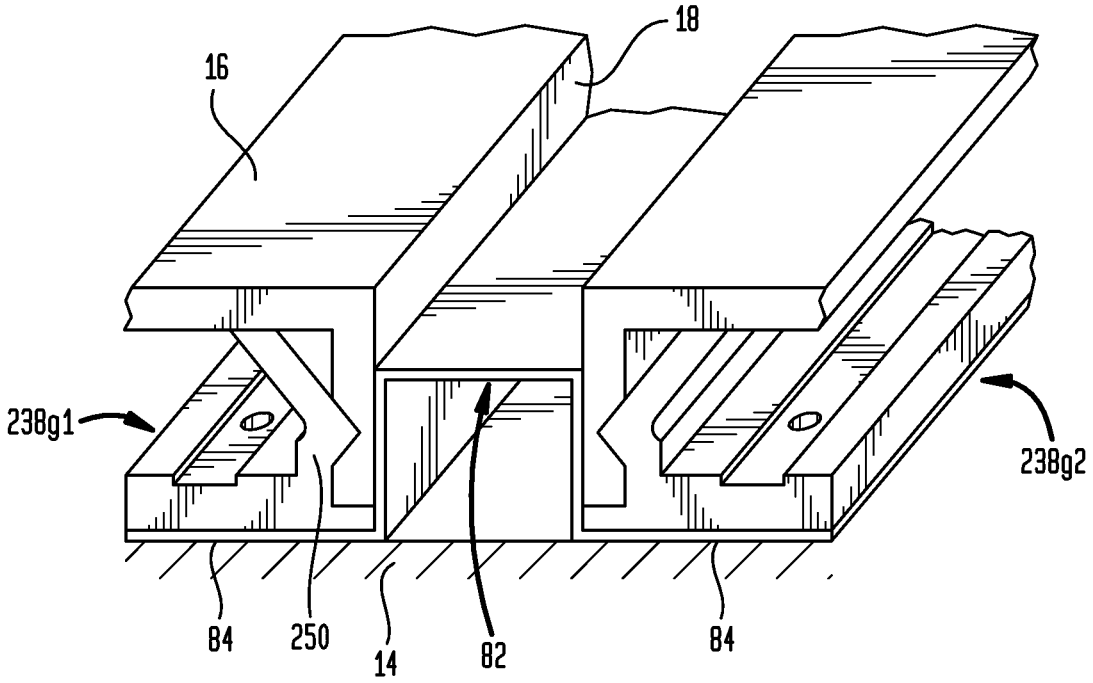
FIG. 40 is a perspective view showing two wall panels connected together by a frame extrusion according to another embodiment of the present invention.

Specifically, as shown in FIG. 40, two separate main fastening extrusion sections 238*g*1 and 238*g*2 are provided, which are of a similar configuration to the main fastening extrusion of FIG. 32, divided along a center line. In the embodiment of FIG. 40, a thin walled, inverted U-shaped spacer member 82 including outwardly extending wing sections 84 that extend between separate main fastening extrusion sections 38*g*1 and 38*g*2 and wall 14, is first secured to the wall 14 by any suitable means, for example, a double sided adhesive strip. Then, separate main fastening extrusion sections 238*g*1 and 238*g*2 are secured to wall 14 by screws, such that the inner surfaces of bent end securing walls 250 thereof are spaced away from the side edges of spacer member 82 by a distance equal substantially to the thickness of a bent end section 18.

Figure 40A:
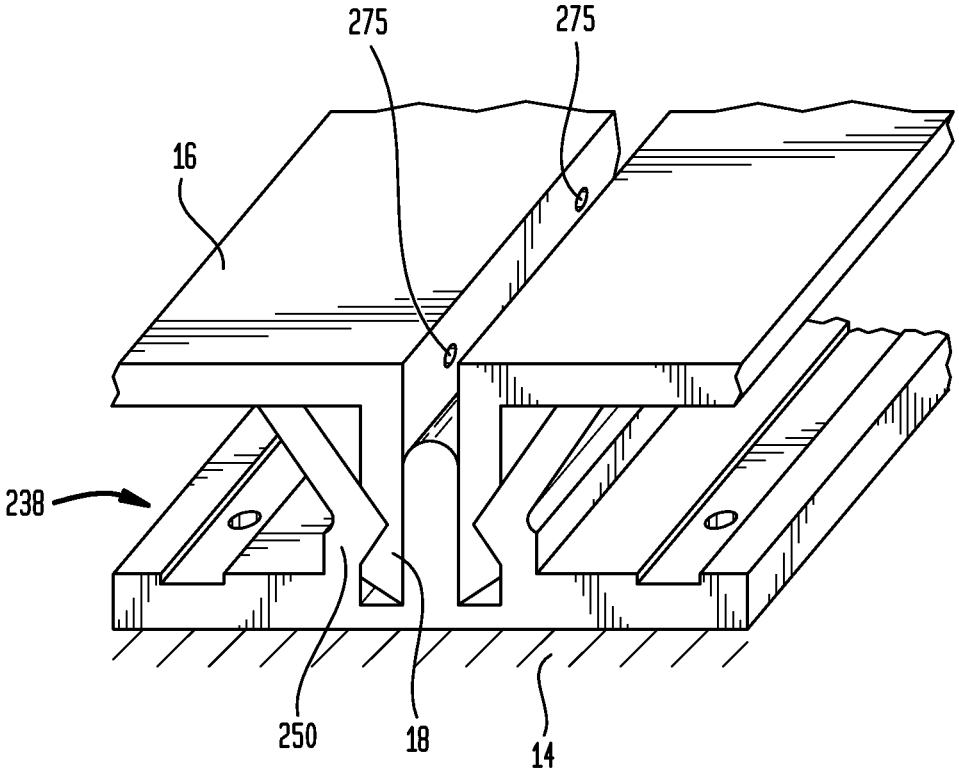
FIG. 40A is a perspective view showing two wall panels connected together by a frame extrusion according to another embodiment of the present invention.

FIG. 40A shows an embodiment similar to FIG. 40, except that U-shaped spacer member 82 is replaced by a spacer post member 282 that is formed integrally as a single piece with main fastening extrusion 238. In addition, holes 275 of any shape can be provided in the facing surfaces of bent end sections 18 so that a tool can be inserted therein to aid in pulling out the wall panels 12.

Figure 40B:
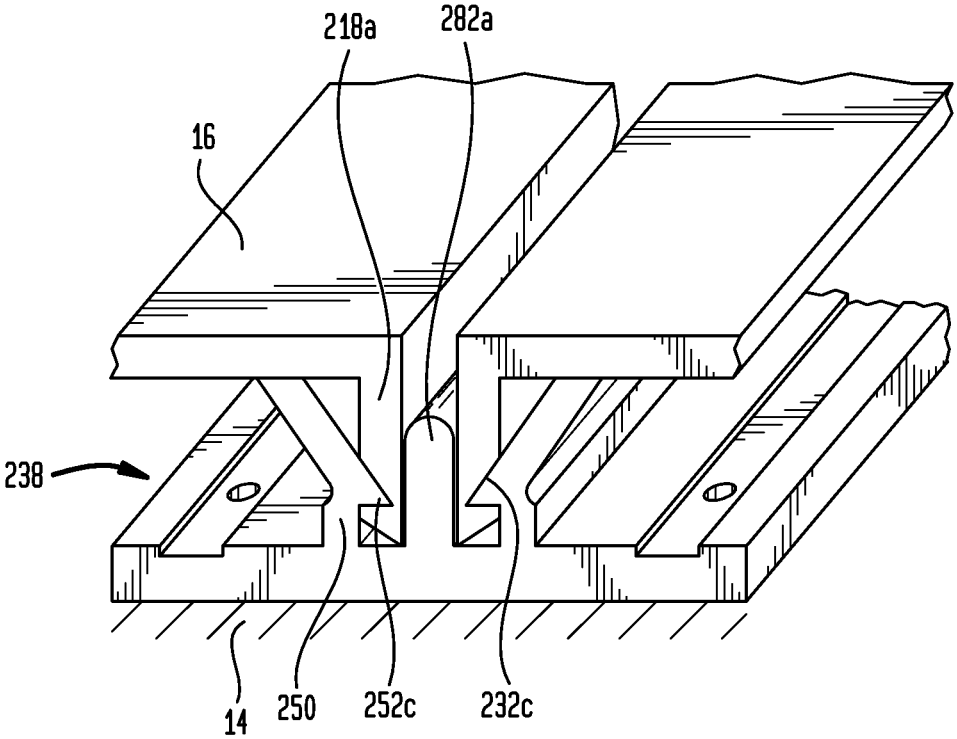
FIG. 40B is a perspective view showing two wall panels connected together by a frame extrusion according to another embodiment of the present invention.
Figure 40C:
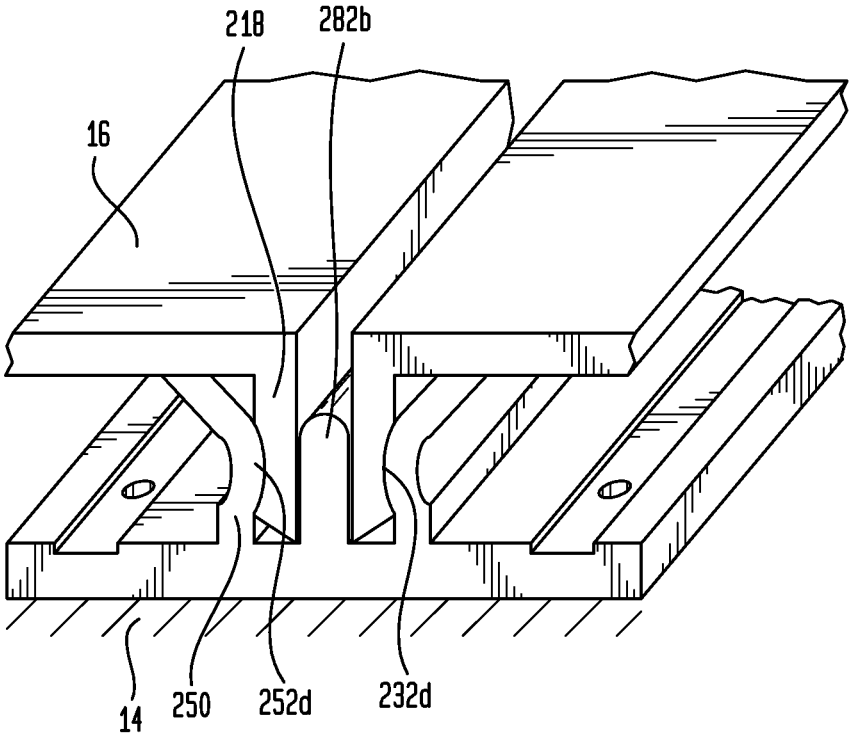
FIG. 40C is a perspective view showing two wall panels connected together by a frame extrusion according to another embodiment of the present invention.

FIGS. 40B and 40C show embodiments similar to FIG. 40A, with spacer post members 282*a* and 282*b*, respectively, in which FIG. 40B shows cut-outs 232*c* and projections 252*c* formed in a nose-shape similar to the embodiments of FIGS. 1-27, while FIG. 40C shows cut-outs 232*d* and projections 252*d* formed in an arcuate shape. The key aspect to these embodiments, as with the other embodiments, is that each bent end securing wall 250 is flexible and resilient so that, when a bent end section 218 is inserted into the space between the bent end securing wall 250 and the spacer post member 282, the bent end securing wall 250 will be biased away to allow the bent end section 218 to enter the space, whereupon the bent end securing wall 250, because of its resilience will resume its original unbiased position so that the projections are engaged in the cut-out sections.

Figure 40D:
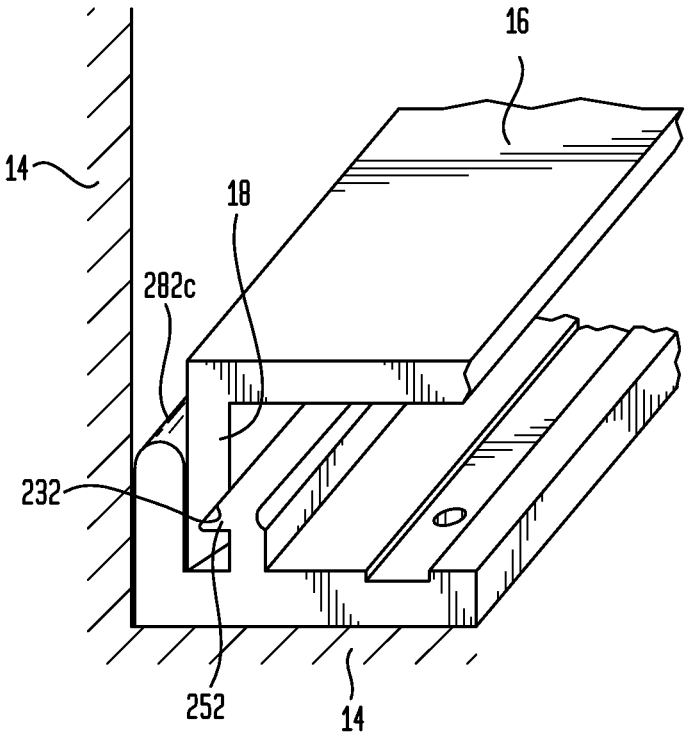
FIG. 40D is a perspective view showing two wall panels connected together by a frame extrusion according to another embodiment of the present invention.

FIG. 40D shows a variation of the embodiment of FIG. 40B for use in a corner. This is similar to the embodiment of 4, but rather than using the existing wall 14 to define the space for insertion of a bent end section 18, a spacer post member 282*c* is provided against the existing wall 14. This has the advantage of providing a more positive definition of the space for insertion of bent end section 18, as well as providing a more aesthetic look to conform to the spaces provided between wall panels 16 throughout the remainder of the wall.

Figure 40E:
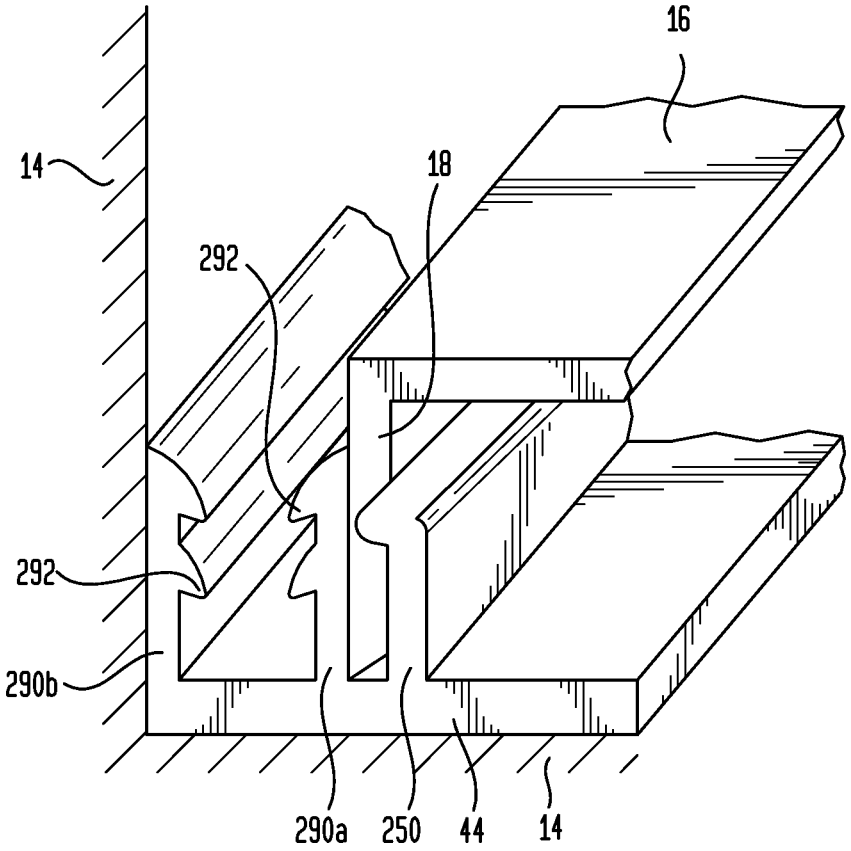
FIG. 40E is a perspective view showing two wall panels connected together by a frame extrusion according to another embodiment of the present invention.

FIG. 40E shows a variation of the embodiment of FIG. 40D, but with the spacer post member 282*c* replaced by second legs 290*a* and 290*b* with barbs 292 on the inner surfaces thereof that are angled toward base section 44. In this manner, a plug (not shown) can be inserted within the gap between second legs 290*a* and 290*b* for closing off the gap and providing an aesthetic appearance, with the plug engaged by barbs 292. Bent end section 18 is inserted into the space between second leg 290*a* and bent end securing wall 250 so as to deflect bent securing wall 250 in the manner discussed above.

Figure 41:
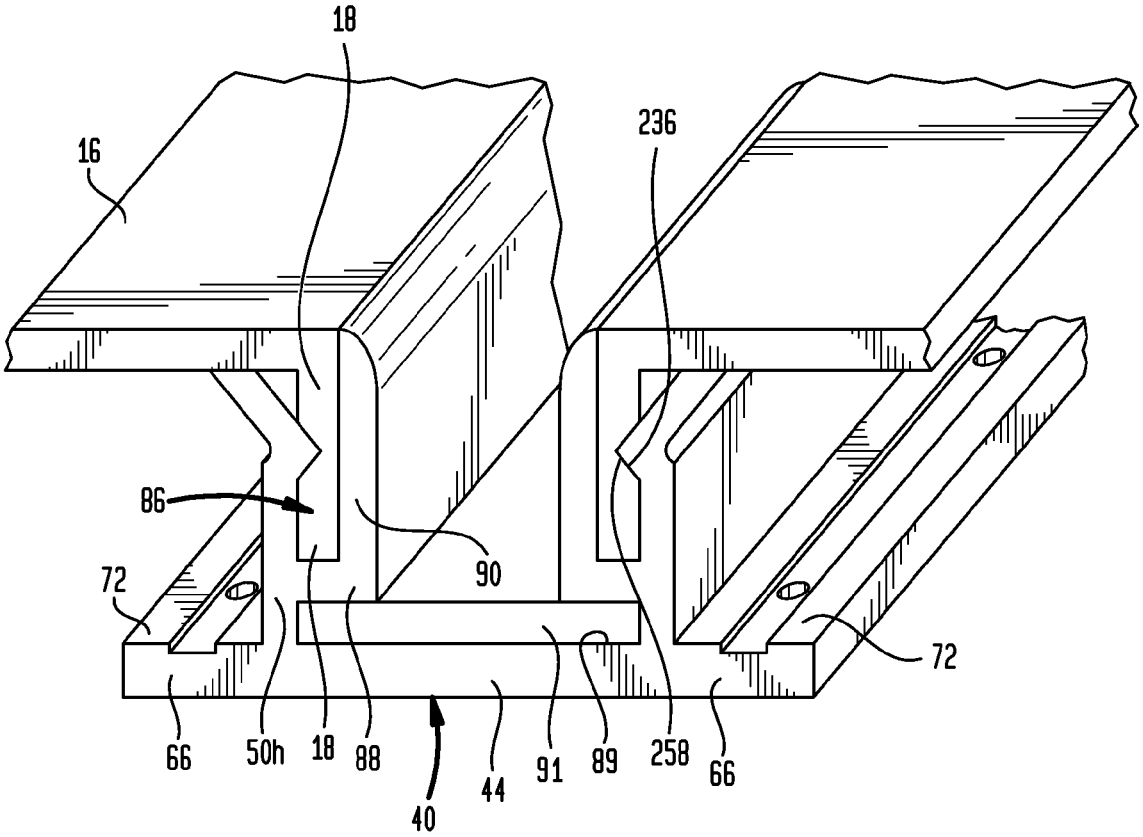
FIG. 41 is a perspective view showing two wall panels connected together by a frame extrusion according to another embodiment of the present invention.

FIG. 41 shows another embodiment which is identical to the embodiment of FIG. 18, except that holding surfaces 36 and 58 are replaced by reverse inclined wedge surfaces 236 and 258, respectively.

Figure 42:
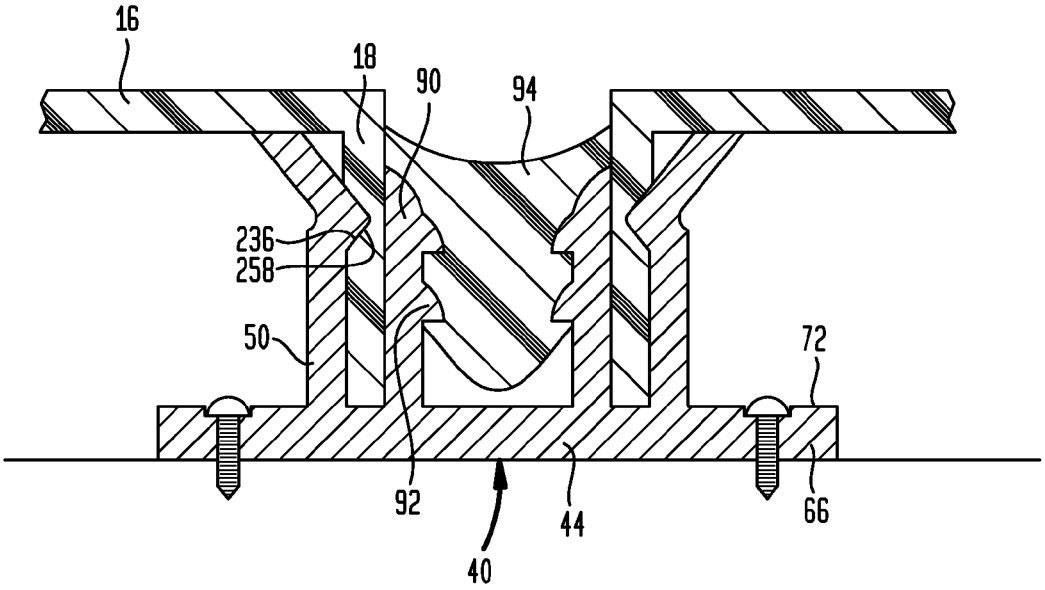
FIG. 42 is a cross-sectional view showing two wall panels connected together by a frame extrusion according to another embodiment of the present invention.

FIG. 42 shows another embodiment which is identical to the embodiment of FIG. 19, except that holding surfaces 36 and 58 are replaced by reverse inclined wedge surfaces 236 and 258, respectively.

Figure 42A:
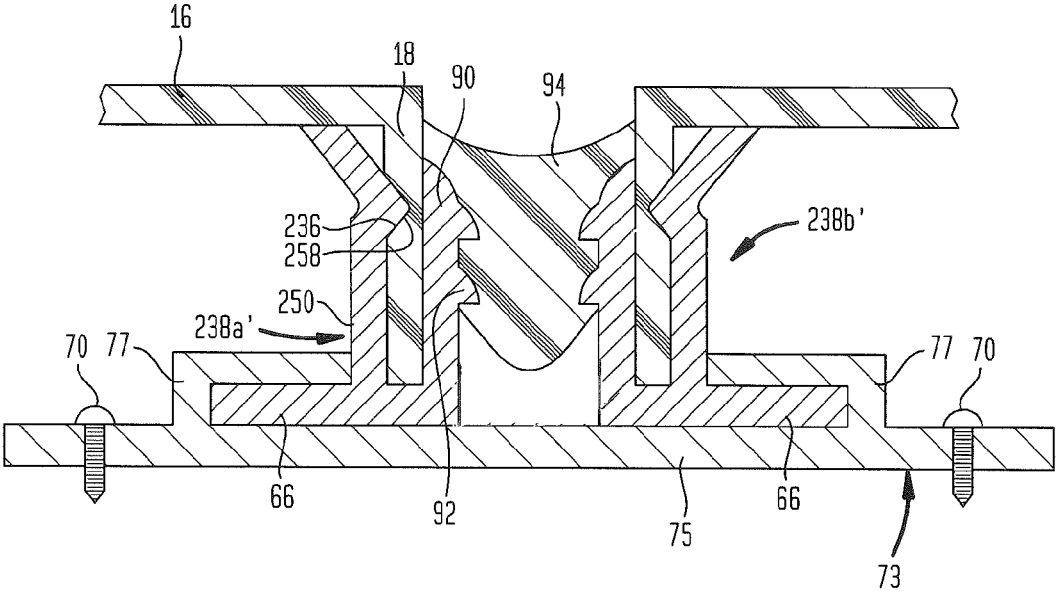
FIG. 42A is a cross-sectional view showing two wall panels connected together by a frame extrusion according to another embodiment of the present invention.

FIG. 42A shows a modification of the embodiment of FIG. 42 in which a separate base member 73 is first secured to a wall 14. Specifically, base member 73 includes a planar wall 75 that is secured to wall 14 by screws 70, with base member 73 including two inwardly directed L-shaped holding plates 77 extending therefrom in spaced relation to each other and facing each other. In this embodiment, main fastening extrusion 238 of FIG. 42 is separated into two fastening extrusions 238*a*= and 238*b*=, with wing walls 66 being inserted and captured within L-shaped holding plates 77. Thereafter, plug 94 can be inserted to maintain the spacing between main fastening extrusions 238*a*= and 238*b*=. Subsequently, it is only necessary to press fit bent end section 18 into the space between the respective bent end securing walls 250 and second legs 90.

Figure 42B:
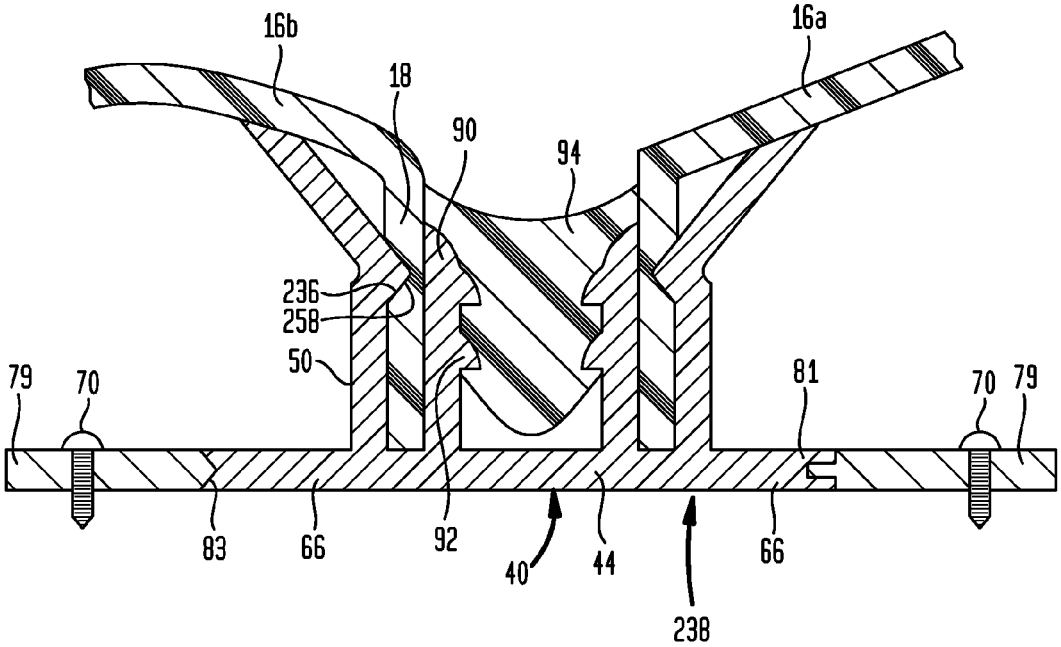
FIG. 42B is a cross-sectional view showing two wall panels connected together by a frame extrusion according to another embodiment of the present invention.

Alternatively, as shown in FIG. 42B, a separate securing wall 79 can be secured to wall 14 by screws 70 in abutting relation to the free end of a wing wall 66, and a locking arrangement can be provided for securing wing walls 66, and thereby main fastening extrusions 238, thereto. For example, this can include a tongue and groove arrangement 81 as shown at the right side of a FIG. 42B, a V-shaped end locking arrangement 83 as shown at the left side of FIG. 42B, or any other suitable arrangement. Further, as shown in FIG. 42B, main panel sections 16 of wall panels 12 do not have to be parallel to wall 14 and do not have to be planar, but can have other shapes, such as the angled main panel section 16*a* shown at the right side of FIG. 42B or the curved main panel section 16*b* shown at the left side of FIG. 42B. Alternatively, separate securing wall 79 can be eliminated, and main fastening extrusion 238 can be separated into two fastening extrusions 238*g*1 and 238*g*2 as in FIG. 40, but with inner edges of fastening extrusions 238*g*1 and 238*g*2 connected together by tongue and groove arrangement 81 or V-shaped locking arrangement 83.

Figure 42C:
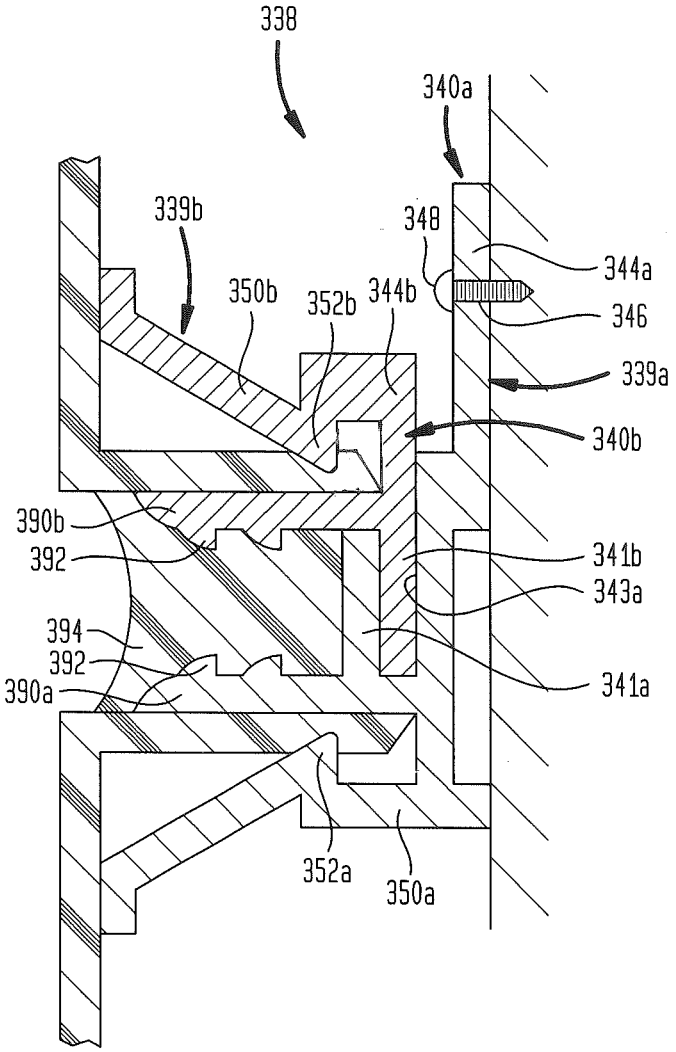
FIG. 42C is a cross-sectional view showing two wall panels connected together by a frame extrusion according to another embodiment of the present invention.

FIG. 42C shows a modification of the embodiment of FIG. 42A. In certain situations, it is difficult to secure the main fastening extrusion 238 to a wall. FIG. 42C provides a two piece arrangement of the main fastening extrusion that overcomes this problem. Specifically, as shown therein, main fastening extrusion 338 is provided with a first fastening section 339*a* having a base section 340*a* having a planar wall 344*a* that seats flush against existing wall structure 14, and which has a plurality of linearly aligned openings 346 extending therealong and through which screws 348 can be inserted to secure central wall panel 344 to existing wall structure 14. As with the embodiment of FIG. 19, the lower end of base section 340*a* has a bent end securing wall 350*a* extending outwardly therefrom, with a nose-shaped projection 352*a*, and a second leg 390*a* extending outwardly from base section 340*a* in parallel, spaced apart relation to bent end securing wall 350*a* by a spacing equal to or slightly greater than the width of a bent end section 18. This makes it easy to assemble first fastening section 339 to existing wall 14.

Main fastening extrusion 338 is provided with a second fastening section 339*b* which includes a base section 340*b* having a planar wall 344*b* with a second bent end securing wall 350*b* extending outwardly therefrom, with a nose-shaped projection 352*b*, and a second leg 390*b* extending outwardly from base section 340*b* in parallel, spaced apart relation to bent end securing wall 350*b* by a spacing equal to or slightly greater than the width of a bent end section 18.

First fastening section 339*a* includes a stub wall 341*a* that extends from first leg 390*a* toward second leg 390*b* in parallel, spaced apart relation from planar wall 344*a* so as to define a space or groove 343*a* therein, while second fastening section 339*b* includes a tongue wall 341*b* that extends from second leg 390*b* toward first leg 390*a* so as to slidably fit and be held within groove 343*a*, after first fastening section 339*a* is secured to wall 14. Thereafter, assembly of the wall panels is the same as discussed above in regard to FIG. 19.

In this regard bars 392 are provided on the inner facing surfaces of second legs 390*a* and 390*b* for holding a plug 394 therein.

Figure 43:
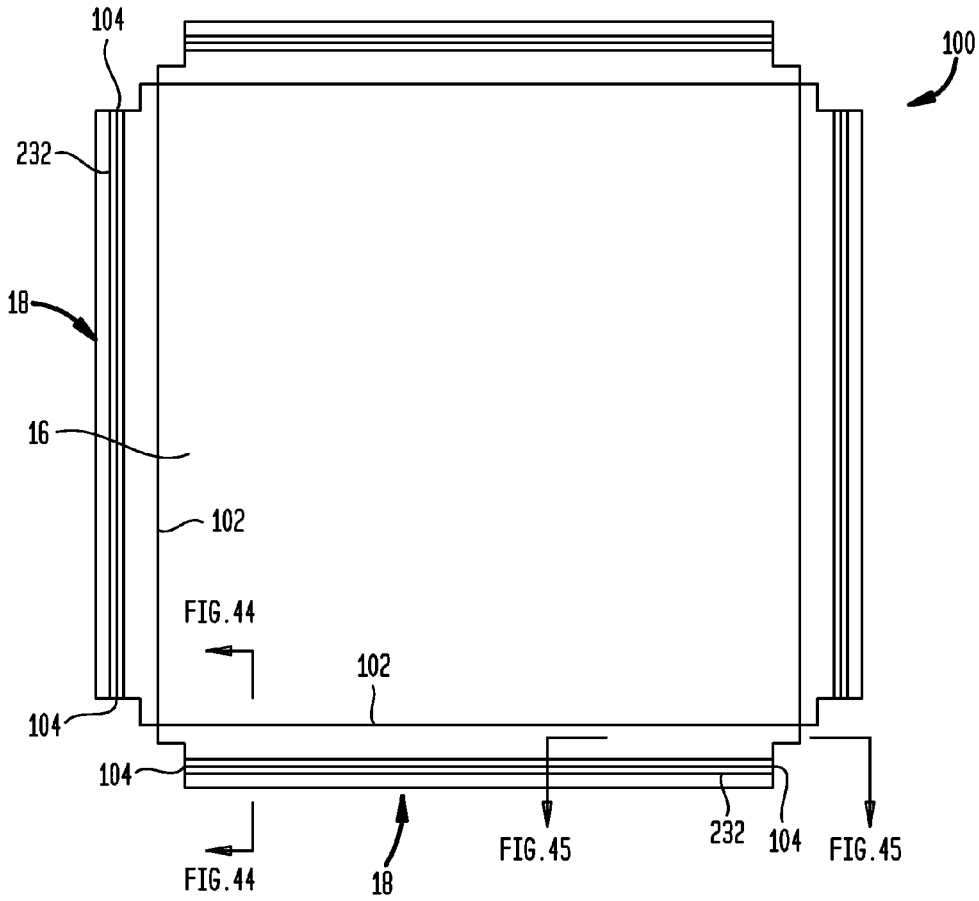
FIG. 43 is a top plan view of a planar blank used for forming a wall panel.
Figure 44:
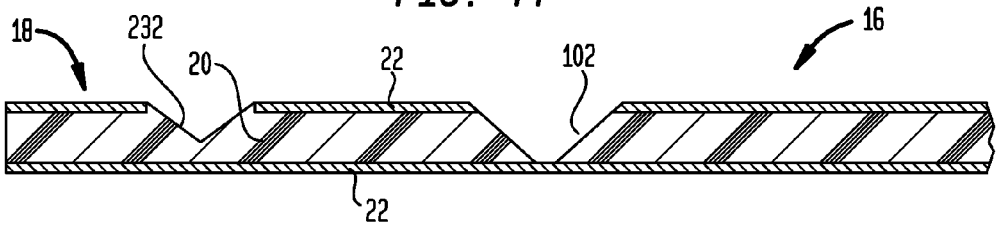
FIG. 44 is a cross-sectional view of the planar blank of FIG. 43, taken along line 44-44 thereof.
Figure 45:
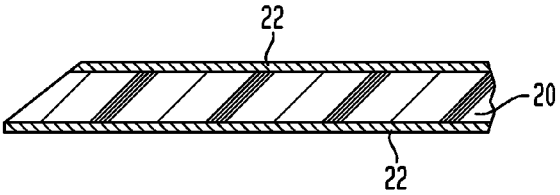
FIG. 45 is a cross-sectional view of the planar blank of FIG. 43, taken along line 45-45 thereof.

FIGS. 43-45 show another embodiment which is identical to the embodiment of FIGS. 20-22, except that cut-out section 32 is replaced by a V-shaped cut-out section 232. Of course, this embodiment would be used in the same arrangement as shown in FIG. 25A.

It will be further appreciated that, in accordance with the present invention, the V-shaped cut-out section 32, 232 can be provided in the inner facing surface of each bent end securing wall 50, 250, and the V-shaped projection 52, 252 can be provided in the corresponding facing surface of the bent end section 18 of the wall panel 12, 212, that is, a reversal of parts from that shown in the drawings.

It will be still further appreciated that, in each of the above embodiments, it is preferable that V-shaped cut-out sections 32, 232 extend through the outer facing thin aluminum wall 22 and through most or all of polyethylene core 20.

Figure 46:
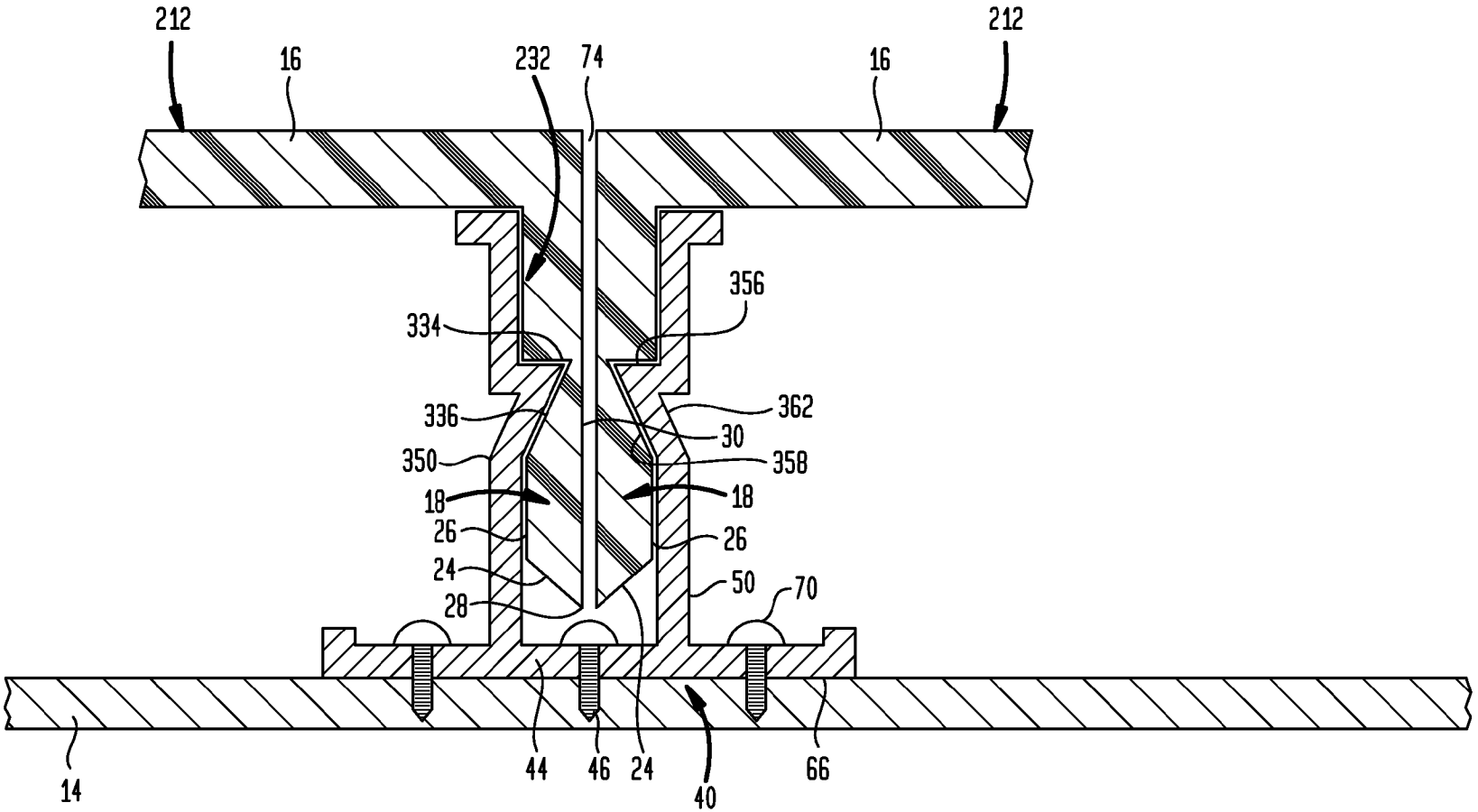
FIG. 46 is a cross-sectional view showing two wall panels connected together by a frame extrusion according to another embodiment of the present invention.

It will be appreciated that cut-out sections 232 and projections 252 need not have a V-shape, but can have any other suitable shape, as long as they include a reverse inclined wedge surface 236 and a reverse inclined wedge surface 258, respectively, to enable projection 252 to releasably lock in cut-out section 232, while also permitting disengagement thereof by a pulling action on the wall panels 212 when it is desired to change the wall panels 212. For example, as shown in FIG. 46, which corresponds to the embodiment of FIGS. 3 and 29, there are provided a reverse nose-shaped cut-out section 332 and a reverse nose-shaped projection 352 which retain the reverse inclined wedge surfaces 336 and 358, respectively to permit the wedging action for removal and replacement of wall panels 212. However, inclined wedge surface 234 is replaced by a planar surface 334 parallel to base section 40 and in like manner, inclined wedge surface 256 is replaced by a corresponding planar surface 356 of each bent end securing wall 350. A corresponding nose-shaped cut-out section 362 is also provided. Of course, it will be appreciated that because of the reverse orientation of nose-shaped cut-out section 332 and nose-shaped projection 352 from those of nose-shaped cut-out section 32 and nose-shaped projection 52 of FIG. 3, planar surfaces 334 and 356 do not constitute holding surfaces which would prevent the removal of the wall panels.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

The invention claimed is:

1. A fastener for attaching wall panels to a supporting surface, the fastener comprising:

a base section;

a first securing wall extending upwardly from the base section, the first securing wall including an inner surface and an inwardly directed first projection;

an L-shaped first extension coupled to the first securing wall, the first extension including a first leg extending inwardly from the inner surface of the first securing wall overlying the base section in spaced apart relationship forming a first opening therebetween, and a second leg extending upwardly from the first leg opposing the inner surface of the first securing wall in spaced apart relationship forming a second opening therebetween, and the first projection extending into the second opening between the first securing wall and the second leg and extending in facing relation toward said second leg;

a second securing wall extending upwardly from the base section, the second securing wall including an inner surface and an inwardly directed second projection; and an L-shaped second extension coupled to the second securing wall, the second extension including a first leg extending inwardly from the inner surface of the second securing wall overlying the base section in spaced apart relationship forming a third opening therebetween, and a second leg extending upwardly from the first leg opposing the inner surface of the second securing wall in spaced apart relationship forming a fourth opening therebetween and the second projection extending into the fourth opening between the second securing wall and the second leg of the second extension and extending in facing relation toward said second leg of the second extension;

wherein the first and second projections have an inclined surface terminating at a holding surface arranged parallel to the base section; and wherein the first and second securing walls are configured to be biased outwardly upon application of a bending force by an engagement of a portion of a respective wall panel with the inclined surface of the first and second projections for aligning the projections with an opening in a respective wall panel, whereupon release of the bending force causes the first and second securing walls to become unbiased whereby the first and second projections are received within an opening of a respective wall panel for securing the wall panel thereto.

2. The fastener of claim 1, wherein the second legs of the first and second extensions are spaced apart forming a fifth opening therebetween in communication with the first and third openings.

3. The fastener of claim 2, wherein the second leg of the first securing wall and the second leg of the second securing wall each have at least one barb extending into the fifth opening.

4. The fastener of claim 1, wherein the base section, the first and second securing walls and first and second extensions are a one piece unitary member.

5. The fastener of claim 1, wherein the second and fourth openings form a space dimensioned substantially equal to a thickness of a portion of a wall panel configured to be received therein.

6. A fastener for attaching wall panels having a bent end section provided with an opening to a supporting structure, the fastener comprising:

an elongated base section configured for attachment to a supporting structure;

a first securing wall extending upwardly from the base section, the first securing wall having an inner surface and an inwardly directed first projection, the first projection having an inclined surface terminating at a holding surface;

an L-shaped first extension coupled to the first securing wall, the first extension including a first leg extending inwardly from the inner surface of the first securing wall overlying the base section, and a second leg extending upwardly from the first leg opposing the inner surface of the first securing wall in spaced apart relationship forming a first opening therebetween, and the first projection extending into the first opening between the first securing wall and the second leg and extending in facing relation toward said second leg;

a second securing wall extending upwardly from the base section, the second securing wall having an inner surface and an inwardly directed second projection, the second projection having an inclined surface terminating at a holding surface;

an L-shaped second extension coupled to the second securing wall, the second extension including a first leg extending inwardly form the inner surface of the second securing wall overlying the base section, and a second leg extending upwardly from the first leg opposing the inner surface of the second securing wall in spaced apart relationship forming a second opening therebetween and the second projection extending into the second opening between the second securing wall and the second leg of the second extension and extending in facing relation toward said second leg of the second extension;

wherein the second legs of the first and second extensions are spaced apart forming a third opening therebetween; and wherein the first and second securing walls are configured to be biased outwardly upon application of a bending force by an engagement of a portion of a respective bent end section with the inclined surface of the first and second projections for aligning the projections with an opening in a respective bent end section, whereupon release of the bending force causes the first and second securing walls to become unbiased whereby the first and second projections are received within an opening of a respective bent end section for securing the wall panels thereto.

7. The fastener of claim 6, wherein the holding surfaces of the first and second projections are arranged parallel to the base section.

8. The fastener of claim 6, wherein the holding surfaces of the first and second projections are arranged upwardly extending at an incline to the base section.

9. The fastener of claim 6, wherein the base section, the first and second securing walls and first and second extensions are a one piece unitary member.

10. The fastener of claim 6, wherein the first and second openings form a space dimensioned substantially equal to a thickness of a received portion of a bent end section of a wall panel.

11. The fastener of claim 6, wherein the second leg of the first securing wall and the second leg of the second securing wall each have at least one barb extending into the third opening.

12. A fastener for attaching wall panels to a supporting surface, the fastener comprising:

a base section;

a first securing wall extending upwardly from the base section having an inwardly directed first projection;

an L-shaped first extension attached to the first securing wall forming a first opening therebetween receiving the first projection and the first projection extending into the first opening between the first securing wall and the first extension and extending in facing relation toward said first extension;

a second securing wall extending upwardly from the base section having an inwardly directed second projection; and an L-shaped second extension attached to the second securing wall forming a second opening therebetween receiving the second projection and the second projection extending into the second opening between the second securing wall and the second extension and extending in facing relation toward said second extension;

wherein the first and second securing walls are configured to be biased outwardly upon application of a bending force by an engagement of a portion of a respective wall panel with one of the first and second protections.

13. The fastener of claim 12, wherein the first and second extensions are spaced upwardly of the base section to form an opening therebetween.

14. The fastener of claim 12, wherein the first and second extensions are spaced apart forming a third opening therebetween, and at least one barb projecting from each of the first and second extensions into the third opening.

15. The fastener of claim 12, wherein the first and second projections have an inclined surface terminating at a holding surface.

16. The fastener of claim 12, wherein the first and second extensions are spaced apart overlying the base section forming an opening therebetween.

17. A system for mounting a plurality of wall panels to a supporting structure, the system comprising:

said plurality of wall panels having a main panel and at least one bent end section arranged at an angle to the main panel, and a cut out extending into at least a portion of the bent end section, the cut out forming a first holding surface in the bent end section; and a plurality of fasteners for attaching said plurality of wall panels to the supporting structure, the fasteners comprising:

an elongated base section;

a first securing wall extending upwardly from the base section, the first securing wall including an inner surface and an inwardly directed first projection;

an L-shaped first extension coupled to the first securing wall, the first extension including a first leg extending inwardly from the inner surface of the first securing wall overlying the base section in spaced apart relationship forming a first opening therebetween, and a second leg extending upwardly from the first leg opposing the inner surface of the first securing wall in spaced apart relationship forming a second opening therebetween, and the first projection extending into the second opening between the first securing wall and the second leg and extending in facing relation toward said second leg;

a second securing wall extending upwardly from the base section, the second securing wall including an inner surface and an inwardly directed second projection; and an L-shaped second extension coupled to the second securing wall, the second extension including a first leg extending inwardly from the inner surface of the second securing wall overlying the base section in spaced apart relationship forming a third opening therebetween, and a second leg extending upwardly from the first leg opposing the inner surface of the second securing wall in spaced apart relationship forming a fourth opening therebetween and the second projection extending into the fourth opening between the second securing wall and the second leg of the second extension and extending in facing relation toward said second leg of the second extension.

18. The system of claim 17, wherein the second legs of the first and second extensions are spaced apart forming a fifth opening therebetween in communication with the first and third openings.

19. The system of claim 17, wherein the first and second projections have an inclined surface terminating at a holding surface arranged parallel to the base section.

20. The system of claim 17, wherein the first and second securing walls are configured to be biased outwardly upon application of a bending force by an engagement of a portion of a respective bent end section with the inclined surface of the first and second projections for aligning the projections with a cutout in a respective bent end section, whereupon release of the bending force causes the first and second securing walls to become unbiased whereby the first and second projections are received within a cutout of a respective bent end section for securing the wall panel thereto.

21. The system of claim 17, wherein the first and second projections have an inclined surface terminating at a holding surface arranged upwardly extending at an incline to the base section.

22. The system of claim 21, wherein the first and second securing walls are adapted to be biased outwardly upon application of a bending force by an engagement of a portion of a respective bent end section with the inclined surface of the first and second projections for aligning the projections with a cutout in a respective bent end section, whereupon release of the bending force causes the first and second securing walls to become unbiased whereby the first and second projections are received within a cutout of a respective bent end section for releasably securing the wall panel thereto.

23. The system of claim 18, wherein the second leg of the first securing wall and the second leg of the second securing wall each have at least one barb extending into the fifth opening.

24. The system of claim 17, wherein the base section, the first and second securing walls and first and second extensions are a one piece unitary member.

25. The system of claim 17, wherein the second and fourth openings form a space dimensioned substantially equal to a thickness of a portion of a bent end section configured to be received therein.

* * * * *